US010625887B2

(12) United States Patent
Mitsusada et al.

(10) Patent No.: US 10,625,887 B2
(45) Date of Patent: Apr. 21, 2020

(54) SHEET BUNDLING DEVICE

(71) Applicant: GLORY LTD., Himeji-shi, Hyogo (JP)

(72) Inventors: Yoshikazu Mitsusada, Hyogo (JP); Toshihiko Kobayashi, Hyogo (JP); Hitoshi Kobayashi, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 539 days.

(21) Appl. No.: 14/908,171

(22) PCT Filed: Jul. 24, 2014

(86) PCT No.: PCT/JP2014/003917
§ 371 (c)(1),
(2) Date: Jan. 28, 2016

(87) PCT Pub. No.: WO2015/015780
PCT Pub. Date: Feb. 5, 2015

(65) Prior Publication Data

US 2016/0167817 A1 Jun. 16, 2016

(30) Foreign Application Priority Data

Jul. 31, 2013 (JP) ..... 2013-159146

(51) Int. Cl.
*B65B 27/08* (2006.01)
*B65B 35/36* (2006.01)
(Continued)

(52) U.S. Cl.
CPC ..... *B65B 27/08* (2013.01); *B65B 35/36* (2013.01); *B65B 35/50* (2013.01); *B65B 57/04* (2013.01); *B65B 2210/02* (2013.01)

(58) Field of Classification Search
CPC ..... B65B 13/18; B65B 13/20; B65B 27/08; B65B 13/04; B65B 13/06; B65B 35/36; B65B 35/50; B65B 57/04; B65B 2210/02
(Continued)

(56) References Cited

U.S. PATENT DOCUMENTS 2,195,043 A * 3/1940 Wright ..... B65B 13/06 100/26
3,525,192 A * 8/1970 Brugh ..... B65B 13/06 53/420
(Continued)

FOREIGN PATENT DOCUMENTS

EP 2 615 036 A1 7/2013
JP 4-253615 A 9/1992
(Continued)

OTHER PUBLICATIONS

European Search Report (Application No. 14833073.1—PCT/JP2014/003917) (11 pages—dated Feb. 24, 2017).

*Primary Examiner* — Robert F Long
*Assistant Examiner* — Patrick B Fry
(74) *Attorney, Agent, or Firm* — Renner, Kenner, Greive, Bobak, Taylor & Weber

(57) ABSTRACT

Disclosed herein is a banknote handling apparatus 100 functioning as a paper sheet bundling device configured to bundle stacked banknotes with a tape T. The apparatus includes bundling stackers 4, 4 configured to bundle the banknotes, a tape loop forming unit 92 configured to form a small tape loop L1 from the tape T and then feed the tape T to enlarge the small tape loop L1 into a large tape loop L2, and a second transport unit 8 configured to grip the banknotes stacked in the bundling stackers 4 to transport the banknotes into the large tape loop L2.

12 Claims, 23 Drawing Sheets

(51) Int. Cl.
*B65B 35/50* (2006.01)
*B65B 57/04* (2006.01)

(58) Field of Classification Search
USPC ..... 53/528; 100/3, 25, 26
See application file for complete search history.

(56) References Cited

U.S. PATENT DOCUMENTS 3,613,557 A * 10/1971 Coleman ..... B65B 13/06 100/26
3,783,575 A * 1/1974 Angenendt ..... B65C 7/00 53/399
3,804,001 A * 4/1974 Longerich ..... B65B 13/30 100/4
3,831,512 A * 8/1974 Johnson ..... B65B 13/06 100/26
4,256,032 A * 3/1981 Davis ..... B65B 13/06 100/26
4,393,763 A * 7/1983 Sauer ..... B65B 13/10 100/2
4,423,673 A * 1/1984 Ball ..... B65B 13/10 100/28
4,438,689 A * 3/1984 Simich ..... B65B 27/12 100/25
4,494,360 A * 1/1985 Flensburg ..... B65B 27/08 100/17
4,499,709 A * 2/1985 Miyano ..... B65B 27/08 156/212
4,870,807 A * 10/1989 Palamides ..... B65B 27/08 53/528
5,172,179 A * 12/1992 Tani ..... B42C 1/125 100/26
5,233,816 A * 8/1993 Moriya ..... B65B 27/08 100/27
5,353,576 A * 10/1994 Palamides ..... B65B 27/08 414/790.5
5,735,108 A * 4/1998 Tuji ..... B65B 27/08 270/58.08
5,890,423 A * 4/1999 Lih ..... B65B 13/06 100/26
6,629,398 B2 * 10/2003 Pearson ..... B65B 13/06 100/29
6,637,324 B2 * 10/2003 Stamps ..... B65B 13/06 100/26
6,899,505 B2 * 5/2005 Hataya ..... B65B 13/06 412/36
6,902,367 B2 * 6/2005 Hataya ..... B65B 13/18 412/36
7,377,213 B1 * 5/2008 Haberstroh ..... B65B 13/22 100/26
7,428,867 B1 9/2008 Bell, Jr.
7,493,853 B2 * 2/2009 Xue ..... B30B 9/3071 100/280
7,628,279 B2 * 12/2009 Sekiguchi ..... B65H 31/3045 194/206
8,707,863 B2 * 4/2014 Zitzmann ..... B65B 13/14 100/2
8,746,135 B2 * 6/2014 Sakoguchi ..... G07D 11/0084 100/26
9,663,258 B2 * 5/2017 Sakoguchi ..... B65B 27/08
2002/0007616 A1 * 1/2002 Lamamy ..... B65B 13/022 53/399
2012/0240794 A1 9/2012 Sakoguchi et al.

FOREIGN PATENT DOCUMENTS

JP 8-169413 A 7/1996
JP 2597752 Y2 5/1999
JP 2005-247373 A 9/2005
JP 4298548 B2 4/2009
WO WO 2010/097913 A1 9/2010

* cited by examiner (A)

(B)

(A)

(B)

(C)

(A)

(B)

(A)

(B)

SHEET BUNDLING DEVICE

TECHNICAL FIELD

The present disclosure relates to a paper sheet bundling apparatus which bundles stacked paper sheets with a tape.

BACKGROUND ART

Patent Document 1 discloses a bundling apparatus which bundles an object with a tape. In this bundling apparatus, a small loop is formed by the tape and enlarged into a large loop. Then, the object is arranged in the large loop and the tape is rewound to wind the tape around the object, thereby bundling the object.

CITATION LIST

Patent Document

[Patent Document 1] Japanese Patent No. 4298548

SUMMARY OF THE INVENTION

Technical Problem

According to the bundling apparatus of the Patent Document 1, however, the object needs to be arranged manually in the large loop that has been formed once, which makes the bundling work complicated.

In view of the foregoing, it is therefore an object of the present disclosure to improve work efficiency when paper sheets are bundled together with a tape.

Solution to the Problem

The present disclosure is directed to a paper sheet bundling apparatus configured to bundle stacked paper sheets with a tape. The paper sheet bundling apparatus includes: a stacking unit configured to stack paper sheets; a tape loop forming unit configured to form a small tape loop from the tape and feed the tape to enlarge the small tape loop into a large tape loop; and a paper sheet transport unit configured to grip the paper sheets stacked in the stacking unit to transport the paper sheets into the large tape loop.

According to this configuration, a tape loop which is large enough to receive the paper sheets transported thereto is not formed from the beginning, but a small tape loop is formed first, and then is enlarged into a large tape loop. This allows easy formation of such a tape loop that is large enough to receive the paper sheets transported thereto. In addition, the paper sheet transport unit transports the paper sheets stacked in the stacking unit automatically into the large tape loop, thereby bundling the paper sheets with improved efficiency as compared with the configuration in which the paper sheets are transported manually into the tape loop.

In one embodiment, the paper sheet transport unit may transport the paper sheets into the large tape loop by moving the paper sheets in a direction parallel to longer edges thereof.

This configuration allows winding of the tape around the paper sheets in a direction parallel to their shorter edges by rewinding the tape forming the large tape loop.

In another embodiment, the paper sheet transport unit may remove the paper sheets from the stacking unit by moving the paper sheets in a direction parallel to shorter edges thereof.

According to this configuration, the paper sheets are removed in a direction parallel to their shorter edges, and thus the distance traveled by the paper sheets removed from the stacking unit is reducible as compared with the configuration in which the paper sheets are removed in a direction parallel to their longer edges. That is to say, the distance traveled by the paper sheet transport unit is reducible, which eventually allows saving of the space in the paper sheet bundling apparatus.

In still another embodiment, the stacking unit may include a plurality of stacking units. The paper sheet transport unit may remove the paper sheets from a selected one of the plurality of stacking units and may transport the removed paper sheets into the large tape loop.

According to this configuration, the paper sheet transport unit transports the paper sheets automatically from the selected one of the plurality of stacking units into the large tape loop. As a result, the process to be performed until the paper sheets stacked in the stacking unit are bundled may be carried out more efficiently and more quickly than in the case where the same process is performed manually.

In this particular embodiment, the plurality of stacking units may be arranged at different positions in a vertical direction, and the paper sheet transport unit may move in the vertical direction after having removed the paper sheets from the stacking unit.

According to this configuration, the paper sheet transport unit is allowed to move the paper sheets in at least three different directions, namely, the vertical direction, the direction parallel to their shorter edges, and the direction parallel to their longer edges. This allows transportation of the paper sheets to various different locations through various different paths.

In yet another embodiment, the paper sheet bundling apparatus may further include a temporary gripping unit configured to temporarily grip the paper sheets transported into the large tape loop. The paper sheet transport unit may retreat from a bundling position of the tape after the temporary gripping unit has gripped the paper sheets.

According to this configuration, the paper sheet transport unit retreats from the bundling position for bundling the paper sheets when the paper sheets are bundled together with the tape, and thus the paper sheet transport unit is allowed to grip the paper sheets being transported into the large tape loop without taking the bundling position into account. That is to say, in transporting the paper sheets into the large tape loop, the paper sheet transport unit is allowed to grip the paper sheets at a suitable position for the transport.

In yet another embodiment, the bundling position of the tape relative to the paper sheets may be adjustable in accordance with the degree of insertion of the paper sheets brought into the large tape loop by the paper sheet transport unit. The temporary gripping unit may be configured such that the position of the temporary gripping unit in gripping the paper sheets is adjustable in accordance with the degree of insertion of the paper sheets into the large tape loop by the paper sheet transport unit.

According to this configuration, the degree of insertion of the paper sheets into the large tape loop is changed according to the bundling position of the tape. Thus, if the position of the temporary gripping unit is fixed, the temporary gripping unit may possibly fail to grip the paper sheets suitably depending on the degree of insertion of the paper sheets into the large tape loop. Therefore, by adjusting the position of the temporary gripping unit in gripping the paper sheets in accordance with the degree of insertion of the paper sheets into the large tape loop, the paper sheets are gripped suitably by the temporary gripping unit irrespective of the degree of insertion of the paper sheets into the large tape loop.

In yet another embodiment, the paper sheet bundling apparatus may further include a bundle transport unit configured to transport the bundled paper sheets in a direction parallel to shorter edges thereof. The paper sheet transport unit may draw the bundled paper sheets in an opposite direction to the direction of transport of the paper sheets into the large tape loop, and the bundle transport unit may transport the bundled paper sheets drawn by the paper sheet transport unit.

In some cases, some structure may be present at the destination of the paper sheets moving in the direction parallel to their shorter edges from the position where the paper sheets are bundled. In such a case, according to this configuration, the bundled paper sheets are once drawn in a direction parallel to their longer edges so as to be transported in the direction parallel to their shorter edges while avoiding contact with the structure.

In yet another embodiment, the paper sheet bundling apparatus may further include a guide configured to come into contact with an outer peripheral surface of the large tape loop to define the shape of the large tape loop when the tape loop forming unit forms the large tape loop.

This configuration allows formation of the large tape loop into a suitable shape.

The tape loop forming unit may include a tape gripping part which rotates while gripping the tape at an end portion thereof to form the small tape loop and a feeder which feeds the tape to enlarge the small tape loop into the large tape loop, and may form the large tape loop under the tape gripping part.

According to this configuration, the small tape loop expands downward from the tape gripping part, and the large tape loop is formed under the tape gripping part finally. If the small tape loop expands upward, a portion of the tape loop may sag downward due to the tape's own weight during the formation of the large tape loop, because the tape is flexible. On the other hand, if the small tape loop is configured to expand downward, the tape loop does not sag easily during the formation of the large tape loop. That is to say, the large tape loop is formed easily.

In this particular embodiment, the paper sheet bundling apparatus may further include a bonding unit configured to bond together portions of the tape wound around the paper sheets, and a cutting unit configured to cut the tape at a portion not wound around the paper sheets. At least one of the bonding unit and the cutting unit may be arranged above the tape gripping part.

In another embodiment, the paper sheet bundling apparatus may further include a guide configured to come into contact with an outer peripheral surface of the large tape loop to define the shape of the large tape loop when the tape loop forming unit forms the large tape loop. The guide may include a lower guide which comes into contact with the outer peripheral surface of the large tape loop from under the large tape loop to define the shape of the large tape loop.

According to this configuration, the small tape loop expands downward to form the large tape loop. Thus, the large tape loop tends to expand downward due to the tape's own weight and eventually have a vertically elongated shape. On the other hand, providing the lower guide allows formation of the large tape loop, which tends to be elongated vertically, into a desired shape.

In this particular embodiment, the lower guide may have a pair of sidewalls which regulates the position of the tape in a tape width direction.

According to this configuration, the lower guide allows formation of the large tape loop into a desired shape, and for regulating the position of the tape in the tape width direction.

In another embodiment, the paper sheet bundling apparatus may further include a lateral guide configured to come into contact with the outer peripheral surface of the large tape loop horizontally with respect to the large tape loop to define the shape of the large tape loop when the tape loop forming unit forms the large tape loop.

This configuration allows defining of the shape of the large tape loop not only from below, but also horizontally. Thus, the large tape loop is easily formed into a desired shape.

In a specific embodiment, the lateral guide may be configured to retreat during the transport of the bundled paper sheets so as not to interfere with the transport of the bundled paper sheets.

According to this configuration, even if the lateral guide which comes into contact with the large tape loop horizontally is provided, the lateral guide retreats after the paper sheets have been bundled together. Thus, the bundled paper sheets are movable toward the position where the lateral guide was located.

The guide may define the shape of the large tape loop as a rectangle having rounded corners.

According to this configuration, the large tape loop that is large enough to receive the paper sheets transported thereto may be formed out of as short a tape as possible. That is to say, in the configuration in which the paper sheets are moved in a direction parallel to their longer edges and transported into the large tape loop, the cross-sectional shape of the paper sheets orthogonal to the moving direction of the paper sheets is rectangular. Thus, by forming the large tape loop in the rectangular shape, too, an extra portion of the tape to use to form the large tape loop is reducible as much as possible. Note that shaping the large tape loop into a rectangle having rounded corners instead of a regular rectangle allows smooth feeding of the tape in forming the large tape loop, and for smooth rewinding of the tape in winding the tape around the paper sheets.

In yet another embodiment, the paper sheet bundling apparatus may further include a clamp configured to press the paper sheets in a stacking direction when the paper sheets are bundled together with the tape. When the paper sheets are bundled with the tape, at least a portion of the tape gripping part may be caught in a gap between the tape and an upper surface of the bundled paper sheets. The paper sheet transport unit may draw the bundled paper sheets in an opposite direction to the direction of transport of the paper sheets into the large tape loop until the tape gripping part is withdrawn from the gap between the tape and the paper sheets. The clamp may include a pair of upper clamps which are arranged on respective sides of the tape in a tape width direction above the paper sheets, and a pair of lower clamps which are arranged on the respective sides of the tape in the tape width direction below the paper sheets and are configured to be movable vertically so as to sandwich the paper sheets between the upper and lower clamps. One of the pair of upper clamps on one side of the tape, toward which the paper sheets are drawn, may be configured to move upward when the bundled paper sheets are drawn.

According to this configuration, a portion of the tape gripping part needs to be withdrawn from the gap between the tape and the paper sheets to transport the bundled paper sheets. The portion of the tape gripping part is withdrawable from the gap between the tape and the paper sheets by moving the bundled paper sheets in a direction parallel to their longer edges. Note that the upper clamp is located on one side of the tape toward which the bundled paper sheets are drawn in the direction parallel to their longer edges, and thus the tape may be caught on the upper clamp when the paper sheets are drawn. Therefore, the upper clamp is moved upward when the bundled paper sheets are drawn. This allows drawing of the bundled paper sheets while preventing the tape from coming into contact with the upper clamp.

In yet another embodiment, the paper sheet bundling apparatus may further include a sensor configured to detect that the large tape loop has reached a predetermined size.

This configuration allows determination of whether the large tape loop has been formed successfully or not.

The sensor may detect that the large tape loop has reached the predetermined size by determining whether or not the tape is present at a predetermined position above the paper sheets transported into the large tape loop.

This configuration allows detection of the sag of the large tape loop accurately. That is to say, if any portion of the large tape loop sags inward, it is highly likely that the upper portion of the large tape loop sags due to the tape's own weight. Thus, providing the sensor at the above-described position allows detection of the sag at the position where the large tape loop tends to sag.

The tape loop forming unit may rewind the tape if the sensor does not detect that the large tape loop has reached the predetermined size even when the tape is fed to a length that allows formation of the large tape loop, and then feed the tape again to the length that allows formation of the large tape loop.

This configuration allows a retry of the formation of the large tape loop if the large tape loop has not been formed properly even if the tape is fed to the predetermined length. In that case, the tape is once rewound and then fed again. Thus, if the large tape loop has not been formed properly due to the sag of the tape, the large tape loop may possibly be formed properly by feeding the tape again.

Advantages of the Invention

The paper sheet bundling apparatus described above allows improvement of work efficiency when paper sheets are bundled together.

BRIEF DESCRIPTION OF THE DRAWINGS

FIGS. 9(A) and 9(B) illustrate a banknote compression process performed in a bundling stacker, wherein FIG. 9(A) illustrates a state just after the banknotes have been stacked, and FIG. 9(B) illustrates a state where the banknotes have just been compressed.

FIGS. 16(A)-16(C) illustrate how the respective members operate while the banknotes are transported into the large tape loop and gripped by the temporary gripping unit as viewed in a thickness direction of the banknotes, wherein FIG. 16(A) illustrates a state where the banknotes transported are about to reach the large tape loop, FIG. 16(B) illustrates a state where the banknotes are transported into the large tape loop, and FIG. 16(C) illustrates a state where the banknotes are gripped by the temporary gripping unit.

FIGS. 17(A)-17(C) illustrate how the respective members operate while the banknotes are transported into the large tape loop and gripped by the temporary gripping unit as viewed in a direction parallel to shorter edges of the banknotes, wherein FIG. 17(A) illustrates a state where the banknotes transported are about to reach the large tape loop, FIG. 17(B) illustrates a state where the banknotes are transported into the large tape loop, and FIG. 17(C) illustrates a state where the banknotes are gripped by the temporary gripping unit.

FIGS. 18(A)-18(C) illustrate how the respective members operate while the banknotes are gripped again by the gripper and the tape is wound around the banknotes as viewed in a thickness direction of the banknotes, wherein FIG. 18(A) illustrates a state where the gripper grips the banknotes again, FIG. 18(B) illustrates a state where a clamp presses the banknotes, and FIG. 18(C) illustrates a state where the tape is wound around the banknotes.

FIGS. 19(A)-19(C) illustrate how the respective members operate while the banknotes are gripped again by the gripper and the tape is wound around the banknotes as viewed in a direction parallel to shorter edges of the banknotes, wherein FIG. 19(A) illustrates a state where the banknotes are gripped again by the gripper, FIG. 19(B) illustrates a state where the banknotes are pressed by a clamp, and FIG. 19(C) illustrates a state where the tape is wound around the banknotes.

FIGS. 21(A) and 21(B) illustrate how the tape is bonded and cut, and a seal is stamped on the tape, wherein FIG. 21(A) illustrates a state where first and second pressers press the tape, and FIG. 21(B) illustrates a state where a heater heat-seals the tape and a cutter cuts the tape.

FIGS. 22(A)-22(C) illustrate how the respective members operate while the bundled banknotes are dispensed to a dispense unit as viewed in the thickness direction of the banknotes, wherein FIG. 22(A) illustrates a state where the bundled banknotes are removed in a second horizontal direction, FIG. 22(B) illustrates a state where a third transport unit grips the bundled banknotes, and FIG. 22(C) illustrates a state where the third transport unit transports the bundled banknotes to the dispense unit.

FIGS. 23(A) and 23(B) illustrate how the respective members operate while the bundled banknotes are dispensed to the dispense unit as viewed in a direction parallel to shorter edges of the banknotes, wherein FIG. 23(A) illustrates a state where the bundled banknotes are removed in the second horizontal direction, and FIG. 23(B) illustrates a state where the third transport unit grips the bundled banknotes.

FIGS. 25(A) and 25(B) illustrate how the respective members operate in another embodiment while the banknotes are transported into the large tape loop and gripped by the temporary gripping unit, and then gripped again by the gripper as viewed in a thickness direction of the banknotes, wherein FIG. 25(A) illustrates a state where the banknotes are transported into the large tape loop, and FIG. 25(B) illustrates a state where the gripper grips the banknotes again.

DESCRIPTION OF EMBODIMENTS

Embodiments will be described in detail below with reference to the drawings.

<General Configuration for Banknote Handling Apparatus>

Figure 1:
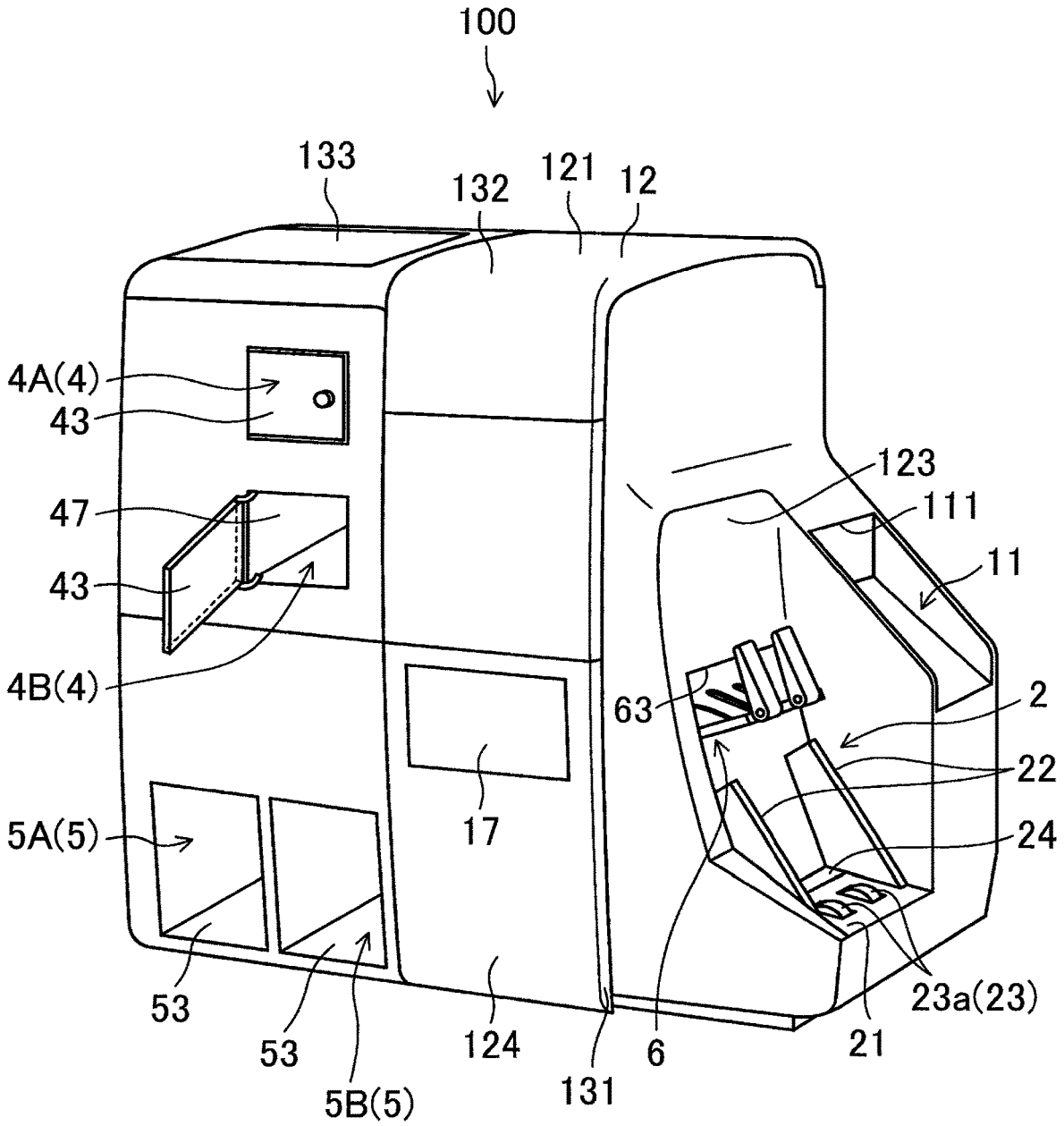
FIG. 1 is a view illustrating the appearance of a banknote handling apparatus.
Figure 2:
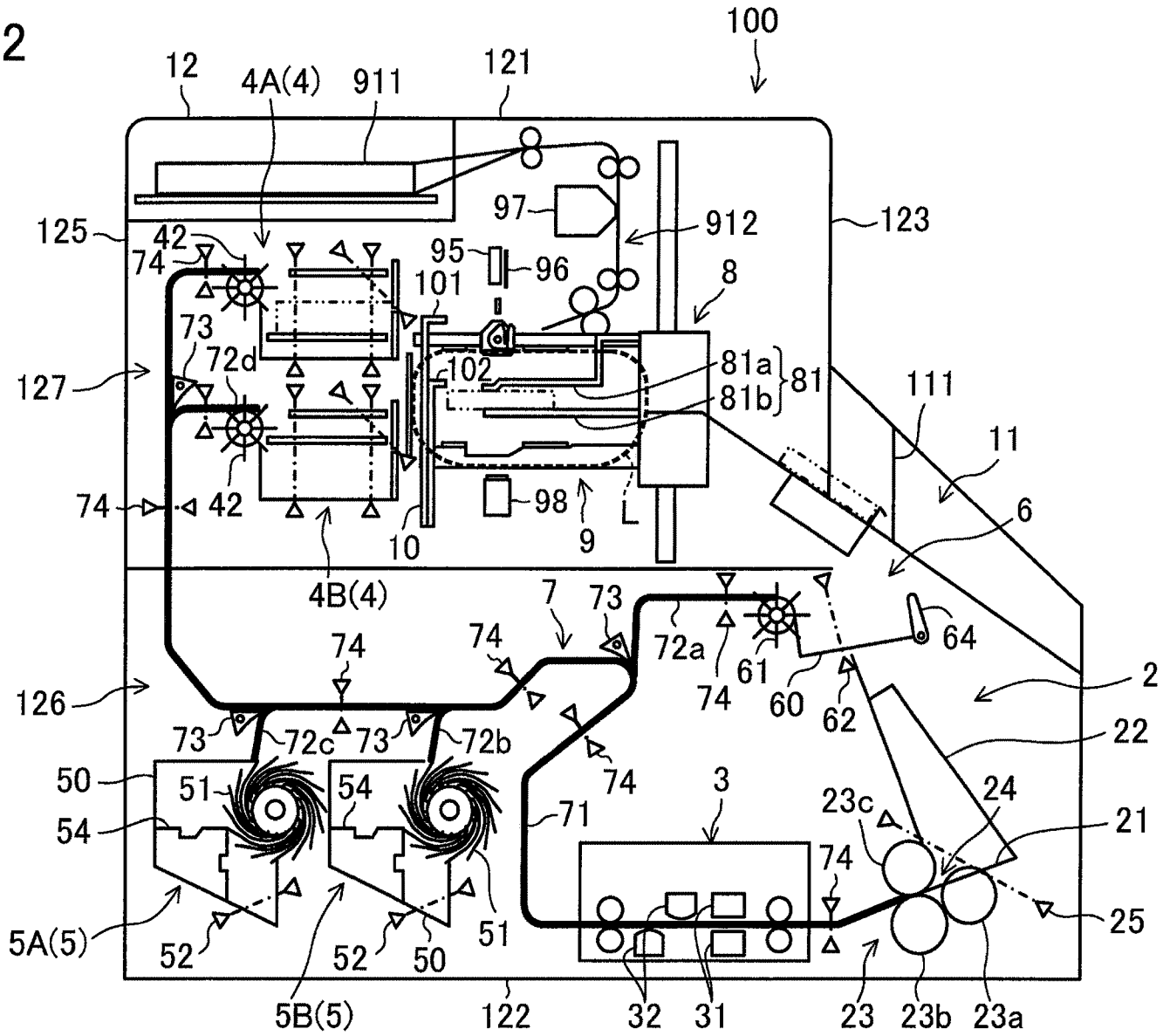
FIG. 2 illustrates a general configuration for the banknote handling apparatus.

FIG. 1 illustrates the appearance of a banknote handling apparatus 100, and FIG. 2 illustrates a general configuration for the banknote handling apparatus 100.

The banknote handling apparatus 100 is placed on a teller counter of a bank, for example, and is used by an operator. The banknote handling apparatus 100 takes loose banknotes therein, stacks the banknotes of a predetermined kind, bundles the banknotes in a predetermined bundling number, and dispenses the bundled banknotes.

The banknote handling apparatus 100 includes a hopper unit 2 which takes the banknotes placed thereon into the apparatus, a recognition unit 3 which recognizes the banknotes, bundling stackers 4 which stack the banknotes to be bundled, non-bundling stackers 5 which stack the banknotes not to be bundled, a reject stacker 6 which stacks rejected banknotes, a first transport unit 7 which transports the banknotes taken in through the hopper unit 2 to the recognition unit 3, the bundling stackers 4, the non-bundling stackers 5, and the reject stacker 6, a second transport unit 8 which transports the banknotes stacked in the bundling stackers 4 to the predetermined position, a bundling unit 9 which bundles the banknotes transported by the second transport unit 8, a third transport unit 10 which transports the banknotes that have been bundled (hereinafter referred to as "bundled banknotes"), a dispense unit 11 through which the bundled banknotes are dispensed, and a box-shaped housing 12 which houses the recognition unit 3, the bundling stackers 4, the non-bundling stackers 5, the reject stacker 6, the first transport unit 7, the second transport unit 8, the bundling unit 9, and the third transport unit 10.

The housing 12 has a top surface 121, a bottom surface 122, and four side surfaces. The housing 12 is a desktop type housing. That is to say, the bottom surface 122 of the housing 12 is not provided with casters or any other similar parts, and thus the housing 12 is configured to be placed on the desk.

The hopper unit 2 and the dispense unit 11 are provided through a first side surface 123, which is one of the four side surfaces of the housing 12. First outlets 47 of the bundling stackers 4 and second outlets 53 of the non-bundling stackers 5, which will be described in detail later, are provided through a second side surface 124, which is another one of the four side surfaces. The first and second side surfaces 123 and 124 are adjacent to each other.

The space inside the housing 12 is divided into a first handling section 126 configured to perform various kinds of handling processes for recognizing and sorting the banknotes and a second handling section 127 configured to perform various kinds of handling processes for bundling the banknotes to be bundled. The second handling section 127 is provided above the first handling section 126. The first handling section 126 includes the hopper unit 2, the recognition unit 3, the non-bundling stackers 5, and the reject stacker 6. The second handling section 127 includes the bundling stackers 4, the second transport unit 8, the bundling unit 9, and the third transport unit 10. Most of the first transport unit 7 is included in the first handling section 126.

The bundling stackers 4 include two stackers, namely, a first bundling stacker 4A and a second bundling stacker 4B. Both of the first and second bundling stackers 4A and 4B stack the banknotes to be bundled. The banknotes stacked as those to be bundled are determined as appropriate. The banknotes to be bundled are banknotes of a predetermined kind. The predetermined kind is identified by denomination or the orientation of the banknotes, or by determining whether the banknotes are fit or unfit, whether the banknotes are facing up or down, or whether the banknotes are new or not, for example. In this example, the banknotes to be bundled are fit banknotes of a predetermined denomination (e.g., 100 Chinese Yuan). In the following description, the banknotes which are recognized as normal by the recognition unit 3 will be hereinafter referred to as "normal banknotes," the banknotes which are not recognized as normal by the recognition unit 3 will be hereinafter referred to as "abnormal banknotes," and the banknotes which are transported in an abnormal state, e.g., skewed or multi-fed, will be hereinafter referred to as "abnormally transported banknotes." For example, one of the conditions for determining whether the banknotes are normal or not is whether the serial numbers of the banknotes are distinguishable or not. However, the normality of the banknotes may be checked based on a different condition, or an additional condition may be applied to determine whether the banknotes are normal or not. The banknotes which are determined as the normal banknotes but the destination of which (the bundling stacker, the non-bundling stacker, or other stackers) is not designated will be hereinafter referred to as "undesignated banknotes." Among the normal banknotes, those which are not stained or torn significantly will be hereinafter referred to as "fit banknotes," and those which are stained or torn significantly will be hereinafter referred to as "unfit banknotes." The bundling stacker 4 is an exemplary stacking unit.

The first and second bundling stackers 4A and 4B are arranged vertically, i.e., one on top of the other, in the second handling section 127. The first bundling stacker 4A is positioned over the second bundling stacker 4B. The first and second bundling stackers 4A and 4B have the same configuration. When it is not necessary to distinguish the two stackers from each other, they will be hereinafter referred to as "bundling stackers 4." A detailed configuration of the bundling stackers 4 will be described later.

The non-bundling stackers 5 include two stackers, namely, a first non-bundling stacker 5A and a second non-bundling stacker 5B. The first and second non-bundling stackers 5A and 5B are arranged substantially horizontally, i.e., side by side, in the first handling section 126. The second non-bundling stacker 5B is arranged closer to the hopper unit 2 than the first non-bundling stacker 5A is. When it is not necessary to distinguish the two stackers from each other, they will be hereinafter referred to as "non-bundling stackers 5." A detailed configuration of the non-bundling stackers 5 will be described later. The banknotes to be stacked in the non-bundling stackers 5 may be determined as appropriate. Here, the first non-bundling stacker 5A stacks unfit banknotes of the predetermined denomination. The second non-bundling stacker 5B stacks banknotes of every denomination but the predetermined denomination.

The reject stacker 6 stacks the rejected banknotes. The reject stacker 6 is positioned closer to the hopper unit 2 than the first and second non-bundling stackers 5A and 5B are. The reject stacker 6 is positioned at a level slightly higher than the first and second non-bundling stackers 5A and 5B. A detailed configuration of the reject stacker 6 will be described later. The banknotes to be stacked in the reject stacker 6 may be determined as appropriate. Here, the reject stacker 6 stacks "undesignated banknotes," "abnormal banknotes," and "abnormally transported banknotes" as the rejected banknotes.

The hopper unit 2 is provided for a portion of the first side surface 123 corresponding to the first handling section 126, and the dispense unit 11 is provided in a portion of the first side surface 123 corresponding to the second handling section 127.

The hopper unit 2 includes a mount 21 on which banknotes are placed, two guides 22, 22 which guide the banknotes placed on the mount 21, intake rollers 23, an inlet 24 through which the banknotes are taken in, and a banknote sensor 25 which detects the banknotes on the mount 21. In the present embodiment, the banknotes are placed on the hopper unit 2 such that the banknotes are taken in in a direction parallel to their shorter edges.

As shown in FIG. 1, the inlet 24 is arranged at a corner where the mount 21 and the first side surface 123 intersect with each other. The mount 21 is tilted such that the closer to the inlet 24, the lower the level of the mount 21. Thus, the banknotes on the mount 21 go toward the inlet 24 by themselves. The banknotes placed on the mount 21 are taken into the housing 12 through the inlet 24.

The banknote sensor 25 is provided near the inlet 24. The banknote sensor 25 includes a transmitter which emits light and a receiver which receives the light, and detects the banknotes when the light emitted from the transmitter toward the receiver is blocked. First and second banknote sensors 45 and 46, stacking sensors 52 and 62, tracking sensors 74, and first, second, and third tape sensors 9210, 9211 and 926*e* to be described later are also configured in the same manner. The banknote sensor 25 is arranged such that the light is blocked by the banknotes placed on the mount 21. That is to say, the banknote sensor 25 can detect that the banknotes are placed on the mount 21 when the light is blocked.

The guides 22, 22 are configured such that the interval between them is adjustable. Specifically, the interval between the guides 22, 22 is adjusted according to the banknotes placed on the mount 21.

The intake rollers 23 include kicker rollers 23*a*, feed rollers 23*b*, and gate rollers 23*c*. The kicker rollers 23*a* are partially exposed from the mount 21, and are in contact with the lowermost one of the banknotes placed on the mount 21. The kicker rollers 23*a* feed the lowermost one of the banknotes on the mount 21 to the inlet 24. Thus, the banknotes are taken in through the inlet 24 one by one. The banknotes taken in through the inlet 24 are distributed one by one by the feed rollers 23*b* and the gate rollers 23*c* into the housing 12. The banknotes thus taken in are passed to the first transport unit 7.

The dispense unit 11 includes a dispense port 111 through which the bundled banknotes are dispensed. In the dispense unit 11, the bundled banknotes are dispensed through the dispense port 111 in the direction parallel to their shorter edges.

The first transport unit 7 may be configured as a transport belt or any other suitable member. The first transport unit 7 includes a main transport path 71, first to fourth diverged paths 72*a* to 72*d* diverged from the main transport path 71, sorting mechanisms 73 provided at junctions between the main transport path 71 and the diverged paths, and a plurality of tracking sensors 74 which detect the passage of the banknotes. The first transport unit 7 transports the banknotes in the direction parallel to their shorter edges. The first transport unit 7 is an exemplary transport unit.

The main transport path 71 extends from the intake rollers 23 through the first bundling stacker 4A. The first diverged path 72*a* is the most upstream path in the main transport path 71, and the second, third, and fourth diverged paths 72*b*, 72*c* and 72*d* are arranged in this order downstream of the first diverged path 72*a*. When it is not necessary to distinguish the first to fourth diverged paths 72*a* to 72*d* from each other, they will be hereinafter referred to as "diverged paths 72." The first diverged path 72*a* extends to reach the reject stacker 6. The second diverged path 72*b* extends to reach the second non-bundling stacker 5B. The third diverged path 72*c* extends to reach the first non-bundling stacker 5A. The fourth diverged path 72*d* extends to reach the second bundling stacker 4B.

The sorting mechanisms 73 are driven by a solenoid (not shown). Each of the sorting mechanisms 73 sorts the banknotes transported through the main transport path 71 depending on whether they need to be diverged to an associated one of the diverged paths 72 or not. A tracking sensor 74 is provided upstream of each of the sorting mechanisms 73. The tracking sensors 74 are configured in the same manner as the banknote sensor 25. That is, the tracking sensors 74 can detect the passage of the banknotes if the reception of light by the receiver of the tracking sensor 74 is temporarily interrupted and then resumed. In guiding the banknotes to the diverged path 72, each sorting mechanism 73 is turned ON as soon as the tracking sensor 74 immediately upstream thereof detects the passage of the banknotes.

The recognition unit 3 is provided on the main transport path 71 upstream of the first diverged path 72*a*. The recognition unit 3 is configured to recognize each of the banknotes being transported in terms of their denomination, authentication, and fitness. Specifically, the recognition unit 3 includes a line sensor 31 and a magnetic sensor 32, and detects the feature of each banknote. The recognition unit 3 determines whether the feature of the banknote thus detected corresponds with any of the features of the banknotes stored, thereby making a determination about their denomination, authentication, and fitness.

The recognition unit 3 does not always include the line sensor and the magnetic sensor, but may include any other suitable sensor such as an infrared sensor and an ultraviolet sensor as long as they can detect the features of the banknotes. The line sensor 31 also has the function of optically reading the serial numbers printed on the banknotes. Note that a control unit 120 to be described later may have all of the functions of the recognition unit 3 but the detecting function.

The bundling unit 9 bundles the stacked banknotes. As will be described in detail later, the bundling unit 9 forms a tape loop L out of a tape, and rewinds the tape after the banknotes have been transported into the tape loop L so that the banknotes are bundled with the tape.

The second transport unit 8 grips the banknotes stacked in the bundling stacker 4 to transport the banknotes into the tape loop L. The second transport unit 8 includes a gripper 81 which grips the banknotes, a first horizontal displacement mechanism which displaces the gripper 81 in the horizontal direction parallel to the shorter edges of the banknotes (this direction will be hereinafter referred to as a "first horizontal direction"), a second horizontal displacement mechanism which displaces the gripper 81 in the horizontal direction parallel to the longer edges of the banknotes (hereinafter referred to as a "second horizontal direction"), and a vertical displacement mechanism which displaces the gripper 81 in the vertical direction. The second transport unit 8 is an exemplary paper sheet transport unit.

Figure 16:
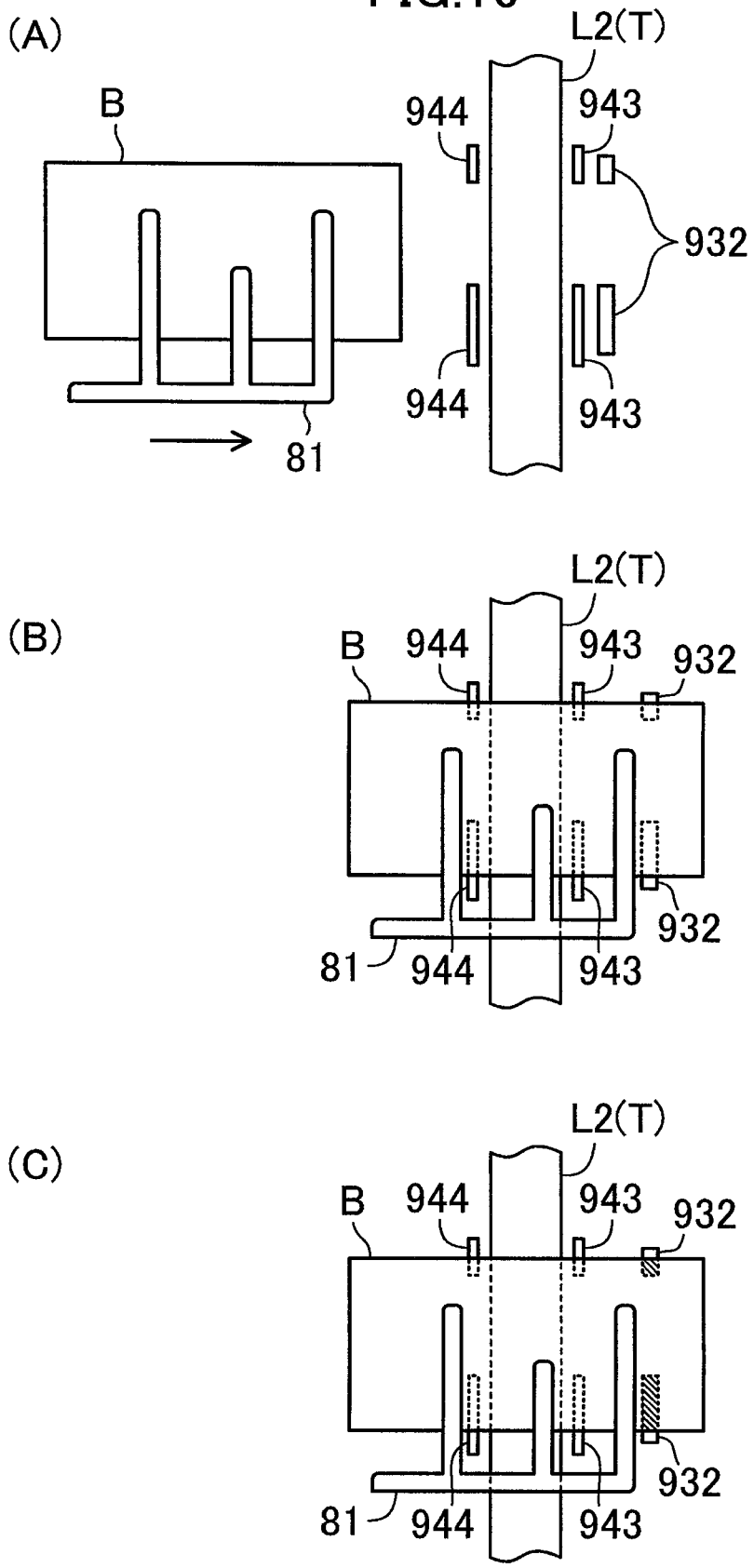

The gripper 81 includes an upper arm 81*a*, a lower arm 81*b* facing the upper arm 81*a*, and a gripping mechanism which displaces the upper arm 81*a* in the vertical direction. The upper arm 81*a* includes three fingers extending parallel to each other and a coupling portion which couples the three fingers together (see FIG. 16). Likewise, the lower arm 81*b* also has three fingers extending parallel to each other and a coupling portion which couples the three fingers together. The gripping mechanism supports the upper arm 81*a* so that the upper arm 81*a* is movable in the vertical direction, and moves the upper arm 81*a* in the vertical direction using a motor and a drive belt. This configuration allows the upper and lower arms 81*a* and 81*b* to grip the banknotes.

The first horizontal displacement mechanism supports the gripper 81 so that the gripper 81 is movable in the first horizontal direction, and displaces the gripper 81 in the first horizontal direction using the motor and the drive belt.

The vertical displacement mechanism supports the first horizontal displacement mechanism so that the first horizontal displacement mechanism is movable in the vertical direction, and displaces the first horizontal displacement mechanism in the vertical direction using the motor and the drive belt.

The second horizontal displacement mechanism supports the vertical displacement mechanism so that the vertical displacement mechanism is movable in the second horizontal direction, and displaces the vertical displacement mechanism in the second horizontal direction using the motor and the drive belt.

Thus, the gripper 81 is configured to be readily moved along three orthogonal axes by the first and second horizontal displacement mechanisms and the vertical displacement mechanism.

The third transport unit 10 transports the bundled banknotes to the dispense unit 11. The third transport unit 10 includes an upper gripping part 101, a lower gripping part 102, and a horizontal displacement mechanism which displaces the upper and lower gripping parts 101 and 102 in the first horizontal direction. In displacing the upper gripping part 101 in the first horizontal direction, the horizontal displacement mechanism displaces the upper gripping part 101 in the vertical direction, too. That is, the third transport unit 10 is configured to pass beside the bundling unit 9 in the first horizontal direction. When the third transport unit 10 is positioned opposite to the dispense unit 11 relative to the bundling unit 9, the upper gripping part 101 is positioned over, and sufficiently distant from, the lower gripping part 102. The upper gripping part 101 moves downward from this position as it approaches the bundled banknotes in the bundling unit 9. Then, when the upper gripping part 101 reaches the bundled banknotes, the bundled banknotes are gripped by the upper and lower gripping parts 101 and 102. The upper and lower gripping parts 101 and 102 transport the bundled banknotes to the vicinity of the dispense unit 11 while gripping them. In the vicinity of the dispense unit 11, the upper gripping part 101 moves upward as it approaches the dispense unit 11. As a result, the bundled banknotes gripped by the upper and lower gripping parts 101 and 102 are released from the upper and lower gripping parts 101 and 102 at the dispense unit 11, and are dispensed to the dispense unit 11.

On the second side surface 124 of the housing 12, as shown in FIG. 1, a touch panel 17 is provided to serve as an operating unit through which information is entered into the banknote handling apparatus 100 and as a display unit which displays information about the banknote handling apparatus 100. The touch panel 17 is a human interface for the operator who operates this banknote handling apparatus 100.

<Detailed Configuration of Bundling Stacker 4>

Figure 3:
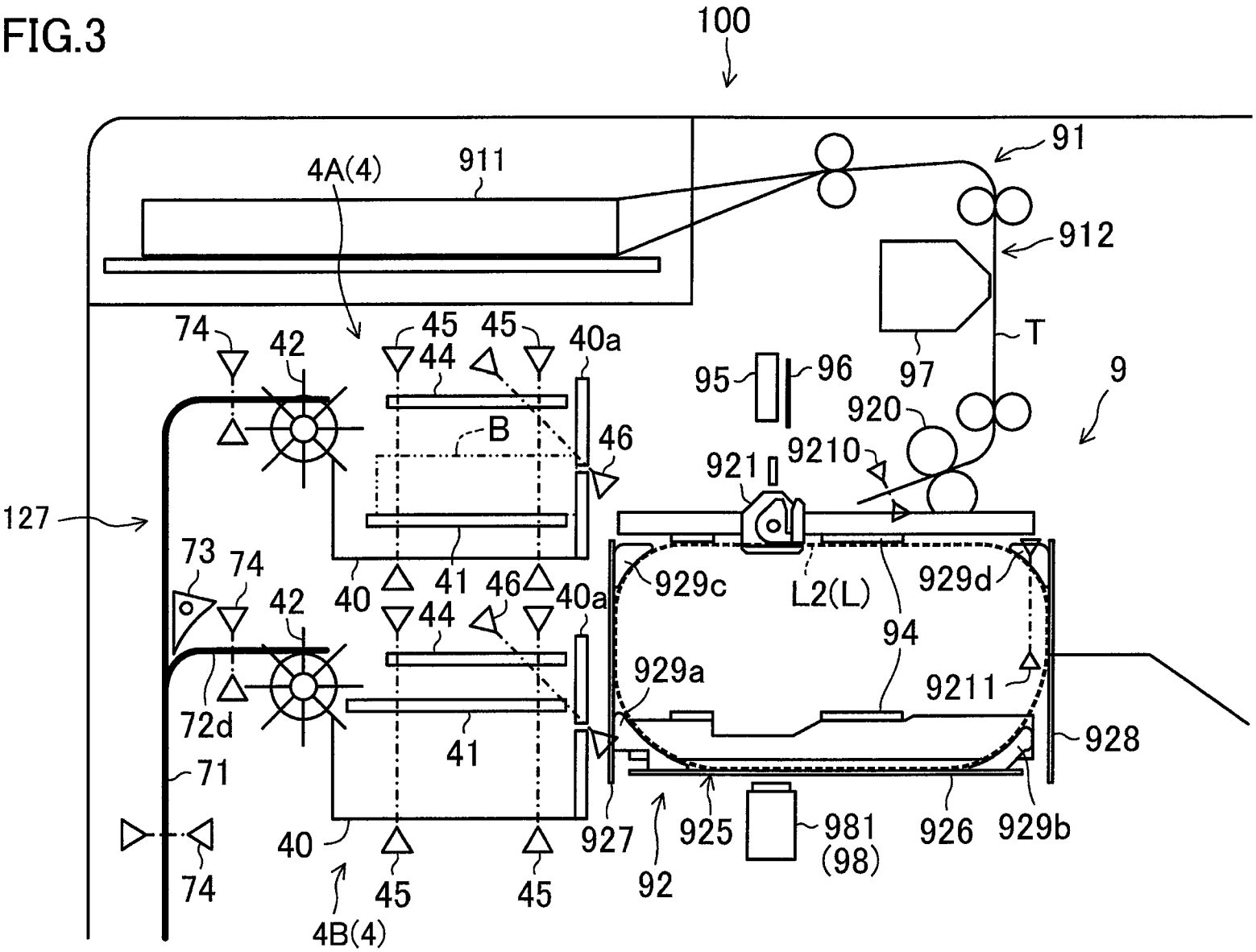
FIG. 3 illustrates a general configuration for bundling stackers and a bundling unit.

FIG. 3 illustrates a general configuration for the bundling stackers 4 and the bundling unit 9.

The bundling stackers 4 pile and stack banknotes B. As shown in FIGS. 1-3, each of the bundling stackers 4 includes a container 40 in which the banknotes B are stacked, a stage 41 arranged in the container 40 to carry the banknotes B thereon, a stacking wheel 42 which brings the transported banknotes B into the container 40, a door 43 which opens/closes the first outlet 47 to be described later, a top plate 44 which determines a ceiling of the container 40, a first banknote sensor 45 which detects the banknotes B in the container 40, and a second banknote sensor 46 which detects the banknotes B of a predetermined height in the container 40.

The container 40 has a front wall 40*a* which is located in front in the transport direction of the banknotes B and is configured to be movable forward and backward in the transport direction. The position of the front wall 40*a* is adjusted according to the dimension of the shorter edges of the banknotes B specified as those to be bundled. In particular, the front wall 40*a* is arranged such that the banknotes B brought into the container 40 collide against the front wall 40*a* and fall as they are to the bottom of the container 40 so as to be stacked there in contact with the front wall 40*a*. The front wall 40*a* is also configured to open/close in the vertical direction. The front wall 40*a* opens when the stacked banknotes B are transported by the second transport unit 8.

The stage 41 is configured to be movable in the vertical direction. For example, the stage 41 moves in the vertical direction in accordance with the amount of the banknotes B stacked.

The container 40 has an opening through the second side surface 124 of the housing 12. That is, the first outlet 47 through which the banknotes B stacked in the bundling stackers 4 are removed out of the housing 12 is provided through the second side surface 124 as shown in FIG. 1.

The door 43 is provided for each of the bundling stackers 4. The door 43 is configured to be rotatable around a predetermined rotation axis to change between an open state where the first outlet 47 is opened and a closed state where the first outlet 47 is closed, and is opened/closed manually. The door 43 is made of a material which allows visual check of the inside of the bundling stacker from outside. For example, the door 43 may be made of a transparent or translucent material (e.g., glass or a resin).

The stacking wheel 42 includes a plurality of flexible blades, and has the function of tapping the banknotes B falling into the container 40 on their rear edges in the transport direction so as to help the banknotes B fall. Even when the banknotes B are brought into the container 40 successively, each of the banknotes B is prevented from being inserted below the rear edge of the preceding banknote B, and thus the banknotes B can be sequentially stacked one by one on top of the previously stacked ones.

Two or more banknote sensors 45 are provided for each of the bundling stackers 4. In the present embodiment, two banknote sensors 45 are provided in the container 40 at different positions in the transport direction of the banknotes B. The first banknote sensor 45 is configured in the same manner as the banknote sensor 25. Each of the banknote sensors 45 is arranged to project light in the stacking direction of the banknotes B in the container 40. That is to say, the banknote sensor 45 can detect the presence of the banknotes B in the container 40 when the light is blocked. The provision of the two banknote sensors 45 at the different positions in the transport direction enables any one of the banknote sensors 45 to detect the presence of the banknotes B even when the positions of the banknotes B vary in the transport direction in the container 40. Note that two or more banknote sensors 45 may be provided at different positions in the direction orthogonal to both of the transport and thickness directions of the banknotes B (the direction coming out of the paper of FIG. 2).

The second banknote sensor 46 is configured to detect the banknotes B located at a predetermined height in the container 40. The second banknote sensor 46 is configured in the same manner as the banknote sensor 25. The second banknote sensor 46 is arranged such that light emitted from the transmitter to the receiver is blocked by the banknotes B when the banknotes B are present at a level higher than the predetermined height, and that the light emitted from the transmitter is received by the receiver when the banknotes B are not present at the level higher than the predetermined height.

<Detailed Configuration for Non-Bundling Stacker 5>

Since the first and second non-bundling stackers 5A and 5B have the same configuration, they are not distinguished from each other in the following description, and will be hereinafter collectively referred to as "non-bundling stackers 5".

The non-bundling stackers 5 pile and stack the banknotes. As shown in FIG. 2, each of the non-bundling stackers 5 includes a container 50 in which the banknotes are stacked, a stacking wheel 51 which brings the transported banknotes into the container 50, and a stacking sensor 52 which detects the presence of the banknotes.

The container 50 of each of the non-bundling stackers 5 has a tilted bottom. Thus, the banknotes brought into the container 50 are collected to the lower end of the bottom.

The stacking sensor 52 is provided at the lower end of the bottom of the container 50. The stacking sensor 52 is configured in the same manner as the banknote sensor 25, and detects the banknotes in the container 50 when the light is blocked. The stacking sensor 52 is arranged such that the light is blocked by the banknotes in the container 50.

The stacking wheel 51 includes a plurality of blades, and catches the transported banknotes between the blades to bring them into the container 50. The banknotes are released from the blades of the stacking wheel 51 near the bottom of the container 50, and are stacked in the container 50.

The container 50 has openings through the second side surface 124 of the housing 12. That is to say, the second side surface 124 is provided with second outlets 53 through which the banknotes stacked in the non-bundling stackers 5 are removed out of the housing 12. The second outlets 53 have no door, and are kept opened. The second outlets 53 of the first and second non-bundling stackers 5A and 5B are opened through the second side surface 124 and are arranged side by side in the horizontal direction.

Each of the non-bundling stackers 5 is provided with a pushing mechanism 54 which pushes the stacked banknotes toward the second outlet 53. The pushing mechanism 54 is provided at the horizontal depth of the container 50 (opposite from the second outlet 53), and is configured to push the banknotes from the horizontal depth to the front (toward the second outlet 53).

<Detailed Configuration for Reject Stacker 6>

The reject stacker 6 piles and stacks the banknotes. The reject stacker 6 includes, as shown in FIG. 2, a container 60 in which the banknotes are stacked, a stacking wheel 61 which brings the transported banknotes into the container 60, a stacking sensor 62 which detects the presence of the banknotes, and stoppers 64, 64 which prevent the banknotes in the container 60 from being ejected outside.

Specifically, the container 60 of the reject stacker 6 has an opening through the first side surface 123 of the housing 12. That is, a reject outlet 63 through which the banknotes stacked in the reject stacker 6 are removed out of the housing 12 is provided through the first side surface 123. The reject outlet 63 is opened through the first side surface 123 to be positioned above the inlet 24. The reject outlet 63 has no door and is kept opened.

The bottom of the container 60 is tilted such that the more distant from the first side surface 123, the lower the level of the bottom. Thus, the banknotes in the container 60 are stacked deep inside the first side surface 123. Thus, the banknotes are prevented from being ejected outside through the reject outlet 63 of the first side surface 123 when they are brought into the container 60.

The two stoppers 64, 64 are provided at one edge of the bottom of the container 60 closer to the first side surface 113. The stoppers 64 are supported to be rotatable around an axis extending parallel to the edge of the bottom closer to the first side surface 123, and are biased by bias springs (not shown) to stand up on the bottom of the container 60. These stoppers 64, 64 can also prevent the banknotes in the container 60 from being ejected outside through the reject outlet 63 of the first side surface 123. Note that in removing the banknotes stacked in the reject stacker 6 through the reject outlet 63, the stoppers 64, 64 need to be pressed down against the elastic force of the bias springs.

The stacking wheel 61 includes a plurality of flexible blades, and has the function of tapping the banknotes falling into the container 60 on their rear edges in the transport direction so as to help the banknotes fall. Even when the banknotes are brought into the container 60 successively, each of the banknotes is prevented from being inserted below the rear edge of the preceding banknote, and thus the banknotes can be sequentially stacked one by one on top of the previously stacked ones.

The stacking sensor 62 is configured in the same manner as the banknote sensor 25, and detects the banknotes in the container 60 when the light is blocked. The stacking sensor 62 is arranged such that the light is blocked by the banknotes in the container 60.

<Detailed Configuration of Bundling Unit 9>

As shown in FIG. 3, the bundling unit 9 includes a tape feeding unit 91 which feeds a tape T, a tape loop forming unit 92 which forms a tape loop L from the tape T, a temporary gripping unit 93 which temporarily grips the banknotes B transported into the tape loop L by the second transport unit 8 (see FIGS. 6 and 7), a clamp 94 which presses the banknotes B in the stacking direction when the banknotes B are bundled together with the tape T, a heater 95 which heat-seals portions of the tape T wound around the banknotes B, a cutter 96 which cuts the tape T at a portion not wound around the banknotes B, a printer 97 which prints characters on the tape T, and a stamper 98 which stamps a seal on the tape T.

The tape feeding unit 91 includes a tape reel 911 around which the tape T is wound, and a tape transporter 912 which transports the tape T drawn from the tape reel 911. The tape transporter 912 transports the tape T along a predetermined transport path. The tape transporter 912 has a guide (not shown) and multiple pairs of rollers.

The tape loop forming unit 92 forms a tape loop L from the tape T, and rewinds the tape T after the stacked banknotes B are arranged in the tape loop L to wind the tape T around the banknotes B. The tape loop forming unit 92 includes a pair of feed rollers 920 which feeds and rewinds the tape T, a tape gripping part 921 which grips an end portion of the tape T, a guide 925 which defines the shape of the tape loop L being formed from the tape T, a first tape sensor 9210 which detects the end portion of the tape T, and a second tape sensor 9211 which detects that a large tape loop L2 has been formed. The tape loop forming unit 92 has a small tape loop L1 formed from the tape T by the tape gripping part 921, and then has the tape T fed by the pair of feed rollers 920 to enlarge the small tape loop L1 into a large tape loop L2. In the meantime, the guide 925 guides the tape T to define the shape of the large tape loop L2, and the second tape sensor 9211 detects that the large tape loop L2 has been formed.

The pair of feed rollers 920 is driven by a stepping motor, feeds the tape T in forming the tape loop L, and rewinds the tape T to wind the tape T around the banknotes B after the banknotes B have been put into the tape loop L. The pair of feed rollers 920 is located at the downstream end of the tape transporter 912, and forms part of the tape transporter 912. The pair of feed rollers 920 is an exemplary feeder. A pair of rollers of the tape transporter 912 is also driven by the motor of the pair of feed rollers 920 through a belt, a gear, or any other suitable mechanism.

The first tape sensor 9210 is provided on the transport path of the tape T between the pair of feed rollers 920 and the tape gripping part 921. The first tape sensor 9210 is configured in the same manner as the banknote sensor 25. The first tape sensor 9210 detects the tape T when the light is cut off. For example, the first tape sensor 9210 may detect the end portion of the tape T when the light that has been cut off starts being received again by the first tape sensor 9210 as the pair of feed rollers 920 rewinds the tape T.

The tape gripping part 921 is arranged at a position where the tape gripping part 921 can receive the tape T fed from the pair of feed rollers 920. The tape gripping part 921 is configured to be able to grip the tape T and rotatable while gripping the tape T. The tape gripping part 921 rotates while gripping, at the end portion thereof, the tape T fed from the pair of feed rollers 920, thereby forming the tape loop L.

Figure 4:
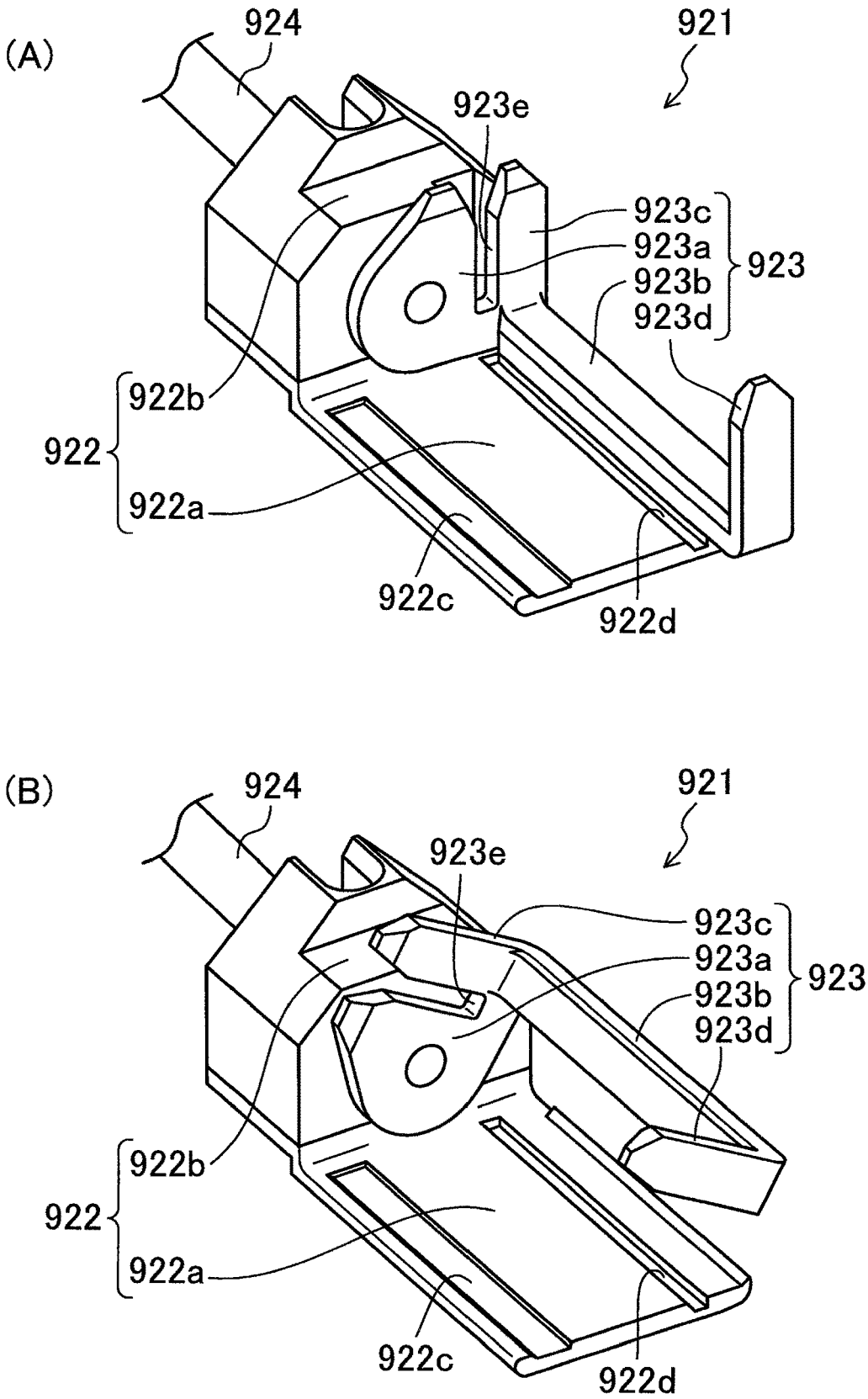
FIG. 4(A) is a perspective view illustrating a tape gripping part in a closed state.
FIG. 4(B) is a perspective view illustrating the tape gripping part in an open state.

FIGS. 4(A) and 4(B) are perspective views illustrating the tape gripping part 921. FIG. 4(A) shows the tape gripping part 921 in a closed state, while FIG. 4(B) shows the tape gripping part 921 in an open state. More specifically, the tape gripping part 921 includes a base 922, a movable part 923, and a rotating shaft 924. The base 922 includes a flat base plate 922*a* and a base block 922*b* which forms an integral part of the base plate 922*a*. The base plate 922*a* is provided with first and second recessed grooves 922*c* and 922*d* extending parallel to each other. The first and second recessed grooves 922*c* and 922*d* extend in a tape width direction. The rotating shaft 924 is rotatably inserted through the base block 922*b*. The rotating shaft 924 extends in the tape width direction, and is driven in rotation by a motor. The movable part 923 is arranged to face the base plate 922*a*, and is fixed to an end of the rotating shaft 924 to be non-rotatable about the rotating shaft 924. The movable part 923 is driven in rotation via the rotating shaft 924. The movable part 923 includes a fitting 923*a* attached to the end of the rotating shaft 924, a pressing part 923*b* provided on the fitting 923*a* to be eccentric to the rotating shaft 924 and to extend parallel to the rotating shaft 924 (i.e., in the tape width direction), and first and second guides 923*c* and 923*d* provided at both ends of the pressing part 923*b*, respectively. The first guide 923*c* forms a guide groove 923*e* between itself and the fitting 923*a*.

If the rotating shaft 924 rotates in one direction about its axis, the movable part 923 overlaps with the base plate 922*a* as shown in FIG. 4(A). This state will be hereinafter referred to as a "closed state" of the tape gripping part 921. On the other hand, if the rotating shaft 924 rotates in the other direction about the axis, a gap is formed between the movable part 923 and the base plate 922*a* as shown in FIG. 4(B). This state will be hereinafter referred to as an "open state" of the tape gripping part 921. When the tape gripping part 921 is in the open state, the tape T is insertable between the movable part 923 and the base plate 922*a*. Then, the tape gripping part 921 is turned into the closed state to grip the tape T between the movable part 923 and the base plate 922*a*. The movable part 923 is configured to be lockable onto the base plate 922 while overlapping with the base plate 922*a*, i.e., in the closed state. Once the movable part 923 is locked, the movable part 923 and the base 922 can no longer rotate relative to each other, and thus the movable part 923 and the base plate 922*a* are kept overlapped with each other. If the rotating shaft 924 rotates with the movable part 923 locked, the tape gripping part 921 rotates about the rotating shaft 924 with the tape T sandwiched by the base plate 922*a* and the movable part 923.

While the tape gripping part 921 is in the closed state, the pressing part 923*b* of the movable part 923 overlaps with a portion of the base plate 922*a* adjacent to the second recessed groove 922*d*. That is, the second recessed groove 922*d* is exposed beside the pressing part 923*b*. In this state, the first and second guides 923*c* and 923*d* extend perpendicularly to the base plate 922*a*. Likewise, the guide groove 923*e* also extends perpendicularly to the base plate 922*a*.

In forming the large tape loop L2, the guide 925 comes into contact with an outer peripheral surface of the large tape loop L2 to define the shape of the large tape loop L2. The guide 925 defines the shape of the large tape loop L2 to be a generally rectangular shape, more specifically, a rectangular shape having rounded corners.

Figure 5:
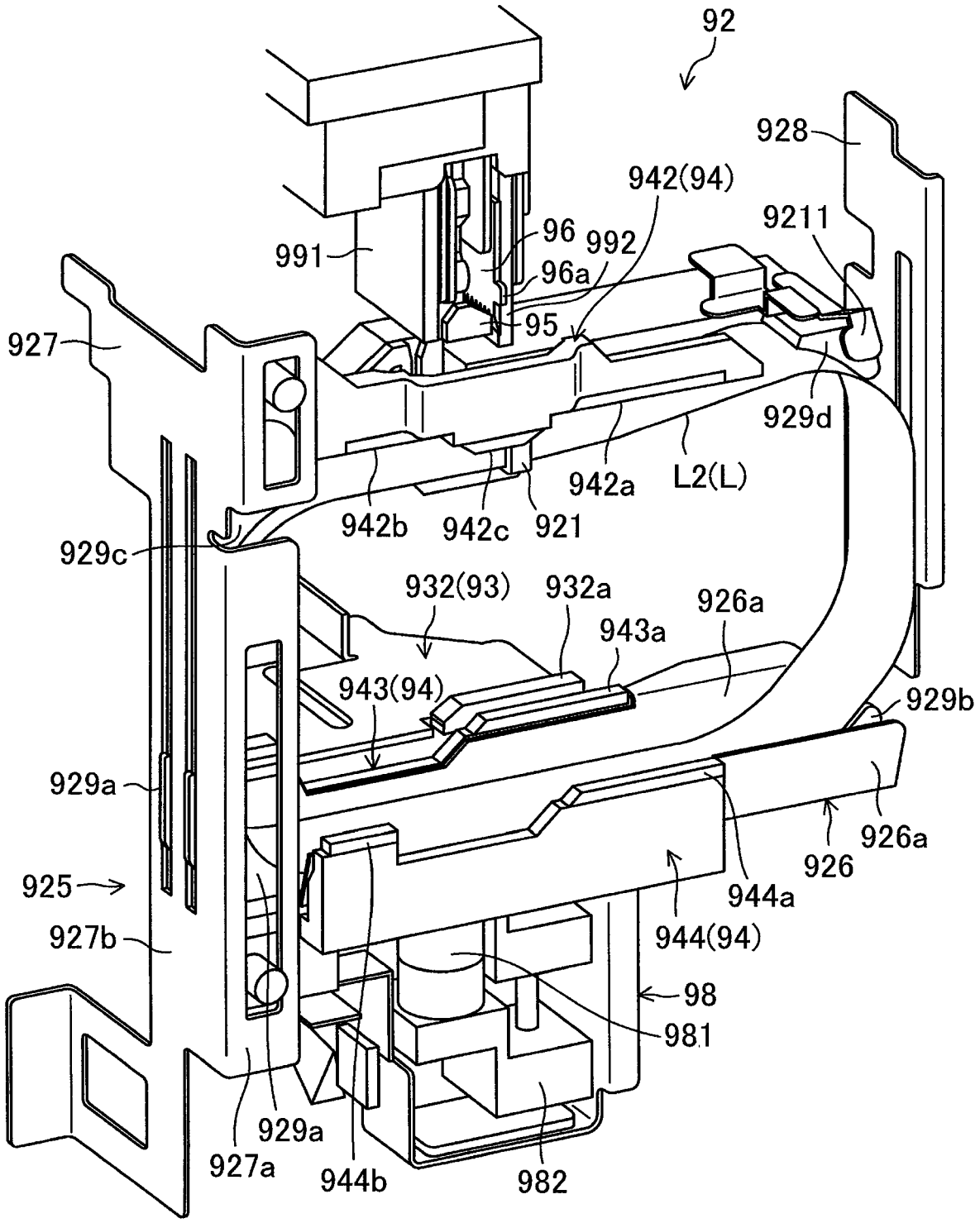
FIG. 5 is a perspective view illustrating a tape loop forming unit.

FIG. 5 illustrates a perspective view of the tape loop forming unit 92. The guide 925 includes a lower guide 926 which comes into contact with the outer peripheral surface of the large tape loop L2 from under the large tape loop L2, first and second lateral guides 927 and 928 which come into contact with the outer peripheral surface of the large tape loop L2 horizontally, and four corner guides, namely, first to fourth corner guides 929*a* to 929*d*, which correspond to the four corners of the rectangle.

Figure 6:
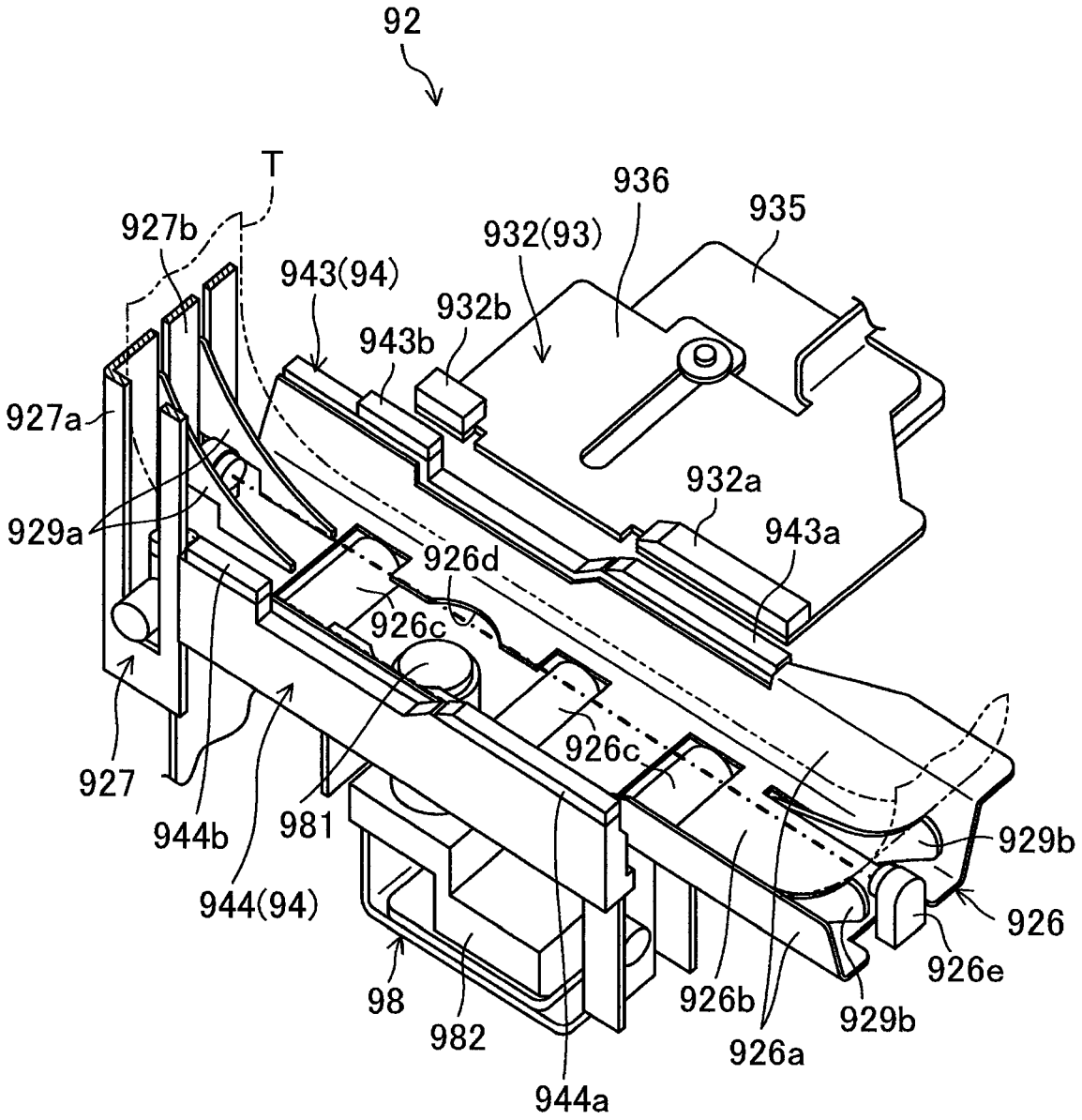
FIG. 6 is a perspective view illustrating a lower portion of the tape loop forming unit as viewed obliquely from above.

FIG. 6 is a perspective view of a lower portion of the tape loop forming unit 92 as viewed obliquely from above. The lower guide 926 has a pair of sidewalls 926*a*, 926*a* which regulates the position of the tape T in the tape width direction and a bottom wall 926*b*, and thus has the shape of a groove. The bottom wall 926*b* is broader than the width of the tape. The pair of sidewalls 926*a*, 926*a* are inclined such that the groove increases its width toward the opening end of the groove from the bottom wall 926*b* (i.e., upward from the bottom wall 926*b*). The bottom wall 926*b* is provided with a plurality of rollers 926*c*, 926*c*, . . . to improve slidability of the tape T. The bottom wall 926*b* has a through hole 926*d* through which a stamp 981 of the stamper 98 (to be described later) passes.

The first and second corner guides 929*a* and 929*b* are respectively provided at the longitudinal ends of the bottom wall 926*b*. The first corner guide 929*a* curves the tape T located at the corner formed by the lower guide 926 and the first lateral guide 927. The second corner guide 929*b* curves the tape T located at the corner formed by the lower guide 926 and the second lateral guide 928 (not shown in FIG. 6). Each of the first and second corner guides 929*a* and 929*b* is made up of two plates. Each of the two plates has an edge curved in a concave shape, and the two plates are provided to stand upright on the bottom wall 926*b* and face each other.

The lower guide 926 is provided with a third tape sensor 926*e* which detects the tape T that has fallen on the lower guide 926. More specifically, the third tape sensor 926*e* is configured in the same manner as the banknote sensor 25, and detects the tape T when the light emitted from the transmitter toward the receiver is cut off. The transmitter and receiver of the third tape sensor 926*e* are respectively provided at the longitudinal ends of the bottom wall 926*b*. The transmitter emits the light in the longitudinal direction of the bottom wall 926*b* above the bottom wall 926*b*. The third tape sensor 926*e* is an exemplary fall detection sensor.

The lower guide 926 is provided with a displacement mechanism, and is configured to be readily moved in the vertical direction by the displacement mechanism. The displacement mechanism also functions as a displacement mechanism for lower clamps 943, 944 which will be described later. The displacement mechanism includes a motor, a disk driven in rotation by the motor, a support which supports the lower guide 926 such that the lower guide 926 is movable in the vertical direction, and a link which couples the disk and the lower guide 926 together. The disk is provided with a cam groove. The link transfers the rotation of the disk to the lower guide 926 in accordance with the shape of the cam groove. The lower guide 926 moves up and down in accordance with the shape of the cam groove as the disk is driven in rotation.

The first lateral guide 927 extends in the vertical direction at one of longitudinal ends of the lower guide 926 closer to the bundling stacker 4 as shown in FIG. 5. The first lateral guide 927 includes a sidewall 927*a* and a bottom wall 927*b*, and thus has the shape of a groove. The sidewall 927*a* regulates the position of the tape T in the tape width direction. The bottom wall 927*b* is broader than the width of the tape. The bottom wall 927*b* is provided with two slits through which the first corner guide 929*a* passes.

The second lateral guide 928 extends in the vertical direction at the other longitudinal end of the lower guide 926 closer to the dispense unit 11. The second lateral guide 928 is substantially in the shape of a flat plate, and does not have a portion corresponding to the sidewall 927*a* of the first lateral guide 927. The second lateral guide 928 is supported to be movable up and down by the support, and is coupled to the lower guide 926 through the link. Thus, the second lateral guide 928 moves upward or downward as the lower guide 926 moves upward or downward. Note that the magnitude of movement of the second lateral guide 928 is amplified by the link. The second lateral guide 928 is configured to retreat upward during the transport of the bundled banknotes B so as not to interfere with the transport of the bundled banknotes B.

A third corner guide 929*c* and a fourth corner guide 929*d* are provided above the first and second corner guides 929*a* and 929*b* at almost the same level as the tape gripping part 921. The third corner guide 929*c* is arranged adjacent to the first lateral guide 927. The third corner guide 929*c* has two plates. Each of the two plates has an edge curved in a concave shape, and the two plates are provided to stand upright on the bottom wall 927*b* and face each other. The fourth corner guide 929*d* is arranged adjacent to the second lateral guide 928. The fourth corner guide 929*d* is formed of a block having a surface curved in a concave shape. When it is not necessary to distinguish the first to fourth corner guides 929*a* to 929*d* from each other, they may be hereinafter referred to as "corner guides 929" collectively.

The second tape sensor 9211 is configured in the same manner as the banknote sensor 25, and detects the tape T when the light is cut off. The receiver of the second tape sensor 9211 is attached to the fourth corner guide 929*d* as shown in FIG. 5. The transmitter of the second tape sensor 9211 is arranged such that the light emitted from the transmitter is cut off by the tape T guided along the fourth corner guide 929*d*. That is, the second tape sensor 9211 detects that the fourth corner guide 929*d* is guiding the tape T, i.e., the tape loop L has reached a predetermined size, when the light emitted from the transmitter is not received by the receiver. The second tape sensor 9211 is an exemplary tape loop detection sensor.

The temporary gripping unit 93 temporarily grips the banknotes B transported into the tape loop L by the second transport unit 8. The temporary gripping unit 93 is arranged opposite to the second transport unit 8 relative to the tape loop L in the second horizontal direction, i.e., in the tape width direction. The temporary gripping unit 93 grips the banknotes B at their portion opposite to the second transport unit 8 relative to the tape loop L. The temporary gripping unit 93 includes an upper gripping part 931, a lower gripping part 932, and a vertical displacement mechanism which displaces the upper and lower gripping parts 931 and 932 in the vertical direction. The temporary gripping unit 93 grips the banknotes B with the upper and lower gripping parts 931 and 932.

Figure 7:
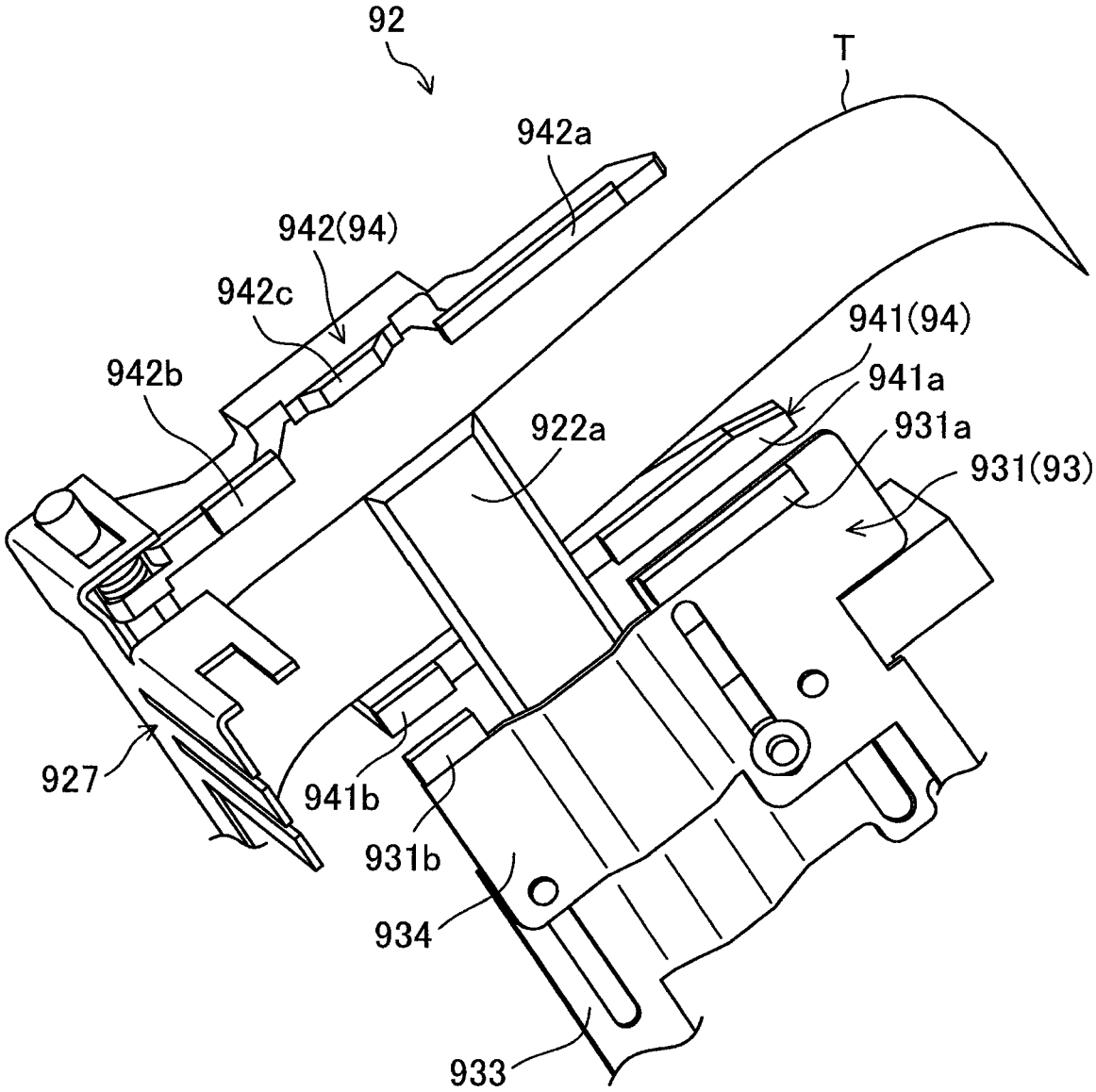
FIG. 7 is a perspective view illustrating an upper portion of the tape loop forming unit as viewed obliquely from below.

FIG. 7 is a perspective view illustrating an upper portion of the tape loop forming unit 92 as viewed obliquely from below. The upper gripping part 931 includes an upper base plate 933, an upper movable plate 934, and first second abutting portions 931*a*, 931*b* provided for the upper movable plate 934. The first and second abutting portions 931*a*, 931*b* are arranged side by side in the direction parallel to the shorter edges of the banknotes B. The first and second abutting portions 931*a* and 931*b* are located at the same level. The base plate 922*a* of the tape gripping part 921 is arranged between the first and second abutting portions 931*a* and 931*b*. The upper movable plate 934 is supported by the upper base plate 933 such that the upper movable plate 934 is movable along the width of the tape T.

The lower gripping part 932 includes, as shown in FIG. 6, a lower base plate 935, a lower movable plate 936, and first and second abutting portions 932*a*, 932*b* provided for the lower movable plate 936. The first and second abutting portions 932*a*, 932*b* are arranged side by side in the direction parallel to the shorter edges of the banknotes B. The first and second abutting portions 932*a* and 932*b* are located at the same level. The first and second abutting portions 932*a*, 932*b* respectively face the first and second abutting portions 931*a*, 931*b* of the upper gripping part 931. The lower movable plate 936 is supported by the lower base plate 935 such that the lower movable plate 936 is movable along the width of the tape T.

The vertical displacement mechanism includes a motor, a disk driven in rotation by the motor, a support which supports the upper and lower base plates 933 and 935 such that these plates 933 and 935 are movable up and down, and a link which couples the disk to the upper and lower base plates 933 and 935. The disk is provided with a cam groove. The link transfers the rotation of the disk to the upper and lower base plates 933 and 935 in accordance with the shape of the cam groove. The upper and lower base plates 933 and 935 move up and down in accordance with the shape of the cam groove as the disk is driven in rotation. Thus, the upper and lower gripping parts 931 and 932 move away from, or approaches, each other. The cam groove for the upper base plate 933 and the cam groove for the lower base plate 935 have different shapes. Thus, the upper and lower gripping parts 931 and 932 do not move up and down to the same extent but move in mutually different ways.

Note that the upper and lower movable plates 934 and 936 are configured to move in the second horizontal direction synchronously with the movement of the second transport unit 8 while the banknotes are being transported into the large tape loop L2.

Specifically, the upper movable plate 934 is supported not only by the upper base plate 933, but also by a vertically extending shaft as well. Likewise, the lower movable plate 936 is also supported not only by the lower base plate 935, but also by a vertically extending shaft as well. Since these shafts extend vertically, the upper and lower movable plates 934 and 936 move up and down along the shafts as the upper and lower gripping parts 931 and 932 move up and down. Thus, the shafts do not interfere with the vertical movement of the upper and lower gripping parts 931 and 932. These two shafts form integral parts of a frame. The frame and the shafts are configured to be readily moved by a displacement mechanism in the second horizontal direction. The frame and the shafts are allowed by the displacement mechanism to move in the second horizontal direction synchronously with the movement of the second transport unit 8 while the banknotes are being transported into the large tape loop L2. That is to say, when the second transport unit 8 transports the banknotes into the large tape loop L2, the displacement mechanism moves the frame in the second horizontal direction synchronously with the movement of the second transport unit 8. As the frame moves in the second horizontal direction, the upper and lower movable plates 934 and 936 supported by the shafts of the frame also move in the second horizontal direction.

In this manner, the positions of the first and second abutting portions 931*a*, 931*b* of the upper gripping part 931 and the first and second abutting portions 932*a*, 932*b* of the lower gripping part 932 in the second horizontal direction are changed according to the degree of insertion of the banknotes into the large tape loop L2 by the second transport unit 8.

The clamp 94 presses the banknotes B in the stacking direction when the banknotes B are bundled together with the tape T. The clamp 94 presses the banknotes B around their portion to be bundled with the tape T. The clamp 94 includes, as shown in FIGS. 6 and 7, a pair of upper clamps 941, 942 provided above the banknotes B transported into the tape loop L, a pair of lower clamps 943, 944 provided below the banknotes B, and a displacement mechanism which allows one of the upper clamps 942 and the lower clamps 943, 944 to move up and down.

The upper clamps 941, 942 are arranged on the respective sides of the tape T in the tape width direction. The upper clamp 941 located more distant from the second transport unit 8 is fixed, and is not movable up or down. On the other hand, the upper clamp 942 located closer to the second transport unit 8 is configured to be movable up and down. When it is necessary to distinguish the upper clamps from each other, the former will be hereinafter referred to as an "upper fixed clamp 941," and the latter will be hereinafter referred to an "upper movable clamp 942."

The upper fixed clamp 941 includes first and second abutting portions 941*a*, 941*b*. The first and second abutting portions 941*a*, 941*b* are arranged side by side in the direction parallel to the shorter edges of the banknotes B. The first and second abutting portions 941*a* and 941*b* are located at the same level. The base plate 922*a* of the tape gripping part 921 is arranged between the first and second abutting portions 941*a* and 941*b*. The base plate 922*a* is located at a lower level than the first and second abutting portions 941*a*, 941*b*.

On the other hand, the upper movable clamp 942 includes first to third abutting portions 942*a* to 942*c*. The first to third abutting portions 942*a* to 942*c* are arranged side by side in the direction parallel to the shorter edges of the banknotes B. The third abutting portion 942*c* is located between the first and second abutting portions 942*a* and 942*b* in the direction parallel to the shorter edges of the banknotes B. The first and second abutting portions 942*a* and 942*b* are located at the same level. The third abutting portion 942*c* is located at a lower level than the first and second abutting portions 942*a* and 942*b*. The upper movable clamp 942 moves up and down between a clamp position where the first and second abutting portions 942*a* and 942*b* are level with the first and second abutting portions 941*a* and 941*b* of the upper fixed clamp 941, and a retreat position where the third abutting portion 942*c* is at a higher level than the first and second abutting portions 941*a* and 941*b* of the upper fixed clamp 941. When the upper movable clamp 942 is at the clamp position, the third abutting portion 942*c* is located at substantially the same level as the base plate 922*a* of the tape gripping part 921.

The lower clamps 943, 944 are arranged on the respective sides of the tape T in the tape width direction. The lower clamp 943 located more distant from the second transport unit 8 and the lower clamp 944 located closer to the second transport unit 8 are configured in the same manner. The lower clamp 943 includes first and second abutting portions 943*a*, 943*b*. The first and second abutting portions 943*a*, 943*b* are arranged side by side in the direction parallel to the shorter edges of the banknotes B. The first and second abutting portions 943*a* and 943*b* are located at the same level. The first and second abutting portions 943*a*, 943*b* respectively face the first and second abutting portions 941*a*, 941*b* of the upper fixed clamp 941. The lower clamp 944 includes first and second abutting portions 944*a*, 944*b*. The first and second abutting portions 944*a*, 944*b* are arranged side by side in the direction parallel to the shorter edges of the banknotes B. The first and second abutting portions 944*a* and 944*b* are located at the same level, and also at the same level as the first and second abutting portions 943*a* and 943*b* of the lower clamp 943. The first and second abutting portions 944*a*, 944*b* respectively face the first and second abutting portions 942*a*, 942*b* of the upper movable clamp 942.

The vertical displacement mechanism includes a motor, a disk driven in rotation by the motor, a support which supports the upper movable clamp 942 and the lower clamps 943, 944 such that these clamps are movable up and down, and a link which couples the disk to the upper movable clamp 942 and the lower clamps 943, 944. The disk is provided with a cam groove. The link transfers the rotation of the disk to the upper movable clamp 942 and the lower clamps 943, 944 in accordance with the shape of the cam groove. The upper movable clamp 942 and the lower clamps 943, 944 move vertically in accordance with the shape of the cam groove as the disk is driven in rotation. Thus, the lower clamps 943, 944 approaches, or move away from, the upper clamps 941, 942, and the upper movable clamp 942 moves up and down between the clamp position and the retreat position. Since the cam groove for the upper movable clamp 942 and the cam groove for the lower clamps 943, 944 have different shapes, the upper movable clamp 942 and the lower clamps 943, 944 do not move up and down to the same extent, but move in mutually different ways. The motor also functions as the motor for the displacement mechanism of the temporary gripping unit 93.

The lower clamps 943, 944 form integral parts of the lower guide 926 of the guide 925. That is, the lower clamps 943, 944 and the lower guide 926 move up and down altogether. In other words, the displacement mechanism which displaces the lower clamps 943, 944 in the vertical direction also function as the displacement mechanism for the lower guide 926.

The heater 95 bonds together portions of the tape T wound around the banknotes B. The heater 95 heat-seals such portions of the tape T. The heater 95 is an exemplary bonding unit.

The cutter 96 cuts a portion of the tape T not wound around the banknotes B, that is, an extra portion of the tape T that has not been used to bundle the banknotes B together with the tape T. The cutter 96 has a saw-toothed cutting edge at its end. The cutter 96 has guiding tabs 96*a* protruding outward from its side edges as shown in FIG. 5. The cutter 96 is an exemplary cutting unit.

The heater 95 and the cutter 96 are configured as a unit as shown in FIG. 5, and is arranged opposite to the stamper 98 relative to the banknotes B brought into the tape loop L, that is, opposite to the stamper 98 in the stacking direction of the banknotes B, i.e., above the tape gripping part 921.

More specifically, the heater 95 and the cutter 96 are configured as a unit together with first and second tape pressers 991, 992. The first and second tape pressers 991, 992 are arranged side by side in the first horizontal direction. Each of the first and second tape pressers 991, 992 is a flat plate member, and has a lower end face extending in the tape width direction. The heater 95 and the cutter 96 are arranged between the first and second tape pressers 991, 992.

The heater 95, the cutter 96, and the first and second tape pressers 991 and 992 are configured to be movable up and down. The heater 95, the cutter 96, and the first and second tape pressers 991 and 992 move down toward the tape gripping part 921 in bonding and cutting the tape T. The first tape presser 991 is configured to fit in the first recessed groove 922*c* of the base plate 922*a* so that the tape T is sandwiched between itself and the bottom surface of the first recessed groove 922*c*. The second tape presser 992 is configured to sandwich the tape T between itself and the pressing part 923*b* of the movable part 923. The heater 95 bonds the tape T between the first and second recessed grooves 922*c* and 922*d* of the base plate 922*a*. The cutter 96 enters the second recessed groove 922*d* of the base plate 922*a* to cut the tape T.

The printer 97 is arranged in the tape transporter 912 as shown in FIG. 3. The printer 97 prints characters on the tape T transported by the tape transporter 912. The printer 97 prints, for example, information about the banknotes B to be bundled (e.g., denomination, date, and/or serial number) on the tape T. The print made by the printer 97 is shifted in the tape width direction from a portion on which a seal will be stamped by the stamper 98 so that the print does not overlap with the seal stamped by the stamper 98.

The stamper 98 stamps a seal on the tape T wound around the banknotes B compressed by the clamp 94. The stamper 98 stamps a seal related to the banknotes B to be bundled (e.g., a seal of a financial institution, a seal indicating the kind of the banknotes such as fit or unfit notes) on the tape T. The stamper 98 is arranged opposite to the heater 95 and the cutter 96 relative to the banknotes B brought into the tape loop L as shown in FIG. 5, in particular, opposite to the heater 95 and the cutter 96 in the stacking direction of the banknotes B. The stamper 98 includes a stamp 981 and a displacement mechanism 982 which displaces the stamp 981 in the vertical direction. When the displacement mechanism 982 displaces the stamp 981 upward, the stamp 981 stamps a seal on the tape T wound around the banknotes B in the stacking direction of the banknotes B. The stamper 98 forms an integral part of the lower guide 926, and moves up and down along with the lower guide 926 that is moving up and down. The stamp 981 is arranged between the pair of sidewalls 926*a*, 926*a* of the lower guide 926 in the direction parallel to the shorter edges of the lower guide 926, i.e., in the width direction of the tape T, as shown in FIG. 6. Note that the stamp 981 in a normal state is arranged under the through hole 926*d* of the bottom wall 926*b* of the lower guide 926, and does not protrude upward from the bottom wall 926*b*. When moved upward by the displacement mechanism 982, the stamp 981 goes through the through hole 926*d* to protrude upward from the bottom wall 926*b*, thereby stamping a seal on the tape T.

<System Configuration for Banknote Handling Apparatus>

Figure 8:
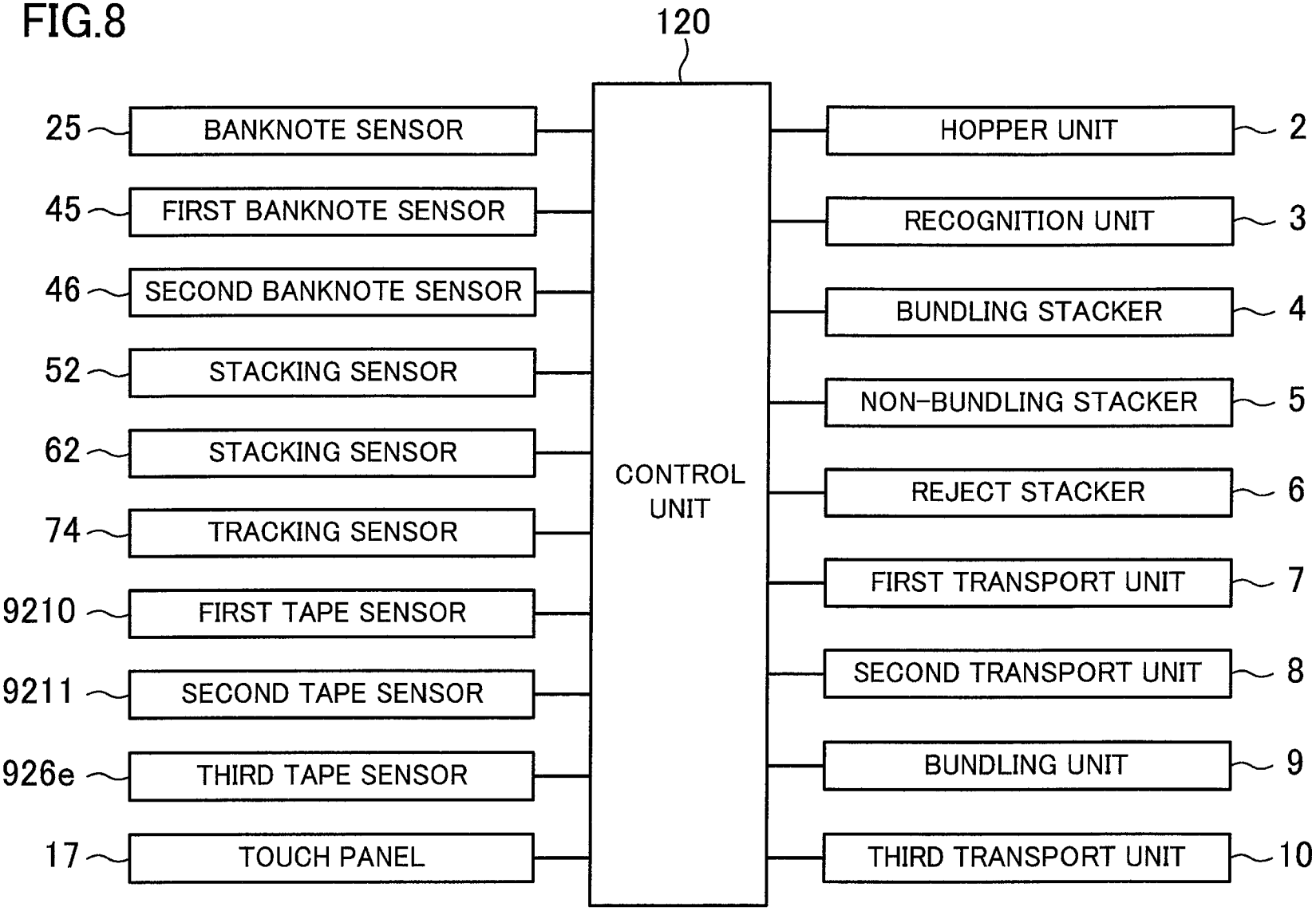
FIG. 8 is a block diagram illustrating a general configuration for the banknote handling apparatus.

FIG. 8 is a block diagram illustrating a general configuration for the banknote handling apparatus 100.

The banknote handling apparatus 100 includes a control unit 120 based on a well-known microcomputer, for example. The control unit 120 is connected to the above-described units, namely, the hopper unit 2, the recognition unit 3, the bundling stackers 4, the non-bundling stackers 5, the reject stacker 6, the first and second transport units 7 and 8, the bundling unit 9, the third transport unit 10, and the touch panel 17 so as to transmit and receive signals to/from these units. The control unit 120 is also connected to the banknote sensor 25, the first and second banknote sensors 45 and 46, the stacking sensors 52 and 62, the tracking sensors 74, the first, second and third tape sensors 9210, 9211 and 926*e* to receive detection signals from these sensors. The control unit 120 generates a control signal based on the signal supplied from the touch panel 17, the detection signals from the sensors and other suitable signals, and outputs the generated control signal to the hopper unit 2 and other units. The hopper unit 2 and other units operate in accordance with the control signal. Taking the bundling stacker 4 as an example, the control unit 120 controls the front wall 40*a* of the container 40, the stage 41, and the stacking wheel 42.

<Working Mechanism of Banknote Handling Apparatus>

It will be described how to perform a deposit process using this banknote handling apparatus 100. In the deposit process, loose banknotes are sorted and stacked in the predetermined stackers, and predetermined ones of them are bundled. In the following description, a single kind banknote bundling process will be described, in which a predetermined number of banknotes of a prescribed kind to be bundled are stacked alternately in the first and second bundling stackers 4A, 4B, and the predetermined number of banknotes stacked are bundled sequentially by the bundling unit 9.

The banknote handling apparatus 100 is placed on a teller counter to be positioned on the front left side of the operator (on the front right side of a customer) when the operator faces the customer over the teller counter. At this time, the banknote handling apparatus 100 is arranged such that the first side surface 123 of the housing 12 faces the customer. In this state, the second side surface 124 of the housing 12 faces the operator. However, since the banknote handling apparatus 100 is located slightly on the front left side of the operator, the customer can also see the second side surface 124.

First, the operator receives loose banknotes to be deposited from the customer, and places the banknotes on the hopper unit 2. At this time, even if the loose banknotes include banknotes of multiple different kinds, all the banknotes are just placed on the hopper unit 2 without sorting them. The operator adjusts the guides 22 according to the dimension of the banknotes. Then, the operator operates the touch panel 17 to start the intake of the banknotes. The banknote handling apparatus 100 may automatically start the intake of the banknotes when the banknote sensor 25 detects the banknotes placed on the hopper unit 2.

The banknotes placed on the hopper unit 2 are brought into the housing 12 one by one through the inlet 24 as the intake rollers 23 are activated. The banknotes thus taken in are transported by the first transport unit 7, and pass through the recognition unit 3. The recognition unit 3 detects the kind of the banknotes passed, and informs the control unit 120 of the kind of the banknotes.

The control unit 120 designates the banknotes' destination according to the kind of the banknotes. In particular, if the banknotes are fit banknotes of a predetermined denomination to be bundled, the control unit 120 designates the bundling stacker 4 (any one of the bundling stackers 4A and 4B) as their destination. If the banknotes are unfit banknotes of the predetermined denomination to be bundled, the control unit 120 designates the first non-bundling stacker 5A as their destination. If the banknotes are of any denomination other than the predetermined denomination, the control unit 120 designates the second non-bundling stacker 5B as their destination. If the banknotes are rejected banknotes, the control unit 120 designates the reject stacker 6 as their destination.

The control unit 120 controls the first transport unit 7 such that the banknotes are transported to the stacker designated as their destination. In particular, the control unit 120 controls the sorting mechanism 73 corresponding to the diverged path 72 leading to the destination stacker such that the banknotes are guided from the main transport path 71 to the diverged path 72. The control unit 120 switches the sorting mechanism 73 when the tracking sensor 74 just before the diverged path 72 detects the banknotes. Further, the control unit 120 controls the stacking wheel 42, 51, or 61 of the destination stacker to bring the banknotes into that stacker.

The banknotes to be transported to the bundling stacker 4 are transported to one of the two bundling stackers 4. When the number of banknotes stacked in one of the bundling stackers 4 reaches a predetermined bundling number (e.g., 100), the remaining banknotes are then transported to the other bundling stacker 4. In this example, the banknotes are supposed to be transported to the first bundling stacker 4A first. When the banknotes are transported one after another to the first bundling stacker 4A, the stacking wheel 42 rotates to stack the banknotes one by one. At this time, when the uppermost one of the banknotes on the stage 41 is detected by the second banknote sensor 46, the stage 41 moves downward to a predetermined degree so that the second banknote sensor 46 does not detect any banknotes. Then, when the banknotes are further stacked much enough for the second banknote sensor 46 to detect the banknotes, the stage 41 then moves downward again to the predetermined degree. Performing this series of processing steps a number of times makes it possible to keep the distance for the banknotes falling into the bundling stacker 4 to travel within a predetermined range, thus enabling the banknotes falling freely to be stacked at the same position and with the same orientation.

When the number of banknotes stacked in the first bundling stacker 4A reaches the bundling number, the control unit 120 controls the second transport unit 8 so that the banknotes in the first bundling stacker 4A are gripped by the gripper 81 and transported to the bundling unit 9. Then, the control unit 120 controls the bundling unit 9 so that the banknotes are bundled with the tape T.

When the number of banknotes stacked in the first bundling stacker 4A reaches the bundling number, the remaining banknotes are stacked in the second bundling stacker 4B. Then, when the number of banknotes stacked in the second bundling stacker 4B reaches the bundling number, the remaining banknotes are stacked again in the first bundling stacker 4A. By this time, the banknotes have already been transported from the first bundling stacker 4A, and thus the first bundling stacker 4A is now empty. Thus, the provision of the two bundling stackers 4 makes it possible to perform the bundling process while stacking the banknotes continuously.

Subsequently, the control unit 120 controls the third transport unit 10 so that the bundled banknotes are dispensed through the dispense port 111.

The unfit banknotes of the predetermined denomination are transported to the first non-bundling stacker 5A. When the banknotes are transported to the first non-bundling stacker 5A, the stacking wheel 51*a* rotates to stack the transported banknotes in the container 50. Thus, the unfit banknotes of the predetermined denomination are stacked in the first non-bundling stacker 5A. Likewise, the banknotes of any denominations other than the predetermined denomination are transported to, and stacked in, the second non-bundling stacker 5B. The rejected banknotes are also transported to, and stacked in, the reject stacker 6.

This series of processing steps will be performed over and over again until there are no banknotes placed on the hopper unit 2. The banknote sensor 25 determines whether banknotes are still present on the hopper unit 2 or not.

When the handling of the banknotes placed on the hopper unit 2 is finished, the rejected banknotes are taken in and recognized again. Specifically, the operator extracts the rejected banknotes from the reject stacker 6, and places them on the hopper unit 2 to take them into the apparatus again. The rejected banknotes are those which were not recognized as normal banknotes for any reason, and thus another attempt is made to take in and recognize them. Banknotes still recognized as rejected banknotes, if any, are restacked in the reject stacker 6. Then, the operator returns those restacked banknotes to the customer.

Note that the banknotes stacked in the first and second non-bundling stackers 5A, 5B are not taken in again.

Thus, when the handling of the banknotes placed on the hopper unit 2 and the re-handling of the rejected banknotes are finished, the single kind banknote bundling process is finished, i.e., the counting and sorting of the banknotes passed as those to be deposited by the customer are finished. The touch panel 17 displays the counted amount of the banknotes. The operator asks for a customer's approval of the amount, or checks whether the displayed amount corresponds with the amount described on a deposit slip by the customer, and, if the answer is YES, the operator operates the touch panel 17 to confirm the deposit amount. When the confirmation is done, a teller terminal (not shown) is informed of the confirmed deposit amount, thereby finishing the deposit process.

After the deposit process is finished, the operator removes the bundled banknotes stacked in the dispense unit 11, the banknotes stacked in the bundling stackers 4, and the banknotes stacked in the non-bundling stackers 5, and stores them in a predetermined storage place.

By performing this series of processing steps, loose banknotes of different kinds are sorted into fit banknotes of a predetermined denomination, unfit banknotes of the predetermined denomination, banknotes of every denomination but the predetermined denomination, and rejected banknotes. The fit banknotes of the predetermined denomination are bundled on a bundling number basis.

<Detailed Description of Processes to be Performed after Banknotes are Stacked>

Processes to be performed until the banknotes stacked in the bundling stacker 4 are dispensed to the dispense unit 11 will be described below.

—Compression of Stacked Banknotes—

Figure 9:
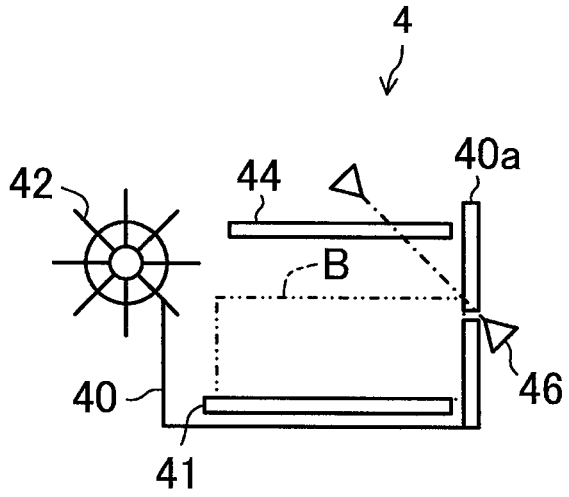
Figure 9:
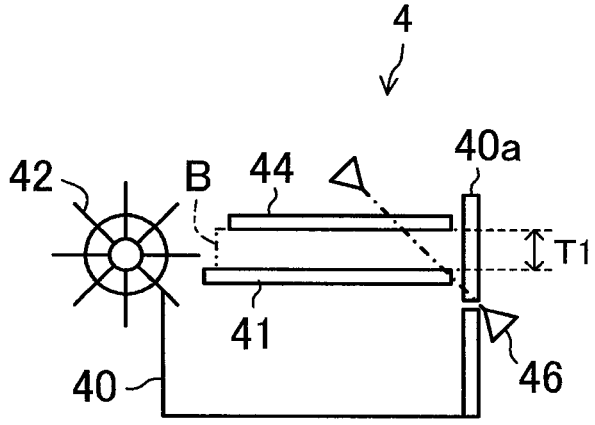

FIGS. 9(A) and 9(B) show a banknote compression process performed in the bundling stacker. FIG. 9(A) shows a state just after the banknotes have been stacked, and FIG. 9(B) shows a state where the banknotes have just been compressed. In FIGS. 9(A) and 9(B), the first banknote sensor 45 is not shown.

As shown in FIG. 9(A), the stage 41 is located at a relatively low level just after the banknotes have been stacked in the bundling stacker 4, and the uppermost one of the banknotes B on the stage 41 is located away from the top plate 44.

When the stacking of the banknotes B is finished, the stage 41 moves upward to compress the stacked banknotes B between the stage 41 and top plate 44. The control unit 120 moves the stage 41 upward to a position where the distance between the stage 41 and the top plate 44 becomes a predetermined value T1 as shown in FIG. 9(B). As a result, the banknotes B on the stage 41 are compressed until their combined thickness becomes equal to the predetermined value T1. If the combined thickness of the banknotes B that have fallen freely to, and been stacked on, the stage 41 is short of the predetermined value T1 (e.g., if the banknotes B are new banknotes), the banknotes B are not compressed even if the stage 41 moves upward as described above. The stage 41 and the top plate 44 are an exemplary compressing unit.

—Transportation of Banknotes to the Bundling Unit—

Figure 10:
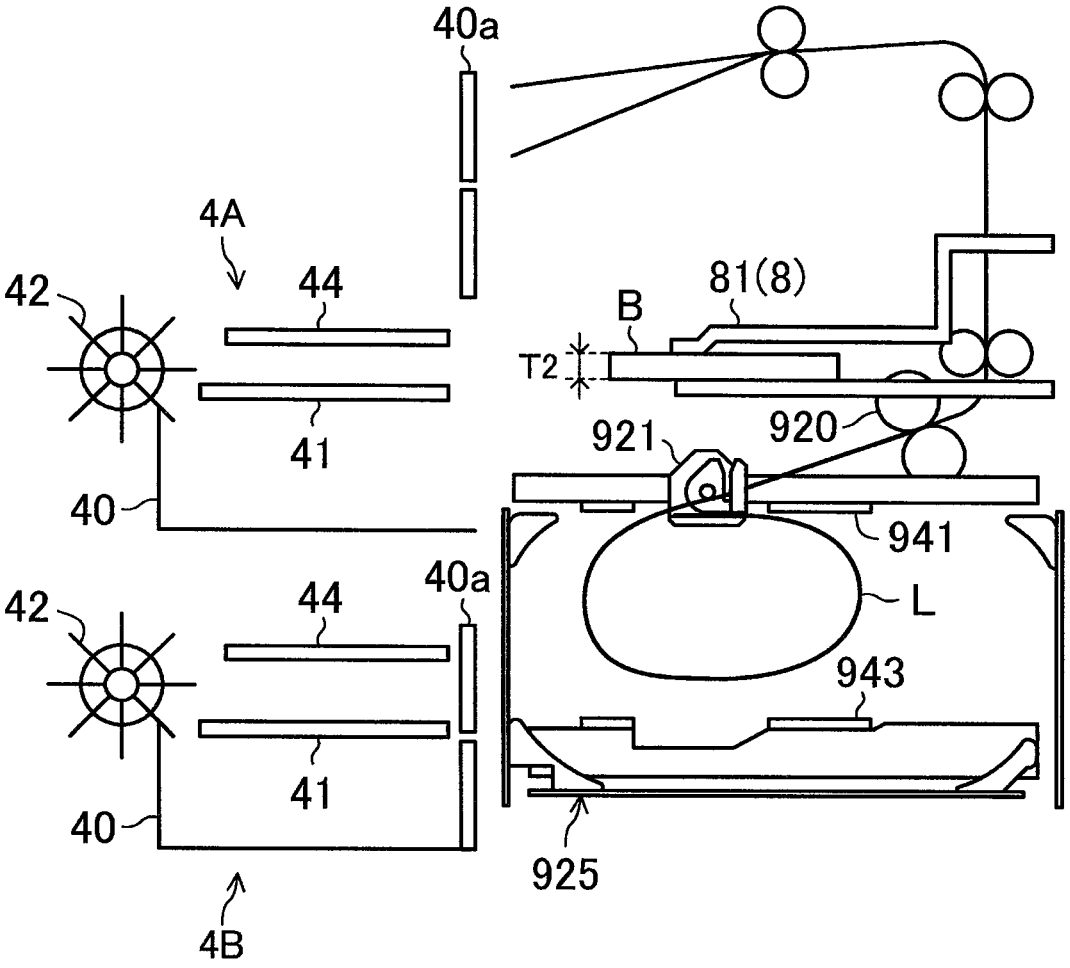
FIG. 10 illustrates a state where a second transport unit has removed the banknotes from the bundling stacker.
Figure 11:
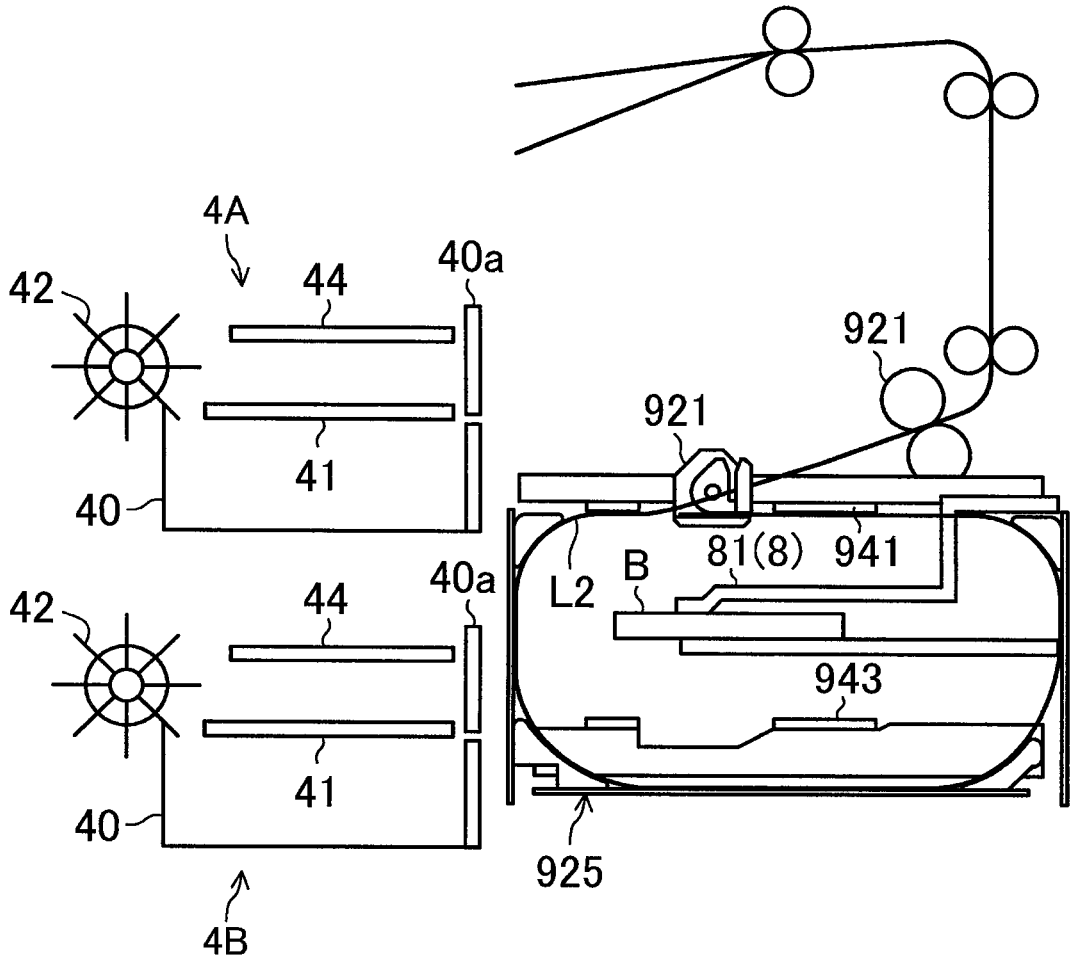
FIG. 11 illustrates a state where the second transport unit has transported the banknotes to beside a tape loop.

When the stacking of the banknotes B is finished, the second transport unit 8 transports the banknotes B from the bundling stacker 4 to the bundling unit 9. FIG. 10 shows a state where the second transport unit 8 has removed the banknotes B from the bundling stacker 4. FIG. 11 shows a state where the second transport unit 8 has transported the banknotes B to beside the tape loop L.

Specifically, when the banknotes B have been stacked, the second transport unit 8 moves to the bundling stacker 4 in which the banknotes B have been stacked, grips the banknotes B in the bundling stacker 4, and removes the banknotes B from the bundling stacker 4 as shown in FIG. 10. In this case, suppose that the banknotes B have been stacked in the first bundling stacker 4A. Then, the gripper 81 of the second transport unit 8 grips the banknotes B in the first bundling stacker 4A. A gap in which the gripper 81 is insertable is provided between the stage 41 and top plate 44 of the bundling stacker 4. Thus, the gripper 81 is allowed to grip the banknotes B sandwiched between the stage 41 and the top plate 44. The gripper 81 sandwiches the banknotes B, compressed by the stage 41 and the top plate 44, in the stacking direction to further compress them. That is, the thickness T2 of the banknotes B gripped by the gripper 81 becomes smaller than the thickness T1 of the banknotes B compressed by the stage 41 and the top plate 44. Note that the stage 41 moves downward after the gripper 81 has sandwiched the banknotes B. The second transport unit 8 removes the gripped banknotes B from the first bundling stacker 4A in the first horizontal direction. At this time, the second transport unit 8 moves the banknotes B in the first horizontal direction to a first predetermined position (the position shown in FIG. 10). This first position corresponds with a first horizontal position for transporting the banknotes B into the large tape loop L2 as will be described later.

Subsequently, the second transport unit 8 displaces the banknotes B vertically to a second predetermined position as shown in FIG. 11. At this second position, the banknotes B are going to be transported into the large tape loop L2. At the second position, the banknotes B are located around the center of the large tape loop L2 as viewed in a direction parallel to the longer edges of the banknotes B.

—Formation of Tape Loop—

Figure 12:
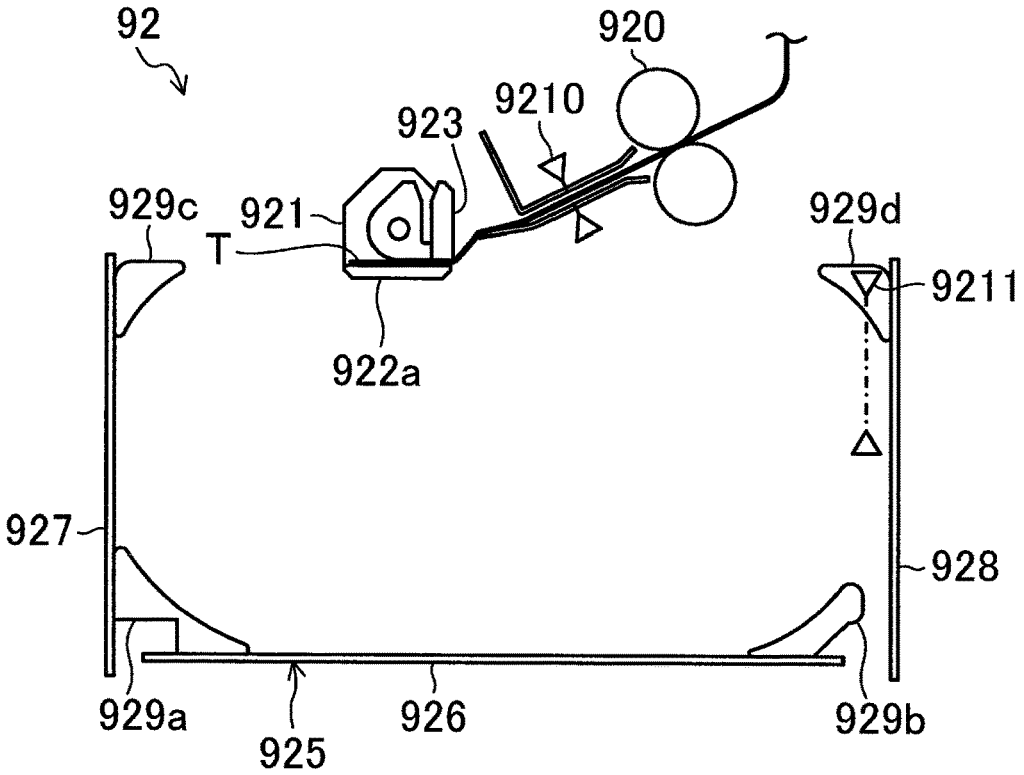
FIG. 12 illustrates a state where a tape gripping part has gripped an end portion of the tape.
Figure 13:
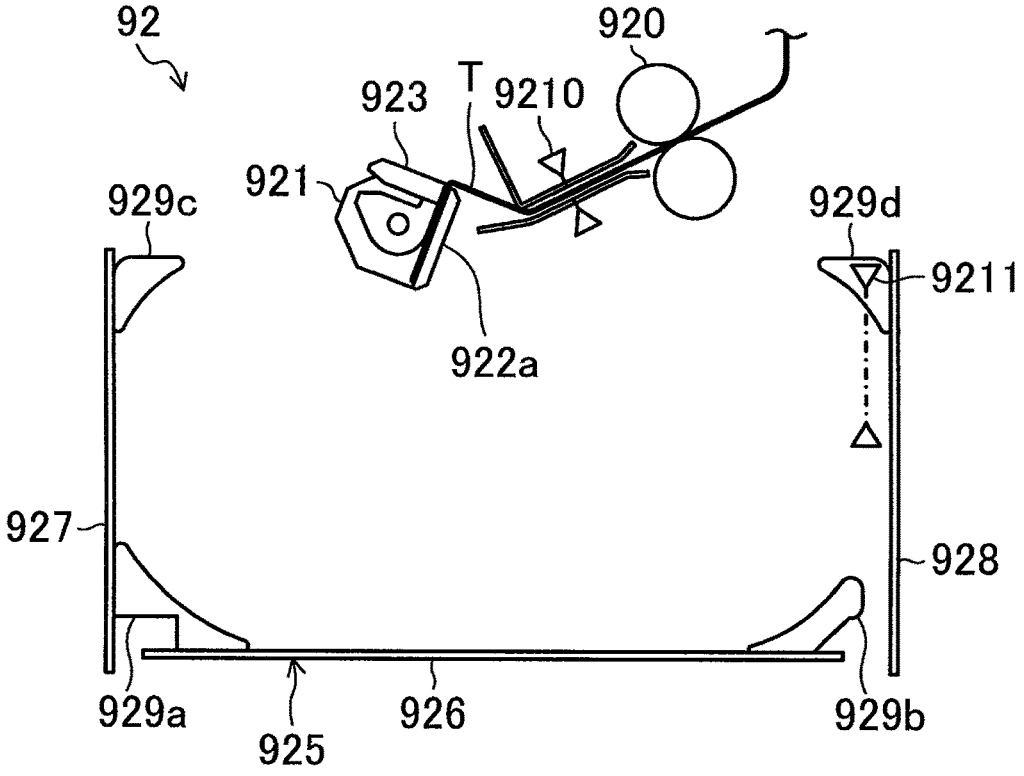
FIG. 13 illustrates a state where the tape gripping part has started to rotate while gripping the tape at the end portion thereof.
Figure 14:
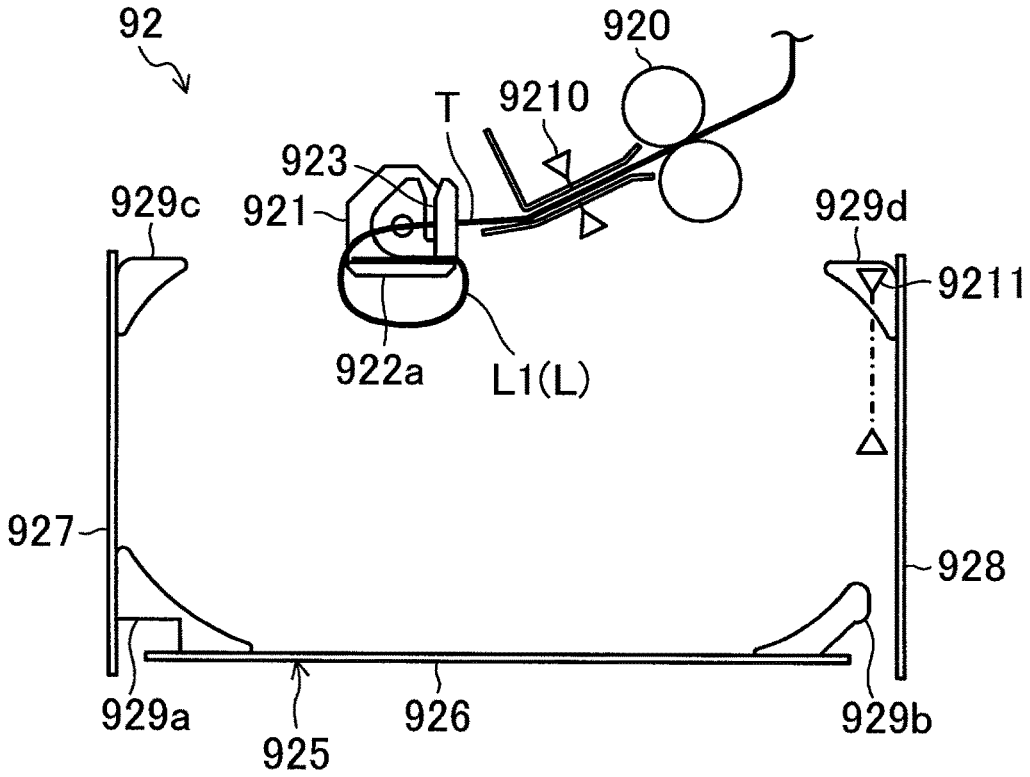
FIG. 14 illustrates a state where the tape gripping part has formed a small tape loop.
Figure 15:
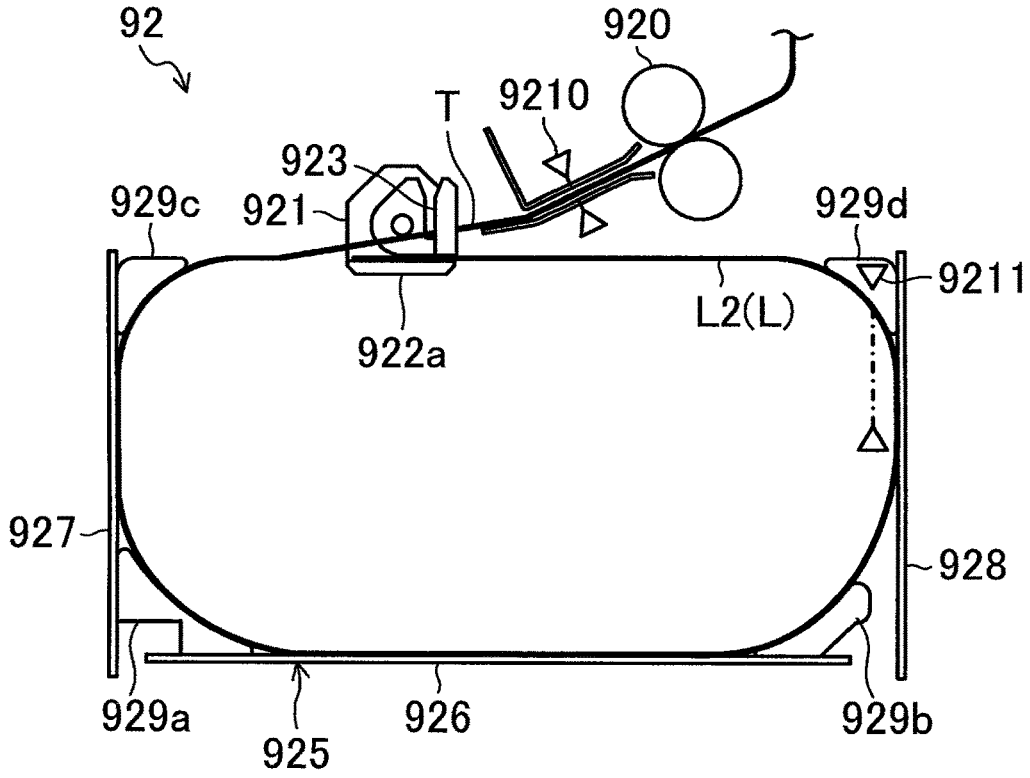
FIG. 15 illustrates a state where a large tape loop has been formed.

The control unit 120 forms a tape loop L while the second transport unit 8 is transporting the banknotes B from the bundling stacker 4 to the second position. FIG. 12 shows a state where the tape gripping part 921 has gripped an end portion of the tape T. FIG. 13 shows a state where the tape gripping part 921 has started to rotate while gripping the tape T at the end portion thereof. FIG. 14 shows a state where the tape gripping part 921 has formed a small tape loop L1. FIG. 15 shows a state where a large tape loop L2 has been formed.

First, the pair of feed rollers 920 rewinds the tape T until the first tape sensor 9210 detects the end portion of the tape T. When the end portion of the tape T is detected, the pair of feed rollers 920 feeds the tape T. At this time, the tape gripping part 921 is in a standby state with a gap left between the movable part 923 and the base plate 922*a* to allow the tape T fed by the pair of feed rollers 920 to be inserted into the gap. When the end portion of the tape T is inserted between the movable part 923 and the base plate 922*a*, the rotating shaft 924 is driven in rotation, and the end portion of the tape T is gripped by the movable part 923 and the base plate 922*a* as shown in FIG. 12. The movable part 923 is locked with the end portion of the tape T gripped by itself and the base plate 922*a*. The end portion of the tape T is gripped by the tape gripping part 921 substantially in a horizontal position.

Meanwhile, synchronously with the feeding of the tape by the pair of feed rollers 920, the printer 97 prints characters on the tape T.

Then, the tape gripping part 921 starts to rotate while gripping the tape T at the end portion thereof as shown in FIG. 13. In the meantime, the pair of feed rollers 920 keeps feeding the tape T. The tape gripping part 921 rotates to displace the end portion of the tape T downward, i.e., rotates counterclockwise in FIG. 13.

When the tape gripping part 921 makes substantially one round, a tape loop L is formed as shown in FIG. 14. Such a tape loop L formed by having the tape gripping part 921 make substantially one round will be hereinafter referred to as a "small tape loop L1." The end portion of the tape T gripped by the tape gripping part 921 is located at an upper portion of the small tape loop L1, and the small tape loop L1 is formed under the tape gripping part 921. The small tape loop L1 is formed at a lower level than the pair of feed rollers 920.

When the small tape loop L1 is formed, the rotation of the tape gripping part 921 stops, while the pair of feed rollers 920 keeps feeding the tape T. As a result, the small tape loop L1 gradually expands. Since the end portion of the tape T gripped by the tape gripping part 921 is located at the upper portion of the small tape loop L1, and the tape T is fed by the pair of feed rollers 920 from the upper portion of the small tape loop L1, the small tape loop L1 expands downward. Since the guide 925 is arranged under the tape gripping part 921, the tape loop L soon comes into contact with the guide 925, and thus the shape of the tape loop L is defined by the guide 925. When the cumulative length of the tape T fed by the pair of feed rollers 920 finally reaches a predetermined value, the tape loop L is formed into a substantially rectangular shape by the guide 925 as shown in FIG. 15. This tape loop L will be hereinafter referred to as a "large tape loop L2." The large tape loop L2 is in contact with the lower guide 926 and the first and second lateral guides 927 and 928, and has a substantially rectangular shape. In addition, the large tape loop L2 is also in contact with the first to fourth corner guides 929*a* to 929*d* such that the large tape loop L2 has a rectangular shape having rounded corners.

The control unit 120 detects that the large tape loop L2 has been formed by being notified of the fact that the second tape sensor 9211 detects the tape T when the cumulative length of the tape T fed by the pair of feed rollers 920 reaches the predetermined value. The control unit 120 calculates the cumulative length of the tape T fed based on the angle of rotation of the stepping motor that has driven the pair of feed rollers 920 since the first tape sensor 9210 has detected the end portion of the tape T. If the second tape sensor 9211 has not detected the tape T yet even though the cumulative length of the tape T fed by the pair of feed rollers 920 has already reached a predetermined value, a portion of the tape loop L may possibly sag inward and the shape of the tape loop L may be different from the desired shape along the guide 925 (i.e., the shape of the large tape loop L2). Thus, if the second tape sensor 9211 has not detected the tape T yet when the cumulative length of the tape T fed by the pair of feed rollers 920 reaches the predetermined value, the control unit 120 rewinds the tape T to a predetermined rewinding length, and then feeds the tape T again until the cumulative length fed reaches the predetermined value. Then, the control unit 120 determines whether the second tape sensor 9211 has detected the tape T or not. If the second tape sensor 9211 still has not detected the tape T yet, the control unit 120 performs the rewinding, feeding and detection check of the tape T all over again.

The second tape sensor 9211 is configured to detect the tape T guided by the fourth corner guide 929*d*. That is, the second tape sensor 9211 detects whether the tape T is present or not at a predetermined position above the banknotes B transported into the large tape loop L2. If any portion of the tape loop L sags inward, it is highly likely that the upper portion of the tape loop L sags due to the tape's own weight. That is to say, arranging the second tape sensor 9211 at the above-described position allows detection of the sag of the tape loop L accurately.

The large tape loop L2 is formed synchronously with the transport of the banknotes B from the bundling stacker 4 to the bundling unit 9 by the second transport unit 8 as shown in FIGS. 10 and 11. Ordinarily (i.e., if the large tape loop L2 is formed at a time by feeding the tape T once), the large tape loop L2 has already been formed when the banknotes B are transported to the second position.

—Winding of the Tape—

Figure 17:
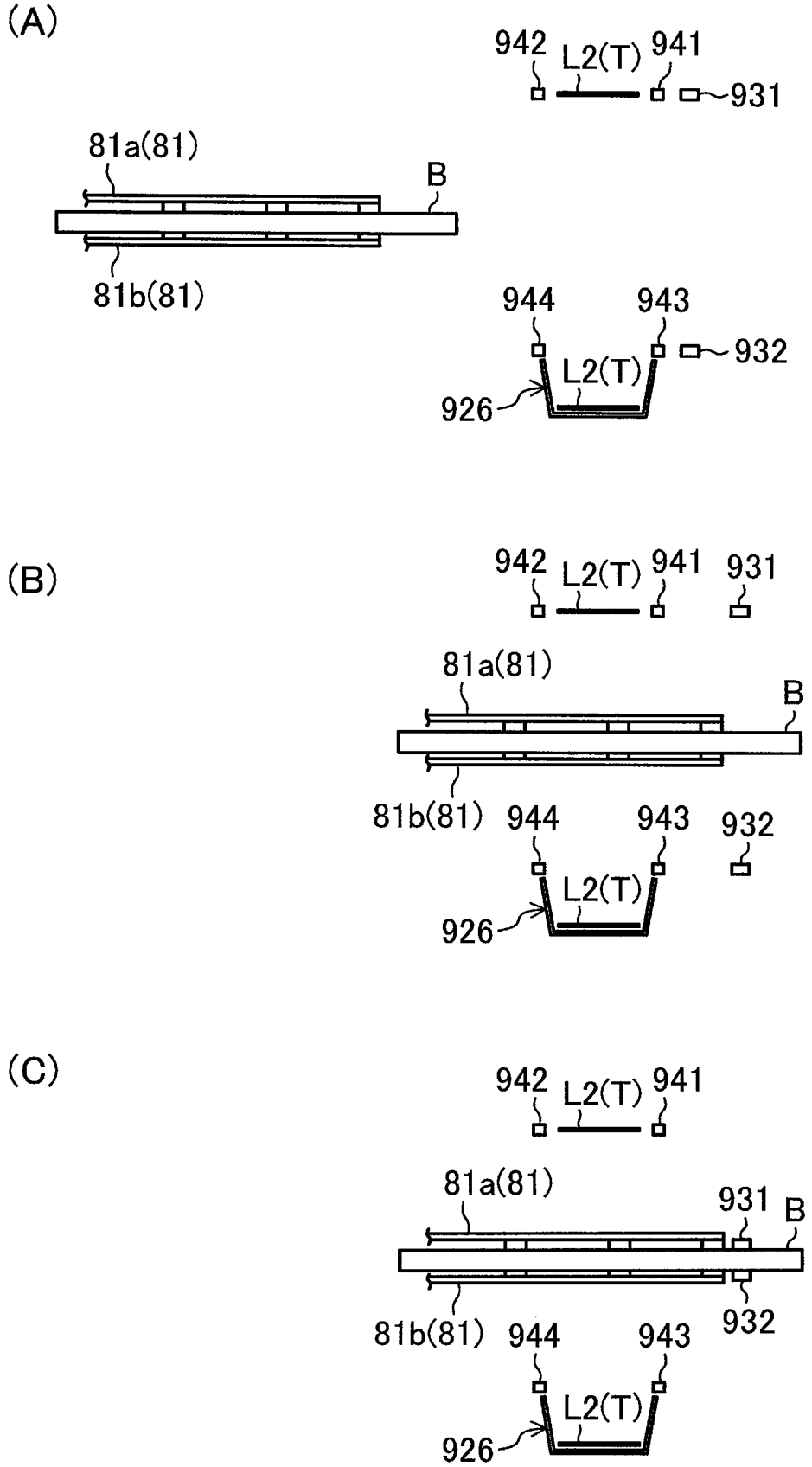
Figure 18:
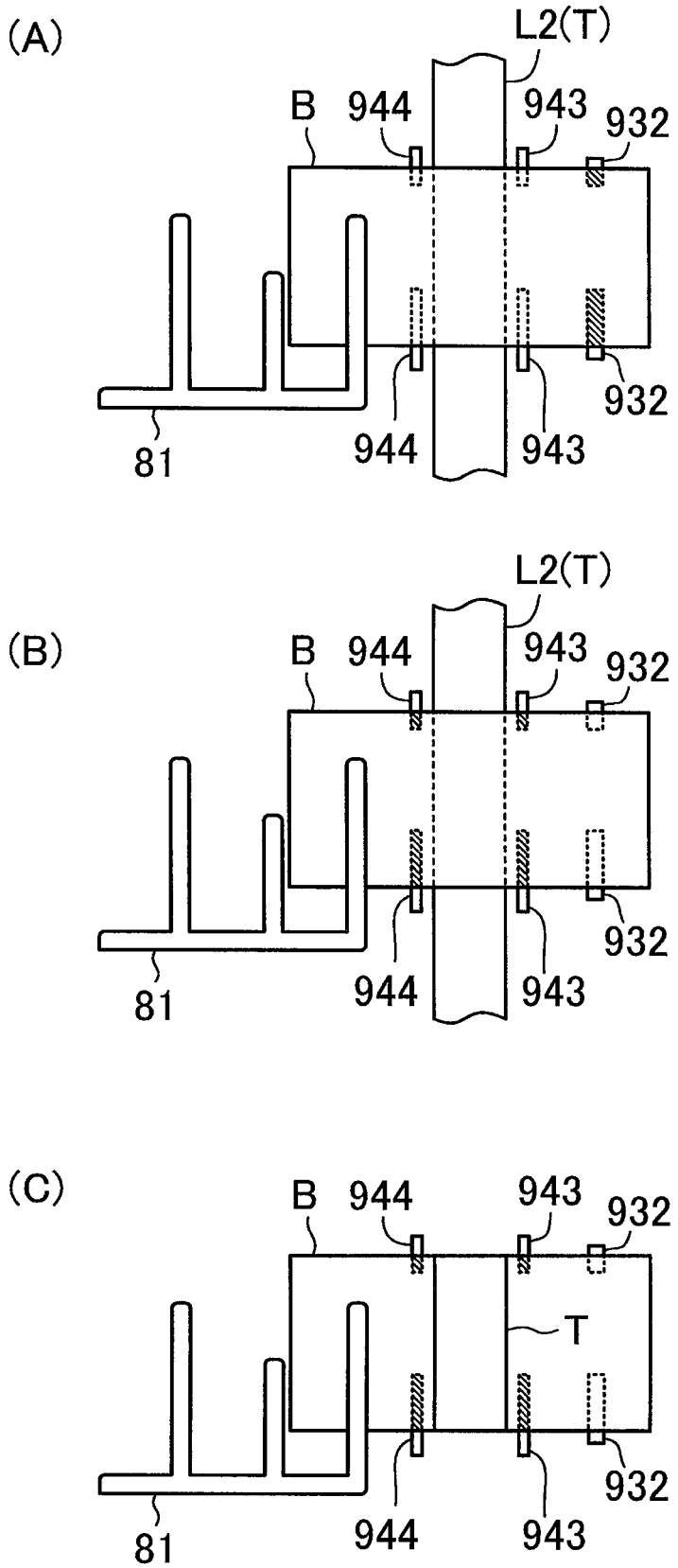
Figure 19:
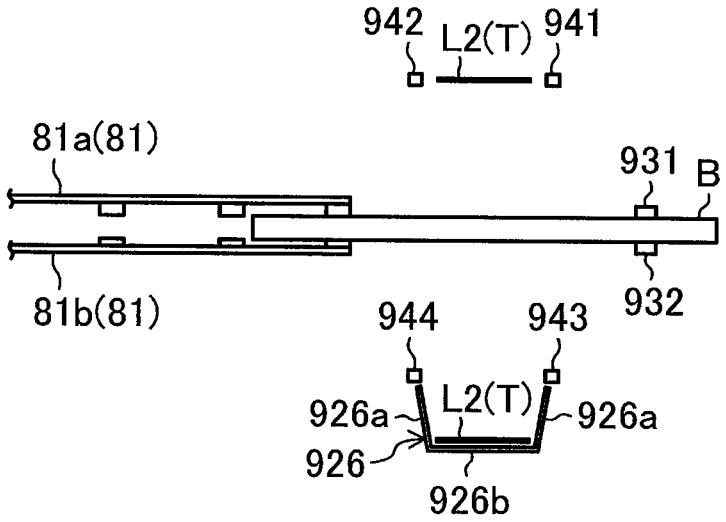
Figure 19:
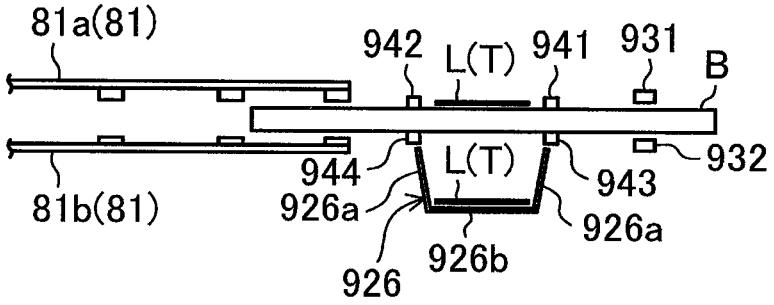
Figure 19:
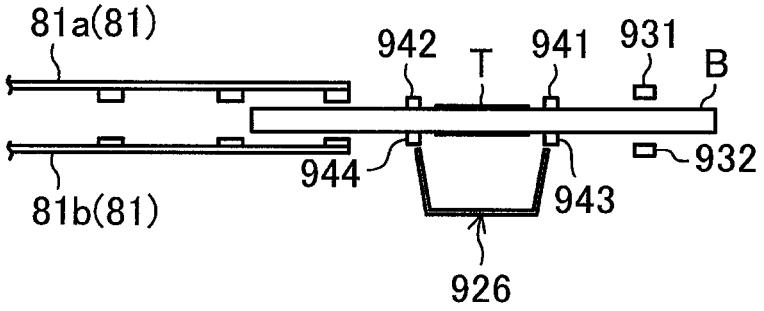
Figure 20:
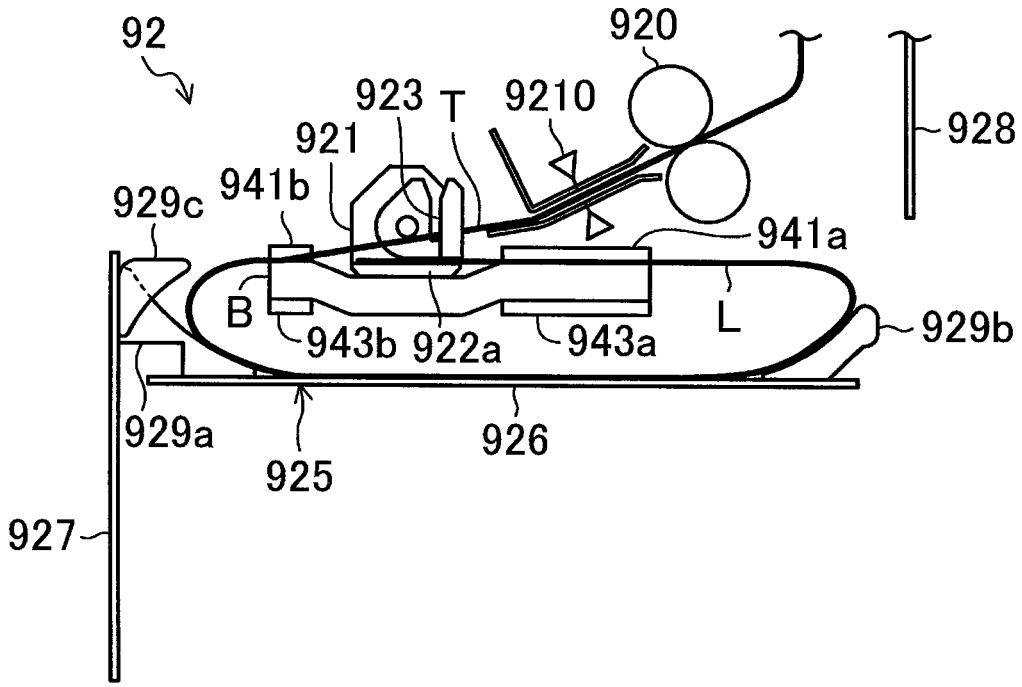
FIG. 20 illustrates a state of a guide when the clamp presses the banknotes.

FIGS. 16(A)-16(C) show how the respective members operate until the banknotes B transported into the large tape loop L2 are gripped by the temporary gripping unit 93 when the banknotes B are viewed in the thickness direction. FIGS. 17(A)-17(C) show how the respective members operate until the banknotes B transported into the large tape loop L2 are gripped by the temporary gripping unit 93 when the banknotes B are viewed in the direction parallel to their shorter edges. FIGS. 16(A) and 17(A) show a state just before the banknotes B are transported into the large tape loop L2. FIGS. 16(B) and 17(B) show a state where the banknotes B are transported into the large tape loop L2. FIGS. 16(C) and 17(C) show a state where the banknotes B are gripped by the temporary gripping unit 93. FIGS. 18(A)-18(C) show how the respective members operate until the banknotes B are gripped again by the gripper 81 and the tape T is wound around the banknotes B when the banknotes B are viewed in the thickness direction. FIGS. 19(A)-19(C) show how the respective members operate until the banknotes B are gripped again by the gripper 81 and the tape T is wound around the banknotes B when the banknotes B are viewed in the direction parallel to their shorter edges. FIGS. 18(A) and 19(A) show a state where the gripper 18 grips the banknotes B again, FIGS. 18(B) and 19(B) show a state where the clamp 94 presses the banknotes B, and FIGS. 18(C) and 19(C) show a state where the tape T is wound around the banknotes B. FIG. 20 shows the state of the guide 925 when the clamp 94 presses the banknotes B. In FIGS. 16(A)-16(C) and 18(A)-18(C), the upper gripping part 931, the upper fixed clamp 941 and the upper movable clamp 942 are not shown. Further, in FIGS. 16(A)-16(C) and 18(A)-18(C), portions of the lower gripping part 932 and the lower clamps 943, 944 in contact with the banknotes B are hatched.

As described above, the second transport unit 8 transports the banknotes B to the second position as shown in FIGS. 10 and 11 (see FIGS. 16(A) and 17(A)), and then moves the banknotes B in the second horizontal direction to bring the banknotes B into the large tape loop L2. The gripper 81 of the second transport unit 8 moves the banknotes B in the second horizontal direction to a third predetermined position as shown in FIGS. 16(B) and 17(B). At this third position, the tape T corresponds with approximately the center of the banknotes B in a direction parallel to their longer edges in the second horizontal direction. At this time, the temporary gripping unit 93 also moves in the second horizontal direction as the second transport unit 8 moves. Specifically, in the second horizontal direction, the temporary gripping unit 93 moves in the same direction as the second transport unit 8. The magnitude of movement of the temporary gripping unit 93 corresponds with that of the second transport unit 8.

When the banknotes B are transported to the third position, the temporary gripping unit 93 grips the banknotes B. More specifically, as shown in FIGS. 16(C) and 17(C), the upper gripping part 931 moves downward and the lower gripping part 932 moves upward such that the upper and lower gripping parts 931 and 932 sandwich the banknotes B vertically at substantially the middle of the large tape loop L2 in the height direction. The temporary gripping unit 93 grips a top portion of the banknotes B that has been inserted into the large tape loop L2 and that has passed through the large tape loop L2.

When the temporary gripping unit 93 grips the banknotes B, the gripper 81 of the second transport unit 8 releases the banknotes B and moves in the second horizontal direction opposite to the direction in which the banknotes B were brought into the large tape loop L2. Then, as shown in FIGS. 18(A) and 19(A), the gripper 81 grips the banknotes B again at their portion other than a portion to be bundled (a portion around which the tape T will be wound later in the process).

Subsequently, the clamp 94 presses the banknotes B in the stacking direction, i.e., from over and from under the banknotes in the vertical direction. Specifically, as the lower clamps 943, 944 of the clamp 94 move upward, the gripper 81 and the temporary gripping unit 93 also move upward accordingly. At this time, the upper movable clamp 942 is located at the clamp position. Finally, as shown in FIGS. 18(B) and 19(B), the lower clamps 943, 944 press the banknotes B against the upper clamps 941, 942. The upper clamps 941, 942 and the lower clamps 943, 944 sandwich vertically the banknotes B at both sides of their portions to be bundled in the direction parallel to their longer edges. Thus, the banknotes B are compressed vertically by the upper clamps 941, 942 and the lower clamps 943, 944. The lower clamps 943, 944 that move upward stop at a position where the upper clamps 941, 942 and the lower clamps 943, 944 compress the banknotes B to a predetermined thickness. When the upper clamps 941, 942 and the lower clamps 943, 944 press the banknotes B, the gripper 81 and the temporary gripping unit 93 no longer grip the banknotes B.

The lower clamps 943, 944 form integral parts of the lower guide 926. Thus, as shown in FIGS. 18(B) and 19(B), the lower guide 926 also moves upward as the lower clamps 943, 944 move upward. At this time, the pair of feed rollers 920 rewinds the tape T as the lower guide 926 moves upward. As a result, as shown in FIG. 20, the tape loop L shrinks as the lower guide 926 moves upward. In addition, the second lateral guide 928 also moves upward as the lower guide 926 moves upward. Thus, a space is left for the tape loop L to deform. That is to say, if the velocity of the upward movement of the lower guide 926 is too high as compared with the rate of shrinkage of the tape loop L, the tape loop L deforms so as to grow out of the guide 925. At this time, the second lateral guide 928 has retreated from beside the tape loop L, and thus the tape loop L is allowed to expand toward the space where the second lateral guide 928 was located originally. This prevents the tape T from bending.

Note that the third abutting portion 942*c* is provided between the first and second abutting portions 942*a* and 942*b* of the upper movable clamp 942, and the third abutting portion 942*c* is located at a lower level than the first and second abutting portions 942*a*, 942*b*. Further, the base plate 922*a* of the tape gripping part 921 is arranged between the first and second abutting portions 941*a* and 941*b* of the upper fixed clamp 941, and located at a lower level than the first and second abutting portions 941*a*, 941*b*. On the other hand, in the lower clamps 943, 944, there is a downward recess between the first and second abutting portions 943*a* and 943*b*, and between the first and second abutting portions 944*a* and 944*b*. Thus, the banknotes B pressed by the clamp 94 are depressed downward substantially at the middle of their shorter edges.

The upward movement of the lower guide 926 stops when the upward movement of the lower clamps 943, 944 stops. On the other hand, the pair of feed rollers 920 keeps rewinding the tape T even after the upward movement of the lower guide 926 has stopped. Finally, as shown in FIGS. 18(C) and 19(C), the tape T is wound around the banknotes B. As described above, the position of the tape T in the tape width direction is regulated by the sidewalls 926*a*, 926*a* of the lower guide 926 until just before the tape T is wound around the banknotes B. Thus, the tape T is wound correctly around the intended portion of the banknotes.

—Bonding of the Tape, Cutting of the Tape, and Stamping of a Seal on the Tape—

Figure 21:
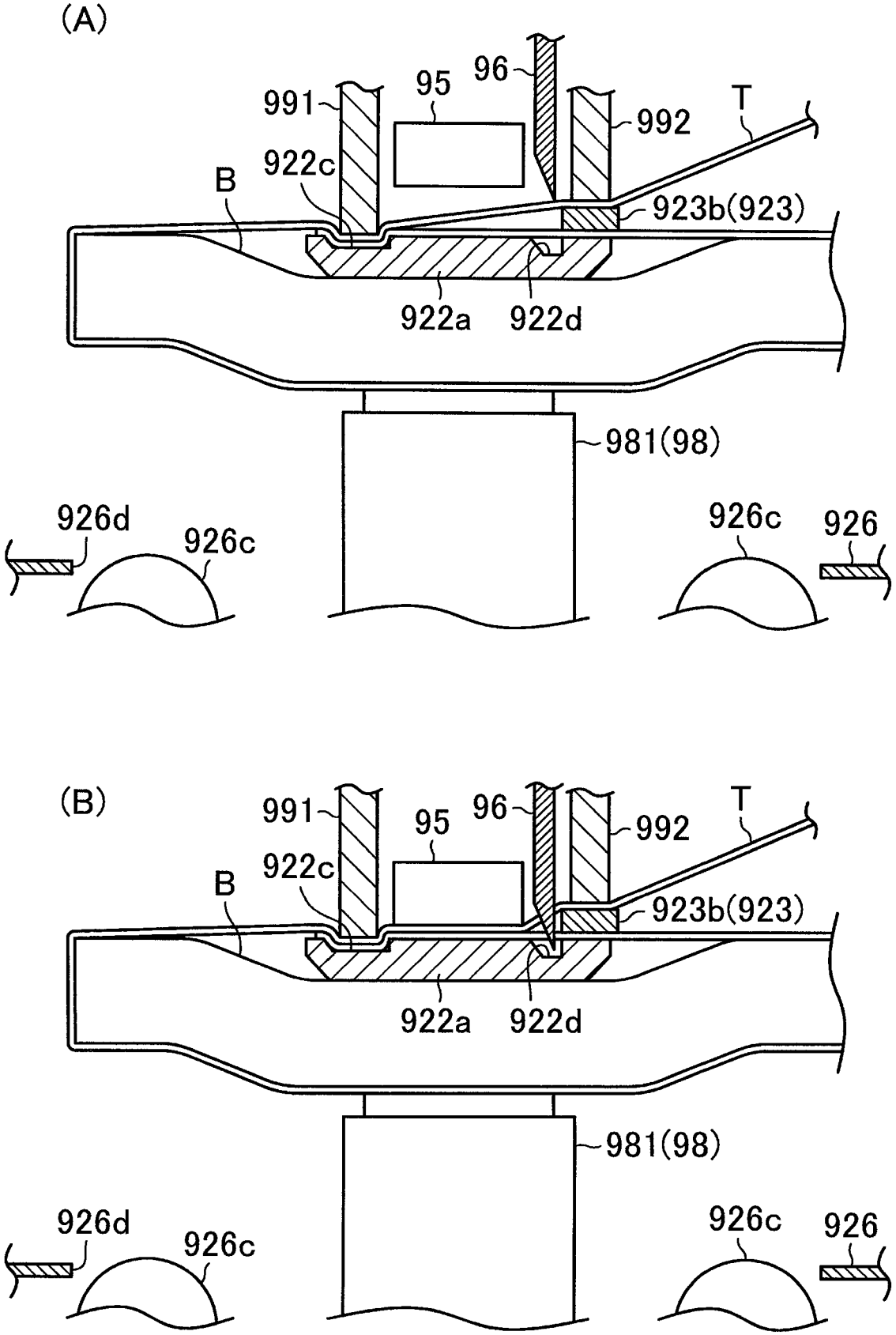

Subsequently, the heater 95 bonds together portions of the tape T, and the cutter 96 cuts the tape T. In addition, the stamper 98 stamps a seal on the tape T. FIGS. 21(A) and 21(B) show how the tape T is bonded and cut, and a seal is stamped on the tape T. FIG. 21(A) illustrates a state where the first and second tape pressers press the tape, and FIG. 21(B) illustrates a state where the heater heat-seals the portions of the tape and the cutter cuts the tape.

When the tape T is wound around the banknotes B, the heater 95 and the cutter 96 move downward together. At this time, the first and second tape pressers 991, 992 also move downward together with the heater 95 and the cutter 96.

First, as shown in FIG. 21(A), the first tape presser 991 is caught in the first recessed groove 922*c* of the base plate 922*a* to sandwich the tape T between itself and the bottom surface of the first recessed groove 922*c*. At the same time, the second tape presser 992 sandwiches the tape T between itself and the upper surface of the pressing part 923*b* of the movable part 923. At this time, heat sealing by the heater 95 and cutting by the cutter 96 are not performed yet.

Subsequently, as shown in FIG. 21(B), the heater 95 and the base plate 922*a* of the tape gripping part 921 sandwich the end portion of the tape T and a portion of the tape T which has made one round and which overlaps with the end portion of the tape T. That is to say, the heater 95 sandwiches these portions of the tape T between itself and a portion of the base plate 922*a*, which is located between the first and second recessed grooves 922*c* and 922*d*. The heater 95 heat-seals the overlapping portions of the tape T.

Synchronously with the heat-sealing by the heater 95, the cutter 96 cuts the tape T. The cutter 96 cuts a portion of the tape T upstream of the portions that are heat-sealed by the heater 95, i.e., a portion of the tape T located closer to the pair of feed rollers 920 than the heat-sealed portions (hereinafter referred to as an "extra portion"). The guiding tabs 96*a* of the cutter 96 are guided by the first and second guides 923*c*, 923*d* to bring the cutter 96 into the second recessed groove 922*d*. Specifically, one of the guiding tabs 96*a* is guided to the guide groove 923*e* between the first guide 923*c* and the fitting 923*a*, and the other guiding tab 96*a* is guided by an end face of the second guide 923*d*. The cutter 96 enters the second recessed groove 922*d*, but stops at a position where the cutter 96 does not contact with the bottom surface of the second recessed groove 922*d*. Between the heater 95 on the base plate 922*a* and the movable part 923, the end portion of the tape T, i.e., the portion of the tape T bundling the banknotes B, is present under the extra portion of the tape T. The cutting edge of the cutter 96 is saw-toothed, and thus has tiny indentation. When the cutter 96 enters the second recessed groove 922*d*, the tips of the cutting edge of the cutter 96 penetrate both of the extra portion and the end portion of the tape T, while the indents of the cutting edge penetrate only the extra portion of the tape T and do not penetrate the end portion. Thus, the extra portion of the tape T is completely cut by the cutter 96. On the other hand, the end portion of the tape T is not cut because only the tips of the cutting edge penetrate the end portion of the tape T. The end portion of the tape T is thus provided with perforations formed by a plurality of small holes.

In this manner, the portions of the tape T wound around the banknotes B are bonded together, and the extra portion of the tape T is cut off. The tape T bundling the banknotes B is provided with the perforations, and thus the tape T is easily cuttable along the perforations when the tape T needs to be removed.

By guiding the cutter 96 that moves downward by the first and second guides 923*c*, 923*d*, the cutter 96 is prevented from interfering with the movable part 923 even if the cutter 96 has some error such as a tooth profile error or an assembling error, and the cutter 96 is allowed to enter the second recessed groove 922*d* appropriately. Further, the provision of the second recessed groove 922*d* allows prevention of the cutter 96 and the base plate 922*a* from coming into contact with each other even if the cutter 96 has some error such as a tooth profile error or an assembling error. This configuration allows improvement of the durability of the cutter 96.

After the tape T has been bonded and cut, the heater 95, the cutter 96 and the first and second tape pressers 991 and 992 move upward. At this time, the first tape presser 991 still sandwiches the tape T between itself and the bottom surface of the first recessed groove 922*c* for a while even after the heater 95 has separated from the tape T. The portion of the tape T that has just been heat-sealed is not cured, and thus the heat sealing could end up with failure if a load were applied to the heat-sealed portion. Thus, by making the first tape presser 991 keep pressing the tape T even after the heater 95 has separated from the heater 95, the load applied to the heat-sealed portion while the heat-sealed portion is being cured is reducible.

Further, the stamper 98 stamps a seal on the tape T synchronously with the heat sealing by the heater 95 and the cutting by the cutter 96. The stamper 98 also moves upward together with the lower guide 926, and is located right under the banknotes B when the tape T is heat-sealed and cut. After the tape T is rewound by the pair of feed rollers 920 to wind the tape T around the banknotes B, the stamper 98 allows the stamp 981 to move upward. The stamp 981 comes into contact with the tape T wound around the banknotes B to stamp a seal on the tape T.

The banknotes B are compressed by the clamp 94 as shown in FIGS. 18(C) and 19(C). That is, the banknotes B are fixed by the clamp 94. Further, the second transport unit 8 transports the banknotes B to a predetermined position, and thus the banknotes B are also positioned. Since the tape T is wound around the banknotes B thus positioned, the position of the tape T has already been roughly determined, too. That is, with the banknotes B compressed by the clamp 94 and the tape T wound around the banknotes B, the position of the tape T is already known. This allows stamping of the seal on the tape T at a correct position without detecting the position of the banknotes B or tape T separately.

The stamper 98 forms an integral part of the lower guide 926 which regulates the position of the tape T in the tape width direction, and thus the stamp 981 is positioned relative to the tape T. Specifically, the stamp 981 goes through the through hole 926*d* in the bottom wall 926*b* of the lower guide 926, and stamps a seal on the tape T between the sidewalls 926*a*, 926*a*. The position of the tape T wound on the lower surface of the banknotes B is regulated in the tape width direction by the sidewalls 926*a*, 926*a*, and thus the tape T is located at the destination of the stamp 981 moving upward between the sidewalls 926*a*, 926*a*. Thus, the stamp 981 stamps a seal on the tape T so as to prevent any portion of the seal from running off the edges of the tape T.

Even if there are any characters or signs printed by the printer 97 under a portion of the tape T on which the stamp 981 stamps a seal in the longitudinal direction of the tape T, the seal stamped by the stamp 981 does not overlap with the print made by the printer 97, because the portion on which the stamp 981 stamps the seal and the portion on which the printer 97 prints the characters or signs are misaligned with each other in the tape width direction.

Further, the heater 95 and the cutter 96 are arranged on one of the two sides of the banknotes B in the stacking direction and the stamper 98 is arranged on the other side of the banknotes B in the stacking direction. This ensures reliably a space for arranging the heater 95 and the cutter 96 and a space for arranging the stamper 98. That is, if the heater 95, the cutter 96 and the stamper 98 are all arranged on an identical side of the banknotes B in the stacking direction, the degree of freedom of arrangement is greatly restricted because the space is limited. On the other hand, if the heater 95 and the cutter 96 are arranged on one side and the stamper 98 is arranged on the other side in the stacking direction of the banknotes B, the spaces for arranging all of them are ensured, thus increasing the degree of freedom of arrangement. Further, the bonding and/or cutting processes may be performed on the one side of the banknotes B in the stacking direction, while the stamping process is performed on the other side of the banknotes B in the stacking direction.

—Discharge of Banknotes—

Figure 22:
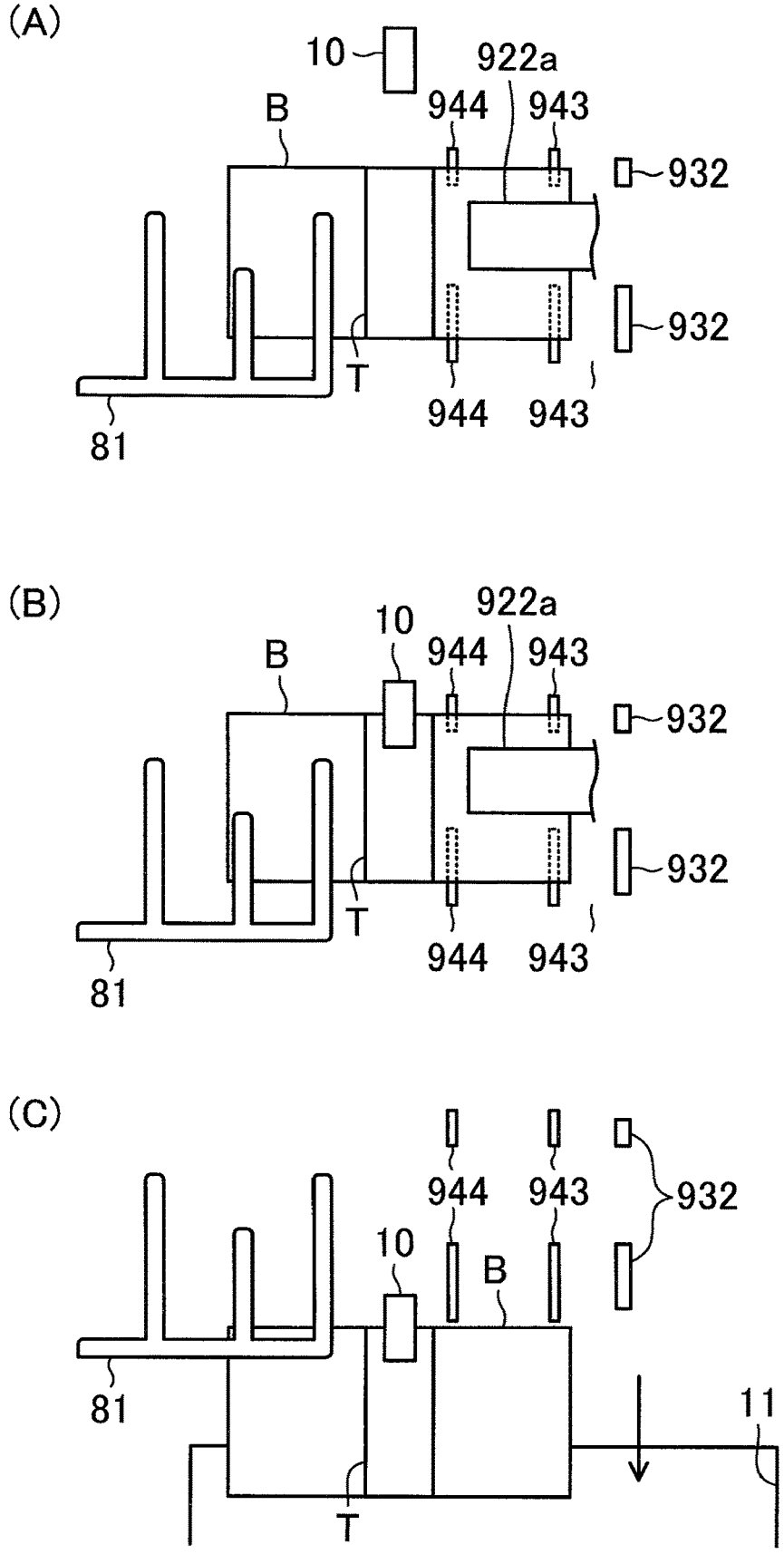
Figure 23:
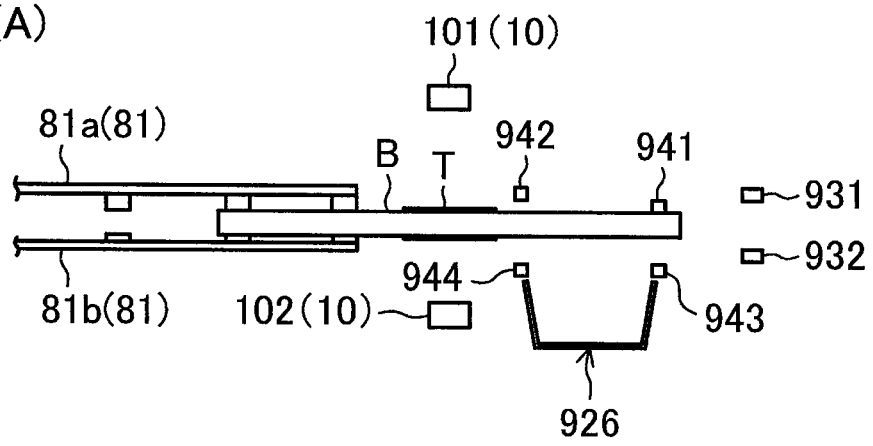
Figure 23:
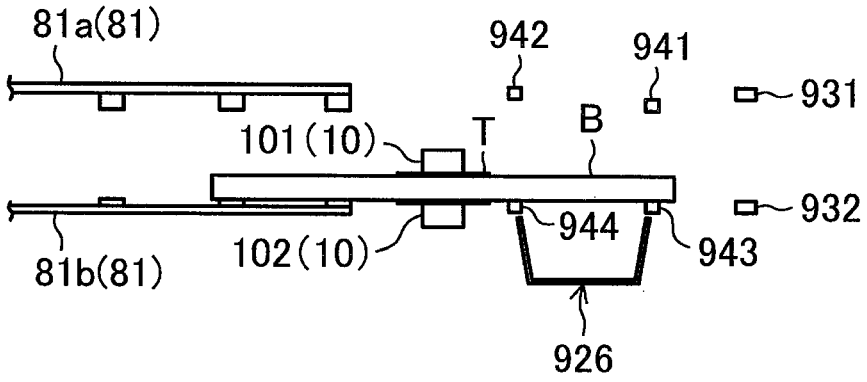

The banknotes B bundled with the tape T are transported to the dispense unit 11 by the second and third transport units 8 and 10. FIGS. 22(A)-22(C) show how the respective members operate until the bundled banknotes B are dispensed to the dispense unit 11 when the banknotes B are viewed in the thickness direction. FIGS. 23(A) and 23(B) show how the respective members operate until the bundled banknotes B are dispensed to the dispense unit 11 when the banknotes B are viewed in a direction parallel to their shorter edges. In FIGS. 22(A)-22(C) and 23(A) and 23(B), FIGS. 22(A) and 23(A) illustrate a state where the bundled banknotes B are removed in the second horizontal direction. FIGS. 22(B) and 23(B) illustrate a state where the third transport unit 10 has gripped the bundled banknotes B. FIG. 22(C) illustrates a state where the third transport unit 10 has transported the banknotes B to the dispense unit 11. In FIGS. 22(A)-22(C), the upper gripping part 931, the upper fixed clamp 941 and the upper movable clamp 942 are not shown.

After the tape T has been bonded and cut and the seal has been stamped on the tape T, the gripper 81 grips the bundled banknotes B. Then, the lower clamps 943, 944 move downward to release the pressure applied by the clamp 94. The lower gripping part 932 of the temporary gripping unit 93 also moves downward slightly. In addition, the upper movable clamp 942 moves upward. Thereafter, the second transport unit 8 transports the bundled banknotes B to a predetermined extent in the second horizontal direction and to the opposite direction from the direction of transport of the banknotes into the large tape loop L2 as shown in FIGS. 22(A) and 23(A). More specifically, when the banknotes B are bundled together with the tape T, the tape gripping part 921 grips the end portion of the tape T, and the base plate 922*a* of the tape gripping part 921 is inserted into the gap between the tape T and the banknotes B as shown in FIGS. 21(A) and 21(B). Therefore, the second transport unit 8 moves the bundled banknotes B in the second horizontal direction until the base plate 922*a* is withdrawn from the gap between the tape T and the banknotes B.

The upper movable clamp 942 is located on the side of the tape T toward which the bundled banknotes B are drawn in the second horizontal direction, and the third abutting portion 942*c* of the upper movable clamp 942 is located at a lower level than the tape T. If the bundled banknotes B are drawn in the second horizontal direction in this state, the tape T interferes with the third abutting portion 942*c*. Thus, when the bundled banknotes B are drawn in the second horizontal direction, the upper movable clamp 942 moves upward until the third abutting portion 942*c* reaches a higher level than the tape T. As a result, the bundled banknotes B are drawn in the second horizontal direction with the tape T prevented from coming into contact with the third abutting portion 942*c*. The second transport unit 8 moves the bundled banknotes B only to such a degree that the base plate 922*a* may be withdrawn from the gap between the tape T and the banknotes B, and then stops transporting the bundled banknotes B.

When the pressure applied by the clamp 94 to the banknotes B is released, the banknotes B are supported by the gripper 81 and the base plate 922*a*. Since the gripper 81 grips the banknotes B at one end of their longer edges, most of the weight of the banknotes B is placed on the base plate 922*a*. Further, since the base plate 922*a* is located under the bonded portions of the tape T, most of the weight of the banknotes B is also placed on the bonded portions of the tape T. Thus, if the bonding of the tape T by the heater 95 were insufficient, the bonded portions of the tape T could separate from each other when the pressure applied by the clamp 94 to the banknotes B is released. In such a case, the tape T would fall down. In this embodiment, however, the lower guide 926 is located under, and away from, the tape T while the tape T is wound around the banknotes B, bonded and cut, and therefore, the tape T that has fallen down is received by the lower guide 926. At least when the pressure applied by the clamp 94 to the banknotes B is released, the control unit 120 makes the third tape sensor 926*e* see if the tape T is present or not on the lower guide 926. Thus, if the tape T has fallen on the lower guide 926, the control unit 120 detects the fall of the tape T by being notified of the fact that the third tape sensor 926*e* has detected the presence of the tape T. The control unit 120 informs the operator of the fall of the tape T through the touch panel 17 or any other notification means if the third tape sensor 926*e* has detected the fall of the tape T.

Subsequently, the gripper 81 releases its grip on the bundled banknotes B as shown in FIGS. 22(B) and 23(B). In place of the gripper 81, the third transport unit 10 grips the bundled banknotes B in turn. Specifically, the lower clamps 943, 944 move downward to the predetermined level. This level corresponds to the level of the dispense unit 11. In addition, the lower gripping part 932 also moves downward to the same level as the lower clamps 943, 944. The second transport unit 8 displaces the bundled banknotes B to the level of the lower clamps 943, 944, and then releases its grip on the gripper 81. At this time, the lower arm 81*b* is level with the lower clamps 943, 944. That is, the bundled banknotes B are now placed on the lower arm 81*b* and the lower clamps 943, 944. Thereafter, the third transport unit 10 grips the bundled banknotes B.

Then, the third transport unit 10 transports the bundled banknotes B in the first horizontal direction toward the dispense unit 11. At this time, the lower arm 81*b* and lower clamps 943, 944 of the second transport unit 8 support the bundled banknotes B from under them, and function as a guide when the bundled banknotes B are transported to the dispense unit 11. When the bundled banknotes B approaches the dispense unit 11, the third transport unit 10 gradually releases its grip on the bundled banknotes B. Finally, the bundled banknotes B are pushed toward the dispense unit 11 by the third transport unit 10.

The bundled banknotes pushed toward the dispense unit 11 are dispensed out of the housing 12 through the dispense unit 11.

<Guidance to Working Point>

The banknote handling apparatus 100 configured in this manner has the function of guiding an operator to a working point for maintenance of the apparatus or recovery of the banknotes stacked. Examples of the maintenance include troubleshooting for jamming of the banknotes or the tape T, replacing consumables such as an ink ribbon of the printer 97, and refilling the stamper 98 with ink. Examples of the recovery of the banknotes include recovery of the banknotes from the bundling stacker 4, recovery of the banknotes from the non-bundling stacker 5, and recovery of the banknotes from the reject stacker 6.

In the banknote handling apparatus 100, some portions of the housing 12 are configured to be openable/closable to allow the maintenance of the inside of the banknote handling apparatus 100.

Specifically, approximately a lower half of the second side surface 124 of the housing 12 is provided with a lower cover 131. The lower cover 131 is provided with the second outlets 53 of the non-bundling stackers 5 and the touch panel 17. The lower cover 131 is configured to be rotatable on an axis extending vertically along the edge defined between the third side surface 125 facing the first side surface 123 and the second side surface 124. The first handling section 126 is exposed when the lower cover 131 is opened.

Approximately a half of the top surface 121 closer to the first side surface 123 and a portion of approximately an upper half of the second side surface 124 closer to the first side surface 123 are provided with a bundling unit cover 132. The bundling unit cover 132 is configured to be slidable toward the first side surface 123. The bundling unit 9 is exposed when the bundling unit cover 132 is slid.

A portion of the top surface 121 closer to the third side surface 125 is provided with a reel cover 133. The reel cover 133 is configured to be rotatable on an axis extending horizontally along the edge defined between the top surface 121 and the third side surface 125. The tape reel 911 is exposed when the reel cover 133 is opened.

Further, inside the banknote handling apparatus 100, some components are configured to be movable as units. For example, the recognition unit 3 is configured to be movable. Further, part of the first transport unit 7 is configured as a movable unit. These units are moved to facilitate the maintenance of space behind them. These units are configured to be lockable when arranged at suitable positions, and to be movable once unlocked. The control unit 120 detects the opening/closing of the covers and the locked/unlocked state of the movable units.

Figure 24:
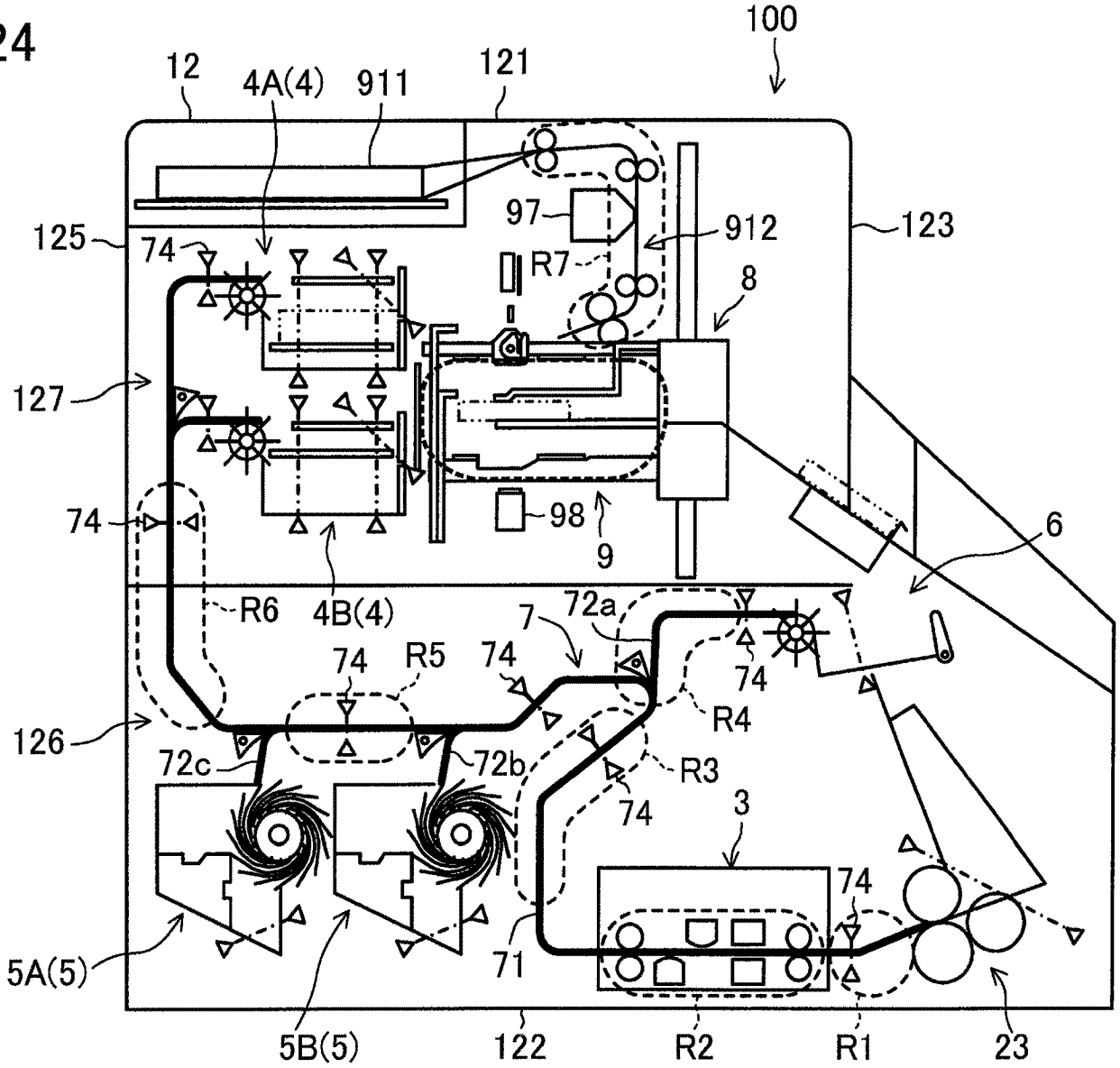
FIG. 24 illustrates positions in the banknote handling apparatus for detecting whether work is necessary or not.

The control unit 120 is configured to detect whether work such as maintenance and recovery of the banknotes is necessary or not. For example, the control unit 120 is configured to detect, using various sensors, whether the banknotes are jammed or not, whether the tape is jammed or not, whether the replacement/refilling of the consumables is necessary or not, and whether the recovery of the banknotes is necessary or not. FIG. 24 shows the points in the banknote handling apparatus 100 where a determination needs to be made whether the work needs to be performed or not. The banknote handling apparatus 100 detects whether or not the banknotes jammed in a region R1 near the intake rollers 23, in a region R2 near the recognition unit 3, in a section R3 of the main transport path 71 between the recognition unit 3 and the first diverged path 72*a*, in a section R4 of the first diverged path 72*a*, in a section R5 of the main transport path 71 between the second and third diverged paths 72*b* and 72*c*, and in a section R6 of the main transport path 71 between the third and fourth diverged paths 72*c* and 72*d*. Further, the banknote handling apparatus 100 detects whether or not the tape is jammed in a section R7 of the tape transporter 912, whether or not the ink ribbon of the printer 97 is running out, whether or not the ink of the stamper 98 runs short, whether or not the banknotes are stacked in the bundling stacker 4, whether or not the banknotes are stacked in the non-bundling stacker 5, and whether or not the banknotes are stacked in the reject stacker 6.

If the control unit 120 has detected that any of these kinds of work needs to be performed, the control unit 120 provides guidance for the operator. Specifically, the control unit 120 displays work procedures on the touch panel 17 by animation or in any other appropriate form, and irradiates the corresponding working point in the housing 12 with an LED. LEDs are provided near the working points in the housing 12. Note that the light source does not have to be an LED.

For example, to prompt the operator to do troubleshooting for the jamming of the banknotes in the main transport path 71 between the recognition unit 3 and the first diverged path 72*a*, the touch panel 17 displays sequentially an instruction to open the lower cover 131, an instruction to unlock the unit of the first and second non-bundling stackers 5A, 5B, an instruction to displace some unit on the main transport path 71, an instruction to remove the jammed ones of the banknotes, an instruction to put the unit on the main transport path 71 back to its original position, an instruction to put the unit of the first and second non-bundling stackers 5A, 5B back to its original position, and an instruction to close the lower cover 131. The control unit 120 irradiates the working points in the housing 12 with LEDs synchronously with display of these instructions on the touch panel 17. That is to say, if the lower cover 131 is opened, the control unit 120 lights the unit of the first and second non-bundling stackers 5A, 5B to be unlocked with an LED. When this unit is unlocked, the control unit 120 turns the LED off, and lights the unit of part of the main transport path 71 with an LED. When this unit is displaced, the control unit 120 turns the LED off and lights a point where the jamming occurred, i.e., a region around the sensor that has detected the jamming of the banknotes, with an LED. When the jammed ones of the banknotes are removed, the control unit 120 turns the LED off, and irradiates the unit on the main transport path 71 with an LED. When this unit is put back to its original position, the control unit 120 turns the LED off, and irradiates the unit of the first and second non-bundling stackers 5A, 5B with the LED. When this unit is put back to its original position, the control unit 120 turns the LED off.

When turned ON, the LEDs may be lit simply or may blink. In the example described above, different points of work are supposed to be irradiated with LEDs one after another, but if a series of work needs to be done in a certain continuous region, the LED associated with the region may be turned ON continuously. Alternatively, the lighting of the LEDs may be omitted as appropriate. For example, when the units are put back to their original positions after intended work (e.g., removal of the jammed banknotes) is finished, the LED does not have to be turned ON, and only the instruction may be displayed on the touch panel 17.

In the foregoing description, the work to be performed as troubleshooting for the jamming of the banknotes on the main transport path 71 between the recognition unit 3 and the first diverged path 72*a* has been described as an example. However, to prompt the operator to do a different kind of work on a different point, the instructions are displayed on the touch panel 17 and the LEDs are turned ON in accordance with the procedure associated with the different kind of work.

<Conclusion>

Thus, the banknote handling apparatus 100 functions as a paper sheet bundling apparatus configured to bundle stacked banknotes with a tape T, and includes bundling stackers 4, 4 configured to stack the banknotes, a tape loop forming unit 92 configured to form a small tape loop L1 from the tape T and feed the tape T to enlarge the small tape loop L1 into a large tape loop L2, and a second transport unit 8 configured to grip the banknotes stacked in the bundling stacker 4 to transport the banknotes into the large tape loop L2.

According to this configuration, a tape loop L which is large enough to receive the banknotes transported thereto is not formed from the beginning, but a small tape loop L1 is formed first, and then is enlarged into a large tape loop L2. This allows easy formation of such a tape loop L that is large enough to receive the banknotes transported thereto. In addition, the second transport unit 8 transports the banknotes stacked in the bundling stacker 4 automatically into the large tape loop L2, thereby bundling the banknotes more easily as compared with the configuration in which the banknotes are transported manually into the tape loop L.

Moreover, the large tape loop L2 is formed synchronously with the transport of the banknotes from the bundling stacker 4 by the second transport unit 8. This allows shortening of the time it takes from the stacking through the bundling of the banknotes.

In one embodiment, the second transport unit 8 transports the banknotes into the large tape loop L2 by moving the banknotes in a direction parallel to longer edges thereof.

This configuration allows winding of the tape T around the banknotes in a direction parallel to their shorter edges by rewinding the tape T forming the large tape loop L2.

In another embodiment, the second transport unit 8 removes the banknotes from the bundling stacker 4 by moving the banknotes in the direction parallel to shorter edges thereof.

According to this configuration, the banknotes are removed in the direction parallel to their shorter edges, and thus the distance traveled by the banknotes removed from the bundling stacker 4 is reducible as compared with the configuration in which the banknotes are removed in the direction parallel to their longer edges. That is to say, the distance traveled by the second transport unit 8 is reducible, which eventually allows saving of the space in the banknote handling apparatus 100.

In still another embodiment, the bundling stacker 4 includes a plurality of bundling stackers. The second transport unit 8 removes the banknotes from a selected one of the plurality of bundling stackers 4, 4 and transports the removed banknotes into the large tape loop L2.

According to this configuration, the second transport unit 8 transports the banknotes automatically from the selected one of the plurality of bundling stackers 4, 4 into the large tape loop L2. As a result, the process to be performed until the banknotes stacked in the bundling stacker 4 are bundled is carried out more efficiently and more quickly than in the case where the same process is performed manually.

The plurality of bundling stackers 4, 4 are arranged at different positions in a vertical direction, and the second transport unit 8 moves in the vertical direction after having removed the banknotes from the bundling stacker 4.

According to this configuration, the second transport unit 8 is allowed to move the banknotes in at least three different directions, namely, the vertical direction, the direction parallel to their shorter edges, and the direction parallel to their longer edges. This allows transportation of the banknotes to various different locations through various different paths.

In yet another embodiment, the banknote handling apparatus 100 further includes a temporary gripping unit 93 configured to temporarily grip the banknotes transported into the large tape loop L2. The second transport unit 8 retreats from a bundling position of the tape T after the temporary gripping unit 93 has gripped the banknotes.

According to this configuration, the second transport unit 8 retreats from the bundling position for bundling the banknotes when the banknotes are bundled together with the tape T, and thus the second transport unit 8 is allowed to grip the banknotes in transporting the banknotes into the large tape loop L2 without taking the bundling position into account. That is to say, in transporting the banknotes into the large tape loop L2, the second transport unit 8 is allowed to grip the banknotes at a suitable position for the transport.

The banknote handling apparatus 100 further includes a third transport unit 10 configured to transport the bundled banknotes in the direction parallel to their shorter edges. The second transport unit 8 draws the bundled banknotes in an opposite direction to the direction of transport of the banknotes into the large tape loop L2, and the third transport unit 10 transports the bundled banknotes drawn by the second transport unit 8.

According to this configuration, the bundled banknotes are not transported simply in the direction parallel to their shorter edges, but are once drawn in the direction parallel to their longer edges, and then transported in the direction parallel to their shorter edges. For example, in the configuration in which the tape T is gripped by a tape gripping part 921 at the end portion thereof to form a tape loop L, and then rewound after the banknotes are transported into the tape loop L to wind the tape T around the banknotes, a base plate 922*a* of the tape gripping part 921 is also bundled together with the banknotes by the tape T. In such a configuration, the base plate 922*a* is withdrawable from the gap between the tape T and the banknotes by once drawing the bundled banknotes in the direction parallel to their longer edges. After the base plate 922*a* has been withdrawn from the gap between the tape T and the banknotes, the bundled banknotes may be transported in the direction parallel to their shorter edges. In some cases, some structure may be present at the destination of the banknotes moving in the direction parallel to their shorter edges from the position where the banknotes are bundled. In such a case, the bundled banknotes are once drawn in the direction parallel to their longer edges so as to be transported in the direction parallel to their shorter edges while avoiding contact with the structure.

Further, the banknote handling apparatus 100 further includes a guide 925 configured to come into contact with an outer peripheral surface of the large tape loop L2 to define the shape of the large tape loop L2 when the tape loop forming unit 92 forms the large tape loop L2.

This configuration allows formation of the large tape loop L2 into a suitable shape.

The tape loop forming unit 92 includes a tape gripping part 921 which rotates while gripping the tape T at an end portion thereof to form the small tape loop L1 and a pair of feed rollers 920 which feeds the tape T to enlarge the small tape loop L1 into the large tape loop L2, and forms the large tape loop L2 under the tape gripping part 921.

According to this configuration, the small tape loop L1 expands downward from the tape gripping part 921, and the large tape loop L2 is formed under the tape gripping part 921 finally. If the small tape loop L1 expands upward, a portion of the tape loop L may sag downward due to the tape's own weight during the formation of the large tape loop L2, because the tape T is flexible. On the other hand, if the small tape loop L1 is configured to expand downward, the tape loop L does not sag easily during the formation of the large tape loop L2. That is to say, the large tape loop L2 is formed easily.

The banknote handling apparatus 100 further includes a heater 95 configured to bond together portions of the tape T wound around the banknotes, and a cutter 96 configured to cut the tape T at a portion not wound around the banknotes. At least one of the heater 95 and the cutter 96 is arranged above the tape gripping part 921.

In another embodiment, the banknote handling apparatus 100 further includes a guide 925 configured to come into contact with an outer peripheral surface of the large tape loop L2 to define the shape of the large tape loop L when the tape loop forming unit 92 forms the large tape loop L2. The guide 925 includes a lower guide 926 which comes into contact with the outer peripheral surface of the large tape loop L2 from under the large tape loop L2 to define the shape of the large tape loop L2.

According to this configuration, the small tape loop L1 expands downward to form the large tape loop L2. Thus, the large tape loop L2 tends to expand downward due to the tape (T)'s own weight and have a vertically elongated shape. On the other hand, providing the lower guide 926 allows formation of the large tape loop L2, which tends to be elongated vertically, into a desired shape.

In this particular embodiment, the lower guide 926 has a pair of sidewalls which regulates the position of the tape T in a tape width direction.

According to this configuration, the lower guide 926 allows formation of the large tape loop L2 into a desired shape, and for regulating the position of the tape T in the tape width direction.

In another embodiment, the banknote handling apparatus 100 further includes first and second lateral guides 927 and 928 configured to come into contact with the outer peripheral surface of the large tape loop L2 horizontally with respect to the large tape loop L2 to define the shape of the large tape loop L2 when the tape loop forming unit 92 forms the large tape loop L2.

This configuration allows defining of the shape of the large tape loop L2 not only from below the large tape loop L2 but also horizontally. Thus, the large tape loop L2 is easily formed into a desired shape.

The second lateral guide 928 is configured to retreat during the transport of the bundled banknotes so as not to interfere with the transport of the bundled banknotes.

According to this configuration, even if the second lateral guide 928 which comes into contact with the large tape loop L2 horizontally is provided, the second lateral guide 928 retreats after the banknotes have been bundled together. Thus, the bundled banknotes are movable toward the position where the second lateral guide 928 was located.

The guide 925 defines the shape of the large tape loop L2 as a rectangle having rounded corners.

According to this configuration, the large tape loop L2 that is large enough to receive the banknotes transported thereto may be formed out of as short a tape T as possible. That is to say, in the configuration in which the banknotes are moved in the direction parallel to their longer edges and transported into the large tape loop L2, the cross-sectional shape of the banknotes orthogonal to the moving direction of the banknotes is rectangular. Thus, by forming the large tape loop L2 in the rectangular shape, too, an extra portion of the tape T to use to form the large tape loop is reducible as much as possible. Note that shaping the large tape loop L2 into a rectangle having rounded corners instead of a regular rectangle allows smooth feeding of the tape T in forming the large tape loop L2, and for smooth rewinding of the tape T in winding the tape T around the banknotes.

In yet another embodiment, the banknote handling apparatus 100 further includes a clamp 94 configured to press the banknotes in a stacking direction when the banknotes are bundled together with the tape T. When the banknotes are bundled with the tape T, at least a portion of the tape gripping part 921 (specifically, the base plate 922*a*) is caught in a gap between the tape T and an upper surface of the bundled banknotes. The second transport unit 8 draws the bundled banknotes in an opposite direction to the direction of transport of the bundled banknotes into the large tape loop L2 until the tape gripping part 921 is withdrawn from the gap between the tape T and the banknotes. The clamp 94 includes a pair of upper clamps 941, 942 which are arranged on respective sides of the tape T in a tape width direction above the banknotes, and a pair of lower clamps 943, 944 which are provided on the respective sides of the tape T in the tape width direction below the banknotes and are configured to be movable vertically so as to sandwich the banknotes between the upper and lower clamps 941, 942 and 943, 944. One of the pair of upper clamps 941, 942 on one side of the tape T, toward which the banknotes are drawn, is configured to move upward when the bundled banknotes are drawn.

According to this configuration, the base plate 922*a* of the tape gripping part 921 needs to be withdrawn from the gap between the tape T and the banknotes to transport the bundled banknotes. The base plate 922*a* is not displaceable in the direction parallel to the longer edges of the banknotes, and therefore, the bundled banknotes are moved in the direction parallel to their longer edges to withdraw the base plate 922*a* from the gap between the tape T and the banknotes. Note that the upper movable clamp 942 is located on the side of the tape T toward which the bundled banknotes are drawn in the direction parallel to their longer edges, and thus the tape T may be caught on the upper movable clamp 942 when the bundled banknotes are drawn. Therefore, the upper movable clamp 942 is moved upward when the bundled banknotes are drawn. This allows drawing of the bundled banknotes while preventing the tape T from coming into contact with the upper movable clamp 942.

In yet another embodiment, the banknote handling apparatus 100 further includes a second tape sensor 9211 configured to detect that the large tape loop L2 has reached a predetermined size.

This configuration allows determination of whether the large tape loop L2 has been formed successfully or not.

In a specific embodiment, the first tape sensor 9210 detects that the large tape loop L2 has reached the predetermined size by determining whether or not the tape T is present at a predetermined position above the banknotes transported into the large tape loop L2.

This configuration allows detection of the sag of the large tape loop L2 accurately. That is to say, if any portion of the large tape loop L2 sags inward, it is highly likely that the upper portion of the large tape loop L2 sags due to the tape (T)'s own weight. Thus, providing the second tape sensor 9211 at the above-described position allows detection of the sag of the large tape loop L2 at the position where the large tape loop L2 tends to sag.

In yet another embodiment, the tape loop forming unit 92 rewinds the tape T if the second tape sensor 9211 does not detect that the large tape loop L2 has reached the predetermined size even when the tape T is fed to the length that allows formation of the large tape loop L2, and then feeds the tape T again to the length that allows formation of the large tape loop L2.

This configuration allows a retry of the formation of the large tape loop L2 if the large tape loop L2 has not been formed properly even if the tape T is fed to the predetermined length. In that case, the tape T is once rewound and then fed again. Thus, if the large tape loop L2 has not been formed properly due to the sag of the tape T, the large tape loop L2 may possibly be formed properly by feeding the tape T again.

Other Embodiments

Embodiments have just been described as examples of the technique disclosed in the present application. However, the present disclosure is not limited to those exemplary embodiments, but is also applicable to other embodiments which are altered or substituted, to which other features are added, or from which some features are omitted, as needed. Optionally, the components described in those embodiments may be combined to create a new embodiment. The components illustrated on the accompanying drawings and described in the detailed description include not only essential components that need to be used to overcome the problem, but also other unessential components that do not have to be used to overcome the problem but that are illustrated or mentioned there just for the sake of showing a typical example of the technique. Therefore, such unessential components should not be taken for essential ones, simply because such unessential components are illustrated in the drawings or mentioned in the detailed description.

The above-described embodiments may be modified in the following manner.

In the above-described embodiments, the banknote handling apparatus 100 has been described as an example of the paper sheet bundling apparatus. However, the paper sheet bundling apparatus is not limited to the banknote handling apparatus 100. For example, recognition, sorting, and stacking of the paper sheets may be performed by a different apparatus, and the paper sheet bundling apparatus may only bundle the stacked paper sheets loaded into the apparatus. Further, in the foregoing description, banknotes are supposed to be used as exemplary paper sheets. However, the paper sheets do not have to be banknotes, and may be vouchers such as gift certificates.

The configuration of the banknote handling apparatus 100 described above is merely an example, and the present disclosure is not limited thereto. For example, the banknote handling apparatus 100 described above is provided with two bundling stackers 4, two non-bundling stackers 5, and a single reject stacker 6. However, the numbers of these stackers are just an example and not limiting. For example, one bundling stacker 4 or three or more bundling stackers 4 may be provided. One non-bundling stacker 5 or three or more non-bundling stackers 5 may be provided. Two or more reject stackers 6 may be provided. Alternatively, the non-bundling stackers 5 and the reject stacker 6 may even be omitted.

In the above-described embodiments, the inlet 24, the dispense port 111 and the reject outlet 63 are provided through the first side surface 123, and the first and second outlets 47 and 53 and the touch panel 17 are provided for the second side surface 124. However, this arrangement is merely an example.

Further, the banknote handling apparatus 100 is supposed to perform a single kind banknote bundling process, but this is only a non-limiting exemplary embodiment of the present disclosure. For example, the banknote handling apparatus 100 may perform a multiple kind banknote bundling process, in which banknotes of multiple different kinds are supposed to be bundled together, the two bundling stackers 4, 4 are supposed to stack banknotes of different kinds, and a predetermined number of banknotes stacked in each of the bundling stackers 4 are bundled by the bundling unit 9. That is, the first and second bundling stackers 4A and 4B may stack the banknotes of mutually different kinds.

The banknote handling apparatus 100 is supposed to handle loose banknotes including banknotes of multiple different denominations, but the banknotes to be handled by the apparatus are not always the banknotes of multiple different denominations. The banknote handling apparatus 100 may be configured to handle banknotes of a single predetermined denomination as well.

Figure 25:
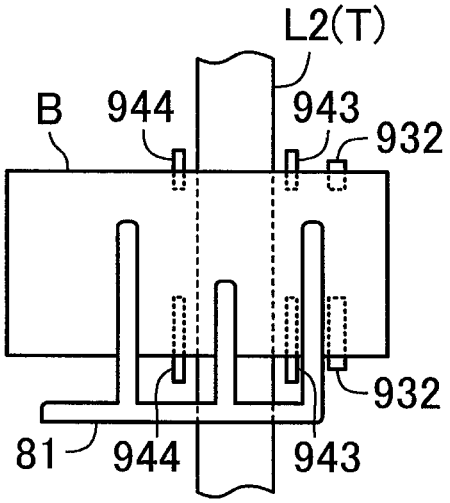
Figure 25:
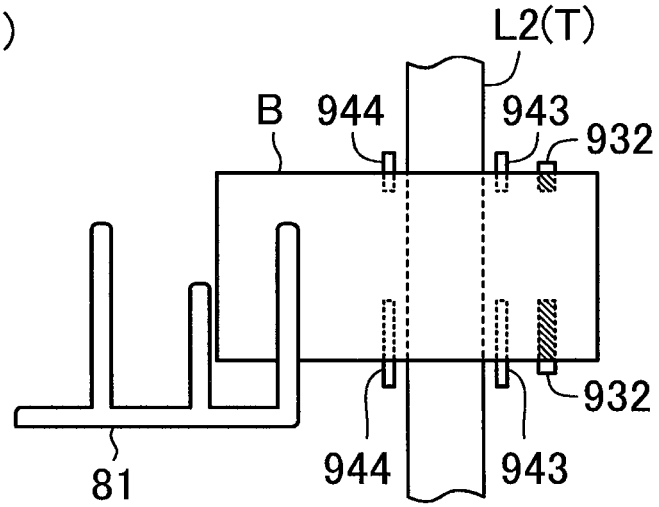

In the embodiments described above, the banknotes B are supposed to be bundled together along a centerline that connects together the respective middles of their longer edges. However, this is just an exemplary embodiment of the present disclosure. Alternatively, as shown in FIGS. 25(A) and 25(B), the banknotes B may also be bundled together such that one of the edges of the tape T is aligned with the centerline connecting the respective middles of the longer edges of the banknotes B. In that case, the degree of insertion of the banknotes B into the large tape loop L2 transported by the second transport unit 8 is adjusted as shown in FIG. 25(A). That is, as compared with the embodiments described above, the distance to travel is reduced for the banknotes B transported. Note that the position of the temporary gripping unit 93 is adjusted according to the degree of insertion (i.e., the distance to travel) of the banknotes into the large tape loop L2 by the second transport unit 8. The greater the degree of insertion of the banknotes B is, the farther away from the tape T the temporary gripping unit 93 moves in the second horizontal direction. In this example, the degree of insertion of the banknotes B is so small that the temporary gripping unit 93 is located closer to the tape T as compared with the embodiments described above. That is, the smaller the degree of insertion of the banknotes B is, the closer to the tape T the temporary gripping unit 93 grips the banknotes B. As a result, the temporary gripping unit 93 is allowed to grip the banknotes B suitably even if the degree of insertion of the banknotes B is small.

Further, in the embodiments described above, the stamper 98 is supposed to be arranged under the banknotes B to stamp a seal on the tape T from the stacking direction of the banknotes B, but the configuration of the stamper 98 is not limited thereto. The stamper 98 may also be arranged at any position. Alternatively, the stamper 98 may stamp a seal on the tape T from any arbitrary direction. For example, the stamper 98 may stamp a seal on the tape T from the direction orthogonal to the stacking direction. Note that if the stamper 98 is configured to stamp a seal on the tape T wound around the banknotes B in the bundling unit 9, the seal is stamped reliably on the tape T at an almost fixed position. That is, if the seal is stamped on the tape T after the banknotes B have been transported from the bundling unit 9, the positions of the banknotes B and tape T need to be detected and regulated. However, in the bundling unit 9, the banknotes B are placed at the fixed position, so is the tape T wound around the banknotes B. Thus, if the tape T is wound around the banknotes B in the bundling unit 9, the seal is stamped on an almost fixed position on the tape T even without detecting or regulating the positions of the banknotes B and tape T.

Further, in the above-described embodiments, the bonding by the heater 95 and the cutting by the cutter 96 are performed synchronously with the stamping by the stamper 98, but these processes may be performed in different ways. For example, the bonding and the cutting by the heater 95 and the cutter 96 and the stamping by the stamper 98 may be performed in totally different periods of time, or may also be performed so that their processing time periods partially overlap with each other. Still alternatively, one of the processing time periods may completely overlap with the other.

Further, in the above-described embodiments, the banknotes stacked in the bundling stacker 4 are compressed by moving the stage 41 upward, but the compression may be performed in different ways. For example, a pressing unit for compressing the banknotes downward may additionally be provided for the bundling stacker 4.

The second transport unit 8 is supposed to further compress and sandwich the banknotes B that have already been compressed by the stage 41 and the top plate 44, but the configuration of the second transport unit 8 is not limited thereto. The second transport unit 8 may sandwich the banknotes B that have been compressed by the stage 41 and the top plate 44 by the same compressive force as the one applied by the stage 41 and the top plate 44. In that case, the stage 41 may be configured to move downward to decompress the banknotes after the second transport unit 8 has sandwiched the banknotes. As a result, the banknotes B compressed by the stage 41 and the top plate 44 may be passed smoothly to the second transport unit 8. In addition, the second transport unit 8 is allowed to remove the banknotes easily from the bundling stacker 4.

Further, in the above-described embodiments, the stacking direction of the banknotes stacked in the bundling stacker. 4 corresponds with the vertical direction. However, this is only an exemplary embodiment of the present disclosure. For example, the banknotes may be stacked substantially horizontally in the bundling stacker 4. That is, the banknotes may also be housed in an upright position in the bundling stacker 4. In this case, for example, the stacked banknotes may lean on a wall such that a normal to the wall extends substantially horizontally in the bundling stacker 4. Thus, if the banknotes are stacked substantially horizontally, a support such as a wall is provided on one of the two sides of the banknotes stacked in the stacking direction to support the stacked banknotes. In such a configuration, provided is a compressing unit configured to press the banknotes in the stacking direction from the other side of the banknotes B opposite from the support when the banknotes are stacked. Thus, the stacked banknotes are compressed by the compressing unit and the support in their stacking direction, i.e., substantially horizontally.

INDUSTRIAL APPLICABILITY

As can be seen from the foregoing, the present disclosure is useful for a paper sheet bundling apparatus which bundles stacked paper sheets with a tape.

DESCRIPTION OF REFERENCE CHARACTERS

100 Banknote Handling Apparatus (Paper Sheet Bundling Apparatus)
4 Bundling Stacker (Stacking Unit)
41 Stage (Compressing Unit)
44 Top Plate (Compressing Unit)
7 First Transport Unit
8 Second Transport Unit (Paper Sheet Transport Unit)
9 Bundling Unit
92 Tape Loop Forming Unit
920 Pair of Feed Rollers (Feeder)
921 Tape Gripping Part
925 Guide
926 Lower Guide
926*a* Sidewall
926*e* Third Tape Sensor (Fall Detection Sensor)
927 First Lateral guide (Lateral Guide)
928 Second Lateral guide (Lateral Guide)
9211 Second Tape Sensor (Tape Loop Detection Sensor)
93 Temporary Gripping Unit
94 Clamp
941 Upper Fixed Clamp
942 Upper Movable Clamp
943 Lower Clamp
944 Lower Clamp
95 Heater (Bonding Unit)
96 Cutter (Cutting Unit)
97 Printer
B Banknotes (Paper Sheets)
L Tape Loop
L1 Small Tape Loop
L2 Large Tape Loop
T Tape

The invention claimed is:

1. A sheet bundling apparatus comprising:
a stacking unit configured to stack sheets taken from outside into the apparatus;
a tape loop forming unit configured to form a tape loop from a tape, configured to enlarge the tape loop and configured to shrink the enlarged tape;
a sheet transport unit configured to transport the sheets stacked in the stacking unit into the tape loop forming unit;
a guide configured to come into contact with an outer peripheral surface of the enlarged tape loop when the tape loop forming unit forms the enlarged tape loop; and
a control unit configured to control the apparatus,
wherein
the guide includes a lower guide configured to come into contact with the outer peripheral surface of the enlarged tape loop from under the enlarged tape loop, the lower guide configured to move in a vertical direction; and
the control unit is configured to control the apparatus such that after the tape loop forming unit forms the enlarged tape loop from the tape loop, and the sheet transport unit transports the sheets stacked in the stacking unit into the enlarged tape loop, the lower guide moves upward in the vertical direction when the enlarged tape loop is shrunk.

2. The sheet bundling apparatus of claim 1, wherein
the sheet transport unit is configured to transport the sheets into the enlarged tape loop by moving the sheets in a direction parallel to longer edges of the sheets.

3. The sheet bundling apparatus of claim 2, further comprising:
a bundle transport unit configured to transport the bundled sheets in a direction parallel to shorter edges of the sheets, wherein
the sheet transport unit is configured to draw the bundled sheets in an opposite direction to the direction of transport of the sheets into the enlarged tape loop, and
the bundle transport unit is configured to transport the bundled sheets drawn by the sheet transport unit.

4. The sheet bundling apparatus of claim 1, wherein
the sheet transport unit is configured to remove the sheets from the stacking unit by moving the sheets in a direction parallel to shorter edges of the sheets.

5. The sheet bundling apparatus of claim 1, wherein
the stacking unit that includes a plurality of stacking units, and
the sheet transport unit is configured to remove the sheets from a selected one of the stacking units and transport the removed sheets into the enlarged tape loop.

6. The sheet bundling apparatus of claim 5, wherein
the plurality of stacking units are arranged at different positions in a vertical direction, and
the sheet transport unit is configured to move in the vertical direction after having removed the sheets from the stacking unit.

7. The sheet bundling apparatus of claim 1, further comprising:
a temporary gripping unit configured to temporarily grip the sheets transported into the enlarged tape loop, wherein
the sheet transport unit is configured to move from a bundling position of the tape after the temporary gripping unit has gripped the sheets.

8. The sheet bundling apparatus of claim 1,
wherein the guide further comprises a lateral guide configured to come into contact with a vertical portion of the enlarged tape loop to define the enlarged tape loop.

9. The sheet bundling apparatus of claim 8, wherein
the lateral guide is configured to move during the transport of the bundled sheets so as not to interfere with the transport of the bundled sheets.

10. The sheet bundling apparatus of claim 1, wherein
the tape loop forming unit further comprises a feeder, and
the control unit is configured to control the apparatus, such that after the enlarged tape loop is formed, the feeder rewinds the tape so that the sheets transported into the enlarged tape loop by the sheet transport unit are bundled with the tape.

11. The sheet bundling apparatus of claim 1, wherein
the control unit is configured to control the apparatus such that, after the tape forming unit finishes forming the enlarged tape loop, the sheet transport unit transports the sheets into the enlarged tape loop.

12. The sheet bundling apparatus of claim 1, wherein a tape loop forming unit includes a feeder configured to feed a tape and to rewind the fed tape, and a tape gripping part configured to grip an end portion of the fed tape, the tape gripping part rotating about an axis to form a tape loop from the fed tape by the rotation of the tape gripping part, the tape loop forming unit configured to enlarge the tape loop by the feeder feeding the tape and configured to shrink the enlarged tape by the feeder rewinding the tape; and the control unit is configured to control the apparatus such that after the tape gripping part gripping the end portion of the fed tape forms the tape loop under the tape gripping part by the rotation of the tape gripping part about the axis, the feeder feeds the tape about the tape gripping part to form the enlarged tape loop from the tape loop under the tape gripping part, the sheet transport unit transports the sheets stacked in the stacking unit into the enlarged tape loop, and the lower guide moves upward in the vertical direction when the enlarged tape loop is shrunk by the feeder rewinding the tape.

* * * * *